US010053759B2

(12) United States Patent
Yan et al.

(10) Patent No.: US 10,053,759 B2
(45) Date of Patent: Aug. 21, 2018

(54) COMPUTATIONALLY-DESIGNED TRANSFORMATION-TOUGHENED NEAR-ALPHA TITANIUM ALLOY

(71) Applicant: NORTHWESTERN UNIVERSITY, Evanston, IL (US)

(72) Inventors: Jiayi Yan, Tianjin (CN); Gregory B. Olson, Riverwoods, IL (US)

(73) Assignee: NORTHWESTERN UNIVERSITY, Evanston, IL (US)

( * ) Notice: Subject to any disclaimer, the term of this patent is extended or adjusted under 35 U.S.C. 154(b) by 326 days.

(21) Appl. No.: 14/839,215

(22) Filed: Aug. 28, 2015

(65) Prior Publication Data

US 2016/0060742 A1 Mar. 3, 2016

Related U.S. Application Data

(60) Provisional application No. 62/043,897, filed on Aug. 29, 2014.

(51) Int. Cl.
*C22F 1/18* (2006.01)
*C22C 14/00* (2006.01)

(52) U.S. Cl.
CPC ..... *C22F 1/183* (2013.01); *C22C 14/00* (2013.01)

(58) Field of Classification Search
CPC ..... C22F 1/183; C22C 14/00
See application file for complete search history.

(56) References Cited

PUBLICATIONS

Bein, S. et al., Phase Transformation Kinetics and Mechanisms in Titanium Alloys Ti-6.2.4.6, beta-CEZ and Ti-10.2.3, Supplement of The Journal De Physique III, vol. 6(C1): p. C1-99-C1-108, Jan. 1996.
Morral, J.E. Morral et al., Particle Coarsening in Binary and Multicomponent Alloys, Scripta Metallurgica Et Materialia, vol. 30(7): p. 905-908, 1994.
Liu, Y.J. et al., Computational Study of Mobilities and Diffusivities in bcc Ti—Zr and bcc Ti—Mo Alloys, Journal of Phase Equilibria and Diffusion, vol. 30(4): p. 334-344, 2009.
(Continued)

*Primary Examiner* — Jessee Roe
(74) *Attorney, Agent, or Firm* — Locke Lord LLP; Tim Tingkang Xia, Esq.

(57) ABSTRACT

In one aspect, a method of computationally designing a near-α transformation-induced plasticity (TRIP) titanium (Ti) alloy is provided. A thermodynamic database of Ti alloys is created. The data of the thermodynamic database is tailored for martensitic transformations in the Ti alloys near room temperature. Then an overall composite of the near-α TRIP Ti alloy may be obtained by adjusting a reference overall composite of a reference near-α Ti alloy based on the tailored data in the thermodynamic database. In certain embodiments, an annealing temperature of the near-α TRIP Ti alloy may be determined such that a $M_S^o$(ct) temperature of the near-α TRIP Ti alloy is about room temperature. In certain embodiments, the near-α TRIP Ti alloy is Ti-8Al-1V-1Sn-1Zr-0.6Mo-0.9Fe-0.1Si-0.1O by weight percentage. In certain embodiments, the near-α TRIP Ti alloy may be cooled at a cooling rate greater than 20° C./min after annealing to inhibit formation of grain-boundary α (GB-α) phase.

10 Claims, 25 Drawing Sheets

(56) References Cited

PUBLICATIONS

Liu, Y.J. et al., Kinetic modeling of diffusion mobilities in bcc Ti—Nb alloys, Journal of Alloys and Compounds, vol. 476(1-2): p. 429-435, 2009.
Liu, Y.J. et al., Study of atomic mobilities and diffusion characteristics in bcc Ti—Ta and Ta—W alloys, Calphad, vol. 34(3): p. 310-316, 2010.
Murray, J.L.,The Ti—V (Titanium-Vanadium) System, Bulletin of Alloy Phase Diagrams, vol. 2(1): p. 48-55, 1981.
Murray, J.L., The Fe—Ti (Iron-Titanium) System, Bulletin of Alloy Phase Diagrams, vol. 2(3): p. 320-334, 1981.
Murray, J.L., The Mo—Ti (Molybdenum-Titanium) System, Bulletin of Alloy Phase Diagrams, vol. 2(2): p. 185-192, 1981.
Murray, J.L., The Nb—Ti (Niobium-Titanium) System, Bulletin of Alloy Phase Diagrams, vol. 2(1): p. 55-61, 1981.
Miyazaki, S. et al., Development and characterization of Ni-free Ti-base shape memory and superelastic alloys, Materials Science and Engineering A, vol. 438: p. 18-24, Feb. 2006.
R.H. Leal, Transformation Toughening of Metastable Austenitic Steels, PhD Thesis, Massachusetts Institute of Technology, 1984.
Tran, Jamie, Titanium by Design: TRIP Titanium Alloy, A Dissertation, Ph.D. Thesis, Northwestern University, p. 1-238, Dec. 2009.
Banerjee, D. et al., Perspectives on Titanium Science and Technology, Acta Materialia, vol. 61(3): p. 844-879, 2013.
Duerig, M. et al., Stress Assisted Transformation in Ti—10V—2Fe—3Al, Titanium '80 Science and Technology—Proceedings of the 4th Int'l Conf. on Titanium, H. Kimura and O. Izuma, Editors, vol. 2, p. 1503-1508, 1980.
Young, Chune-Ching, Transformation Toughening in Phosphocarbide-Strengthened Austenitic Steels, Ph.D. Thesis, Massachusetts Institute of Technology, p. 1-179, Mar. 1988.
Olson, G.B. et al., Stress-Assisted Isothermal Martensitic Transformation: Application to TRIP Steels, Metallurgical Transactions A, vol. 13(11): p. 1907-1914, Nov. 1982.
Olson, G.B., et al., Computational Design of Hierarchically Structured Materials. Science, vol. 277(5330): p. 1237-1242, Aug. 1997.
Anderson J-O, et al., Thermo-Calc & Dictra, Computational Tools for Materials Science, Calphad, vol. 26 (2): p. 273-312, 2002.
Gosh, G. et al., Computational Thermodynamics and the Kinetics of Martensitic Transformation, Journal of Phase Equilibria, vol. 22(3): p. 199-207, 2001.
Hohenberg, P. et al., Inhomogeneous Electron gas, Physical Review, vol. 136(3B): p. B864-B871, Nov. 1964.
Kohn, W. et al., Self-Consistent Equations Including Exchange and Correlation Effects. Physical Review, vol. 140 (4A): p. A1133-A1138, Nov. 1965.
Peil, O.E. et al., Self-consistent supercell approach to alloys with local environment effects, Physical Review, vol. 85(16B): p. 1-15, 2012.
Abrikosov, I.A. et al., Order-N Green's Function Technique for Local Environment Effects in Alloys, Physical Review Letters, vol. 76(22): p. 4203-4206, May 1996.
Abrikosov, I.A. et al., Locally self-consistent Green's function approach to the electronic structure problem, Physical Review B, vol. 56(15):p. 9319-9334, Oct. 1997.
Giannozzi, Paolo et al., Quantum Espresso: a modular and open-source software project for quantum simulations of materials, Journal of Physics—Condensed Matter, vol. 21(395502), p. 1-19, Sep. 2009.
Garrity, K.F. et al., Pseudopotentials for high-throughput DFT calculations, Computational Materials Science, vol. 81, p. 446-452, Jan. 2014.
Wang, Y. et al., Ab initio lattice stability in comparison with Calphad lattice stability, Calphad, vol. 28(1): p. 79-90, Jun. 2004.
Dinsdale A.T., SGTE Data For Pure Elements, Calphad, vol. 15(4): p. 317-425, 1991.
Vrest'al, J. et al., Extension of SGTE data for pure elements to zero Kelvin temperature—A case study, Calphad, vol. 37: p. 37-48, 2012.
Mei, Z.G. et al., Density-functional study of the thermodynamic properties and the pressure-temperature phase diagram of Ti, Physical Review B, vol. 80(104116): p. 1-9, 2009.
Salzbrenner, R.J. et al., On The Thermodynamics of Thermoelastic Martensitic Transformations, Acta Metallurgica, vol. 27(5): p. 739-748, 1979.
Hanada, S. et al., Deformation Characteristics in beta-Phase Ti—Nb Alloys, Metallurgical Transactions A, vol. 16A(5): p. 789-795, May 1985.
Paton, N.E. et al., The Influence of Oxygen Content on the Athermal beta-omega Transformation, Scripta Metallurgica, vol. 7(6): p. 647-649, 1973.
Ikeda, M. et al., Resistometric Estimation of Temperature Range of Athermal Omega Phase Formation in Quenched Ti—V Alloys, Journal of the Japan Institute of Metals, vol. 54(7): p. 743-751, 1990.
Pietrokowsky, P. et al., Partial Titanium-Vanadium Phase Diagram, Transactions of the American Institute of Mining and Metallurgical Engineers, vol. 194(6): p. 627-630, Jun. 1952.
Kaneko, H. et al., Allotropic Transformation Characteristics of Titanium Alloys during Continuous Cooling, Journal of the Japan Institute of Metals, vol. 27(8): p. 387, 1963.
Sato, T. et al., The Ms Points of Binary Titanium Alloys, Journal of the Australian Institute of Metals, vol. 5(2): p. 149-153, Aug. 1960.
Kaneko, H. et al., Some Considerations on the Continuous Cooling Diagrams and Ms points of Titanium-base Alloys, Journal of the Japan Institute of Metals, vol. 27(8): p. 403-406, 1963.
Mirzaev, D.A. et al., Effect of Rapid Cooling on the Polymorphic Transformation in Titanium-Molybdenum Alloys, The Physics of Metals and Metallography, vol. 81(5): p. 520-526, 1996.
Sukedai, E. et al., Electron microscopy study on Mo content dependence of beta to omega phase transformation due to cooling in Ti—Mo alloys, Journal of Electron Microscopy, vol. 51 (Supplement): p. S143-S147, 2002.
Jepson, K.S. et al., The Effect of Cooling Rate on the Beta Transformation in Titanium-Niobium and Titanium-Aluminum Alloys, Science Technology and Applications of Titanium: Proceedings of 1st International Conference on Titanium, R.I. Jaffee and N.E. Promisel, Pergamon Press: Oxford, New York. p. 677-690, 1970.
Brown, A.R.G. et al., The Titanium-Niobium System, Nature, vol. 201(492): p. 914-915, Feb. 1964.
Kim, H.Y. et al., Mechanical Properties and Shape Memory Behavior of Ti—Nb Alloys, Materials Transactions, vol. 45(7): p. 2443-2448, 2004.
Al-Zain, Y. et al., Shape memory properties of Ti—Nb—Mo biomedical alloys, Acta Materialia, vol. 58(12): p. 4212-4223, 2010.
Ikeda, M. et al., Temperature Range of Formation of Athermal omega Phase in Quenched beta Ti—Nb Alloys, Journal of the Japan Institute of Metals, vol. 52(12): p. 1206-1211, 1988.
Buenconsejo, P.J.S. et al., Shape memory behavior of Ti—Ta and its potential as a high-temperature shape memory alloy, Acta Materialia, vol. 57(4): p. 1068-1077, 2009.
Kaneko, H. et al., Continuous Cooling Transformation Characteristics of Titanium Alloys of Eutectoidal Type (Part 1), Journal of the Japan Institute of Metals, vol. 27(8): p. 393-397, 1963.
Dumitrescu, L.F.S. et al., Comparison of Fe—Ti Assessments, Journal of Phase Equilibria, vol. 19(5): p. 441-448, 1998.
Dyakonova, N.B. et al., Nanocrystalline Incommensurate Structures in Ti—Tm Alloys, Reviews on Advanced Materials Science, vol. 18(8): p. 703-710, 2008.
Matyka, J. et al., Study of Iron Solubility in Alpha-Titanium, Scripta Metallurgica, vol. 13(7): p. 645-648, 1979.
Raub et al., The Alpha-Ti—Fe Solid Solution and its Superconducting Properties, Journal of the Less-Common Metals, vol. 12(1): p. 36-40, 1967.
Stupel, M.M. et al., The Solubility of Iron in Alpha-Titanium in the Temperature Range 360-580-degrees-C, Journal of the Less-Common Metals, vol. 123: p. 1-7, 1986.
Turchanin, M.A. et al., Thermodynamic Assessment of the Cu—Ti—Zr System. II. Cu—Zr and Ti—Zr Systems, Powder Metallurgy and Metal Ceramics, vol. 47(7-8): p. 428-446, 2008.

(56) References Cited

OTHER PUBLICATIONS

Huang, Y.C. et al., Thermodynamics of the Ms Points in Titanium Alloys, Science Technology and Applications of Titanium: Proceedings of 1st International Conference on Titanium, R.I. Jaffee, p. 691-693, 1970.
Fukui, Y. et al., Mechanical Properties of a Ti—Nb—Al Shape Memory Alloy, Materials Transactions, vol. 45(4): p. 1077-1082, 2004.
Horiuchi, Y. et al., Effect of Boron Concentration on Martensitic Transformation Temperatures, Stress for Inducing Martensite and Slip Stress of Ti—24mol%Nb—3mol%Al Superelastic Alloy, Materials Transactions, vol. 48(3): p. 407-413, 2007.
Sun, F. et al., A thermo-mechanical treatment to improve the superelastic performances of biomedical Ti—26Nb and Ti—20Nb—6Zr (at.%) alloys, Journal of the Mechanical Behavior of Biomedical Materials, vol. 4(8): p. 1864-1872, 2011.
Matsumoto, H. et al., Beta TiNbSn Alloys with Low Young's Modulus and High Strength, Materials Transactions, vol. 46(5): p. 1070-1078, 2005.
Semboshi, S. et al., In-Situ Transmission Electron Microscopy Observation on the Phase Transformation of Ti—Nb—Sn Shape Memory Alloys, Metallurgical and Materials Transactions A, vol. 39A(12): p. 2820-2829, Dec. 2008.
Takahashi, E. et al., Effect of Heat Treatment and Sn Content on Superelasticity in Biocompatible TiNbSn Alloys, Materials Transactions, vol. 43(12): p. 2978-2983, 2002.
Nozoe, F. et al., Effect of Low Temperature Aging on Superelastic Behavior in Biocompatible beta TiNbSn Alloy, Materials Transactions, vol. 48(11): p. 3007-3013, 2007.
Ohyama, H. et al., Effects of Alloying Elements on Deformation Mode in Ti—V Based beta-Titanium Alloy System, ISIJ International, vol. 35(7): p. 927-936, 1995.
Takemoto, Y. et al., Microstructure and Mechanical Properties of Ti—Mo and Ti—6Mo-X-Y Alloys, Journal of the Japan Institute of Metals, vol. 73(9): p. 752-757, 2009.
Williams, J.C. et al., Tempering Behavior of Orthorhombic Martensite in Titanium Alloys, Metallurgical Transactions, vol. 1(9): p. 2648-2650, Sep. 1970.
Davis, R. et al., Martensitic transformations in Ti—Mo alloys, Journal of Materials Science, vol. 14(3): p. 712-722, 1979.
Oka, M. et al., Crystallography of Stress-Induced Products in Metastable beta Ti—Mo Alloys, Titanium ' 80, Science and Technology: Proceedings of the Fourth International Conference on Titanium, Kyoto, Japan, H. Kimura and O. Izumi, Editors. 1980, Metallurgical Society of AIME: Warrendale, PA. p. 709-715, May 1980.
Sasano, H. et al., Crystal Structure of Martensites in Ti—Mo—Al Alloys, Titanium ' 80, Science and Technology: Proceedings of the Fourth International Conference on Titanium, Kyoto, Japan, H. Kimura and O. Izumi, Editors. 1980, p. 717-724, May 1980.
Bagariatskii, Y.A. Bagariatskii et al., Laws of Formation of Metastable Phase in Titanium Alloys, Doklady Akademii Nauk Sssr, vol. 122: p. 593-596, 1958.
Banumathy, S. et al., Structure of orthorhombic martensitic phase in binary Ti—Nb alloys, Journal of Applied Physics, vol. 106(9): p. 093518-1-093518-6, 2009.
Hatt, B.A. et al., Phase transformation in superconducting Ti—Nb alloys, British Journal of Physics, vol. 2(1): p. 1145-1149, 1968.
Kim, H.Y. et al., Martensitic transformation, shape memory effect and superelasticity of Ti—Nb binary alloys, Acta Materialia, vol. 54(9): p. 2419-2429, 2006.
Dyakonova, N.B. et al., Orthorhombic Martensite and the omega Phase in Quenched and Deformed Titanium Alloys with 20-24 at%Nb, Russian Metallurgy, vol. (1): p. 51-58, 2007.
Jeong, H.W. et al., Analysis On the Martensitic Transformation In the Ti—xNb Alloys Using a Phenomenological Theory, Solid State Phenomena, vol. 124-126: p. 1669-1672, 2007.
Inamura, T. et al., Composition dependent crystallography of alpha-martensite in Ti—Nb-based beta-titanium alloy, Philosophical Magazine, vol. 87(23): p. 3325-3350, Aug. 2007 . . . .
Dobromyslov, A.V. et al., Phase and Structural Transformations in Ti—Ta Alloys, Physics of Metals and Metallography, vol. 107(5): p. 502-510, 2009.
Pak, J.S.L. et al., Atomic ordering in Ti—V—Al shape memory alloys, Materials Science and Engineering A, vol. 132: p. 237-244, 1991.
Duerig, T.W. et al., Formation and Reversion of Stress Induced Martensite in Ti—10V—2Fe—3Al, Acta Metallurgica, vol. 30(12): p. 2161-2172, 1982.
Aurelio, G. et al., Metastable Phases in the Ti—V System: Part I. Neutron Diffraction Study and Assessment of Structural Properties, Metallurgical and Materials Transactions A, 33A(5): p. 1307-1317, May 2002.
Leibovitch, C. et al., Phase Transformations in Metastable Ti—V Alloys Induced by High Pressure Treatment, Metallurgical Transactions A, vol. 12A(8): p. 1513-1519, Aug. 1981.
Ming, L.C. et al., Phase Transformations in the Ti—V System Under High Pressure up to 25GPa, Acta Metallurgica, vol. 29(3): p. 479-485, 1981.
Lu, X.G. et al., Assessments of molar volume and thermal expansion for selected bcc, fcc and hcp metallic elements, Calphad, vol. 29(1): p. 68-89, 2005.
Levinger, B.W., Lattice Parameter of Beta Ttitanium at Room Temperature, Transactions of the American Institute of Mining and Metallurgical Engineers, vol. 197(2): p. 195, Feb. 1953.
Fedotov, S.G. et al., Decomposition of the Metastable beta-Solid Solution of Titanium with Iron, translated from Doklady Akademii Nauk Sssr, vol. 216(2): p. 482-485, May 1974.
Guseva, L.N. et al., Metastable Phases in Titanium Alloys with Group VIII Elements Quenched from the beta Region, Russian Metallurgy, vol. (6): p. 155-159, 1974.
Ray, R. et al., The Constitution of Metastable Titanium-Rich Ti—Fe Alloys: An Order-Disorder Transition, Metallurgical Transactions, vol. 3(3): p. 627-629, Mar. 1972.
Hansen, M. Hansen et al., Systems Titanium-Molybdenum and Titanium-Columbium, Transactions of the American Institute of Mining and Metallurgical Engineers, vol. 191(10): p. 881-888, Oct. 1951.
Hake, R.R. et al., Electrical Resistivity, Hall Effect and Superconductivity of Some b.c.c. Titanium-Molybdenum Alloys, Journal of Physics and Chemistry of Solids, vol. 20(3-4): p. 177-186, 1961.
Terauchi, S. et al., Investigation of the Titanium-Molybdenum Binary Phase Diagram, Journal of the Japan Institute of Metals, vol. 41(6): p. 632-637, 1977.
Leibovitch, C. et al., The structural Stability and Superconductivity of Ti—Mo Alloys Under Pressure, Part 1, Structural Stability, Zeitschrift Fur Metallkunde, vol. 71(7): p. 438-447, 1980.
Adenstedt, H.K. et al., The Titanium-Vanadium System, Transactions of the American Society for Metals, vol. 44: p. 990-1003, 1952.
Ageyev, N.V. et al., Metastable Phases in Quenched Titanium-Molybdenum and Titanium-Vanadium Alloys and the Influence of Small Quantities of Oxygen on them, Russian Metallurgy, vol. (4): p. 113-117, 1975.
Nakano, O. et al., Phase Separation in Ti—V Alloys, Titanium ' 80, Science and Technology:Proceedings of the Fourth International Conference on Titanium, Kyoto, Japan, H. Kimura and O. Izumi, Editors. 1980, p. 2889-2895, May 1980.
Kim, H.Y. et al., Martensitic transformation and shape memory properties of Ti—Ta—Sn high temperature shape memory alloys, Materials Science and Engineering A, vol. 528(24): p. 7238-7246, 2011.
Dechamps, M. et al., Influence of the Distribution of the Interstitial Oxygen Atoms on the Lattice Parameters in Dilute H.C.P. Titanium-Oxygen Solid Solutions (90-4000 ppm at), Scripta Metallurgica, vol. 11(11): p. 941-945, 1977.
Ogden, H.R. et al., Constitution of Titanium-Aluminum Alloys, Transactions of the American Institute of Mining and Metallurgical Engineers, vol. 191(12): p. 1150-1155, Dec. 1951.
Clark, D. et al., A Study of the Titanium-Aluminum System up to 40 At.-% Aluminum, Journal of the Institute of Metals, vol. 91: p. 197-203, 1962.

(56) References Cited

OTHER PUBLICATIONS

Rostoker, W., Observations on the Lattice Parameters of the Alpha Solid Solution in the Titanium-Aluminum System, Transactions of the American Institute of Mining and Metallurgical Engineers, vol. 194(2): p. 212-213, Feb. 1952.

Bumps, E.S. Bumps et al., Titanium-Aluminum System, Transactions of the American Institute of Mining and Metallurgical Engineers, vol. 94(6): p. 609-614, Jun. 1952.

Gray, G.T. et al., Influence of Interstitial Oxygen on the Lattice Parameters of Solution-Treated and Aged Ti-8.6 wt% Al Alloys, Neutron Scattering for Materials Science, Material Research Society, vol. 166: p. 261-266, 1990.

Coucoulas, A. et al., The Influence of Hydrogen on the Lattice Parameters of Ti—Sn Alloys, Transactions of the American Institute of Mining and Metallurgical Engineers, vol. 218(5): p. 958-959, Oct. 1960.

Worner, H.W., The Structure of Titanium-Tin Alloys in the range 0-25 At-% Tin*, Journal of the Institute of Metals, vol. 81(11): p. 521-528, 1953.

Dobromyslov, A.V. et al., The orthorhombic alpha-phase in binary titanium-base alloys with d-metals of V-VIII groups, Materials Science and Engineering A, vol. 438: p. 324-326, 2006.

Olson, G.B. et al., A General Mechanism of Martensitic Nucleation: Part I. General Concepts and the FCC-HCP Transformation, Metallurgical Transactions A, vol. 7A(12): p. 1897-1904, Dec. 1976.

Olson, G.B. et al., A General Mechanism of Martensitic Nucleation: Part II. FCC-BCC and other Martensitic Transformations, Metallurgical Transactions A, vol. 7A(12): p. 1905-1914, Dec. 1976.

Olson, G.B. et al., A General Mechanism of Martensitic Nucleation: Part III. Kinetics of Martensitic Nucleation, Metallurgical Transactions A, vol. 7A(12): p. 1915-1923, Dec. 1976.

Ghosh, G. et al., Kinetics of F.C.C.-B.C.C. Heterogeneous Martensitic Nucleation—I. The Critical Driving Force for Athermal Nucleation, Acta Metallurgica Et Materialia, vol. 42(10): p. 3361-3370, 1994.

Ghosh, G. et al., Kinetics of F.C.C.-B.C.C. Heterogeneous Martensitic Nucleation—II. Thermal Activation, Acta Metallurgica Et Materialia, vol. 42(10): p. 3371-3379, 1994.

Patel, J.R. et al., Criterion for the Action of Applied Stress in the Martensitic Transformation, Acta Metallurgica, vol. 1(5): p. 531-538, Sep. 1953.

Duerig, T.W. et al., Shape Memory in Ti—10V—2Fe—3Al, Scripta Metallurgica, vol. 16(8): p. 957-961, 1982.

Duerig, T.W. et al., Overview: Microstructure and Properties of Beta Titanium Alloys, Beta Titanium Alloys in the 1980's, R.R. Boyer and H.W. Rosenberg, Editors, p. 19-67, 1984.

Bolling, G.F. et al., The Plastic Deformation—Transformation of Paramagnetic F.C.C. Fe—Ni—C Alloys, Acta Metallurgica, vol. 18(6): p. 673-681, 1970.

| Source | Ms/K by dilatometer | Ms/K calculated |
|---|---|---|
| B21 | 463 | 451 |
| B22 | 493 | 486 |
| B23 | 423 | 420 |
| B24 | 493 | 506 |
| B25 | 453 | 457 |
| B26 | 483 | 492 |

680°C annealed
transformed zone near crack tip
with strain-induced martensite

680°C annealed
untransformed zone away from crack tip
β + primary α particles

760°C annealed
transformed zone near crack tip
with stress-assisted martensite

760°C annealed
untransformed zone away from crack tip
β + primary α particles

COMPUTATIONALLY-DESIGNED TRANSFORMATION-TOUGHENED NEAR-ALPHA TITANIUM ALLOY

CROSS-REFERENCE TO RELATED PATENT APPLICATION

This application claims priority to and the benefit of, pursuant to 35 U.S.C. § 119(e), U.S. provisional patent application Ser. No. 62/043,897, filed Aug. 29, 2014, entitled "COMPUTATIONALLY-DESIGNED TRANSFORMATION-TOUGHENED NEAR-ALPHA TITANIUM ALLOY," by Jiayi Yan and Gregory B. Olson, which is incorporated herein in its entirety by reference.

Some references, which may include patents, patent applications and various publications, are cited and discussed in the description of this invention. The citation and/or discussion of such references is provided merely to clarify the description of the present invention and is not an admission that any such reference is "prior art" to the invention described herein. All references cited and discussed in this specification are incorporated herein by reference in their entireties and to the same extent as if each reference was individually incorporated by reference.

STATEMENT AS TO RIGHTS UNDER FEDERALLY-SPONSORED RESEARCH

This invention was made with government support under N00014-10-1-0504 awarded by the Office of Naval Research. The government has certain rights in the invention.

FIELD OF THE INVENTION

The present invention relates generally to titanium (Ti) alloys, and more particularly to a transformation-toughened near-α Ti alloy and methods of computationally designing the same.

BACKGROUND OF THE INVENTION

Titanium alloys possess low density, high strength and fracture toughness, and excellent corrosion resistance, making them attractive candidates for naval structural components. It is primarily the high cost of Ti that limits its range of usage. However, a report in 2004 showed a potential of reducing the production cost of Ti by about 30% to 50% by innovations in extractive technology, leading to a revival of the motivation of making structural components with Ti alloys.

The most commonly used Ti alloy is Ti-64, which was developed in the 1950s. Although Ti-64 has a high strength, its fracture toughness and stress corrosion resistance do not meet the Navy's requirements. Targeting naval applications, a new commercial Ti alloy named Ti-5111 has been developed jointly by the U.S. Navy and TIMET in the 1980s. Compared to Ti-64, Ti-5111 has higher fracture toughness with inferior yield strength.

Therefore, a heretofore unaddressed need exists in the art to address the aforementioned deficiencies and inadequacies.

SUMMARY OF THE INVENTION

One aspect of the present invention relates to a method of computationally designing a near-α transformation-induced plasticity (TRIP) titanium (Ti) alloy. In certain embodiments, the method includes: creating a thermodynamic database of near-α Ti alloys; tailoring data in the thermodynamic database for martensitic transformations in the near-α Ti alloys near room temperature; and obtaining an overall composite of the near-α TRIP Ti alloy by adjusting a reference overall composite of a reference near-α Ti alloy based on the tailored data in the thermodynamic database.

In certain embodiments, a transformation dilatation of the near-α TRIP Ti alloy is greater than that of the reference near-α Ti alloy.

In certain embodiments, the near-α TRIP Ti alloy has a β-phase fraction no greater than 20%.

In certain embodiments, the reference near-α Ti alloy is Ti-5Al-1Sn-1Zr-1V-0.8Mo-0.1Si-0.1Fe-0.1O by weight percentage (Ti-5111).

In certain embodiments, the near-α TRIP Ti alloy is Ti-8Al-1V-1Sn-1Zr-0.6Mo-0.9Fe-0.1Si-0.1O by weight percentage.

In certain embodiments, the method further includes: determining an annealing temperature of the near-α TRIP Ti alloy such that a $M_S^{\sigma}$(ct) temperature of the near-α TRIP Ti alloy is about room temperature, where the $M_S^{\sigma}$(ct) temperature is a $M_S^{\sigma}$ temperature at a crack-tip (CT) stress state, and the $M_S^{\sigma}$ temperature is a temperature at which transformation stress equals parent-phase slip stress.

In certain embodiments, the annealing temperature is a temperature higher than a $Ti_3Al$ formation temperature to prevent formation of $Ti_3Al$.

In certain embodiments, the annealing temperature is about 865° C.

In certain embodiments, the near-α TRIP Ti alloy has a transformation dilatation of about +0.27% and a β-phase fraction of about 19.5%.

In certain embodiments, a cooling rate of the near-α TRIP Ti alloy after annealing at the annealing temperature is greater than about 20° C./min to inhibit formation of grain-boundary α (GB-α) phase in the near-α TRIP Ti alloy.

In certain embodiments, a normalized rate constant $K_{MP}$ of the near-α TRIP Ti alloy is obtained by:

$$\frac{K_{MP}}{\sigma V_m} = \frac{8}{9RT}\left[\left[x_i^{\beta} - x_i^{\alpha}\right]^T \left[\frac{\partial^2 G_m^{\beta}}{\partial x_i \partial x_j}\right]\left[D_{jk}^{\beta}\right]^{-1}\left[x_j^{\beta} - x_k^{\alpha}\right]\right]^{-1},$$

where σ is an α/β interfacial energy, $V_m$ is an overall molar volume, $x_i^{\beta}-x_i^{\alpha}$ is the difference in composition of element i between the equilibrium α and β phases across a flat interface, and $[D]^{-1}$ is an inverse n×n matrix of diffusivities in a matrix β phase.

In certain embodiments, the normalized rate constant $K_{MP}$ is calculated at about 100° C. lower than a β transus temperature ($T_{\beta}$).

In certain embodiments, the data of the thermodynamic database includes information of martensite and athermal ω transformations of the Ti alloys near room temperature.

In certain embodiments, the data of the thermodynamic database includes martensite formation and reversion temperatures of the Ti alloys.

Another aspect of the present invention relates to a near-α transformation-induced plasticity (TRIP) titanium (Ti) alloy designed by any of the methods as stated above.

In a further aspect, a near-α transformation-induced plasticity (TRIP) titanium (Ti) alloy includes Ti-8Al-1V-1Sn-1Zr-0.6Mo-0.9Fe-0.1Si-0.1O by weight percentage, being annealed at an annealing temperature.

In certain embodiments, the annealing temperature is about 865° C.

In certain embodiments, the near-α TRIP Ti alloy is cooled at a cooling rate after annealing at the annealing temperature, where the cooling rate is greater than about 20° C./min to inhibit formation of grain-boundary α (GB-α) phase in the near-α TRIP Ti alloy.

In certain embodiments, the near-α TRIP Ti alloy has a $M_S^o$(ct) temperature of about room temperature, wherein the $M_S^o$(ct) temperature is a $M_S^o$ temperature at a crack-tip (ct) stress state, and the $M_S^o$ temperature is a temperature at which transformation stress equals parent-phase slip stress.

In certain embodiments, the near-α TRIP Ti alloy has a transformation dilatation of about +0.27%, and a β-phase fraction of about 19.5%.

These and other aspects of the present invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
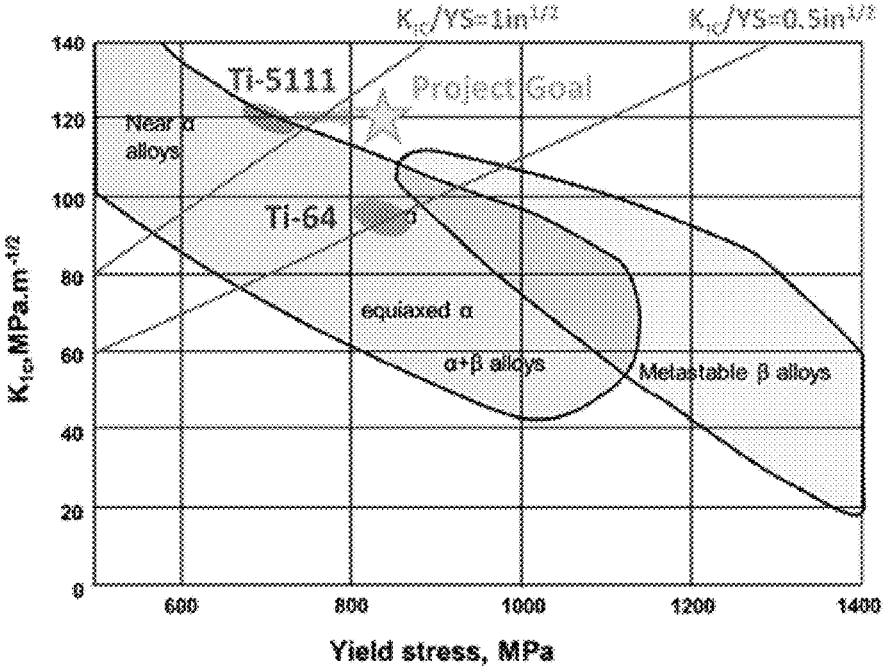
FIG. 1 schematically shows fracture toughness and yield strength of Ti alloys according to certain embodiments of the invention.

The present invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

Definitions

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the invention or of any exemplified term. Likewise, the invention is not limited to various embodiments given in this specification.

It will be understood that, as used in the description herein and throughout the claims that follow, the meaning of "a", "an", and "the" includes plural reference unless the context clearly dictates otherwise. Also, it will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

It will be further understood that the terms "comprises" and/or "comprising," or "includes" and/or "including" or "has" and/or "having" when used in this specification, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising," "including," "carrying," "having," "containing," "involving," and the like are to be understood to be open-ended, i.e., to mean including but not limited to.

Overview Of The Invention

The potential of lower-cost Ti production processes has motivated new directions of Ti alloy design for naval structural applications. In certain aspects, when the near-α Ti-5111 alloy is used as a reference near-α Ti alloy for designing a near-α TRIP Ti alloy, the objective alloy should have the same high stress-corrosion-cracking resistance, weldability and low cost with the near-α Ti-5111 alloy, and an increased strength and fracture toughness. A system design approach is used to link processing, structure, properties and performance with mechanistic quantitative models, which enables a computational Ti alloy design.

Specifically, the primary method utilized in the present invention to improve both yield strength and fracture toughness is TRIP and toughening caused by the β-to-α'/α" martensitic transformation in Ti alloys. Research on TRIP steels has shown that the maximal transformation toughening is obtained at the $M_S^o$ temperature for the crack-tip (CT) stress state, and a large volume dilatation of martensitic transformation, which are accurately modeled for Ti alloys. In certain embodiments, a new thermodynamic database is created and data thereof is tailored for martensitic transformations of Ti alloys near room temperature, which also includes athermal β-to-ω transformation to model its competitive relationship with martensite.

In certain embodiments, a molar volume database for β, α' and α" phases is established. The stable martensitic structure is predicted by the criterion of lower molar volume, which reflects the effect of α" orthorhombicity on transformation dilatation. To explain the physical origin of α" orthorhombicity, the Cahn-Rosenberg model is verified by β phase short-range ordering using first-principles calculations. The invariant-plane shear magnitude and dilatation are input to mechanical driving force calculations. The critical driving force for martensitic nucleation is also modeled based on interfacial solution-hardening friction. These models enable the calculation of $M_S^o$, which is calibrated for Ti-1023 alloy with tensile tests at temperature to account for the effect of α" orthorhombicity and/or athermal ω. Fracture toughness measurements on the commercial Ti-1023 alloy demonstrate the transformation toughening effect at $M_S^o$ (ct).

In certain embodiments, using the near-α Ti-5111 alloy is used as the reference near-α Ti alloy, the final design of a near-α TRIP Ti alloy is Ti-8Al-1V-1Sn-1Zr-0.9Fe-0.6Mo-0.1Si-0.1O (wt %). By annealing at 865° C., the design alloy is predicted to have an $M_S^o$(ct) of room temperature and a transformation dilatation of +0.27%, compared to −0.55% of Ti-5111. In addition to transformation toughening, the design composition should provide more strength without forming detrimental phases, meeting the design objectives.

Specifically, one of the objectives of the present invention is to design a new Ti alloy with the fracture toughness of Ti-5111 and the strength of Ti-64, without compromising other properties including stress-corrosion-cracking resistance, weldability and low cost. The required fracture toughness-yield strength relationship is also quantified by critical flaw size at yield:

$$a_{crit} = \frac{1}{\pi}\left(\frac{K_{IC}}{\sigma_Y}\right)^2 \quad (1)$$

A $K_{IC}/\sigma_Y$ ratio of 0.5 $in^{1/2}$ is the minimum requirement of the U.S. Navy for structural materials, and a ratio of 1.0 $in^{1/2}$ is ideal. FIG. 1 shows schematically fracture toughness and yield strength of Ti alloys according to certain embodiments of the invention.

In order to enhance strength and toughness simultaneously, the present invention makes use of transformation-induced plasticity (TRIP) and transformation toughening. Discovered and well-studied in ferrous systems, the TRIP effect has been successfully used to develop a family of steels with outstanding strength, fracture toughness and ductility. However, the TRIP effect remains largely unexplored in Ti systems. In the present invention, the fundamental mechanistic models developed from TRIP steel research are adopted and calibrated for Ti systems using literature data and key experiments. Using the mechanistic models, a Ti alloy is computationally designed to be similar to Ti-5111 with TRIP toughening in order to obtain the desired strength and fracture toughness.

Figure 2:
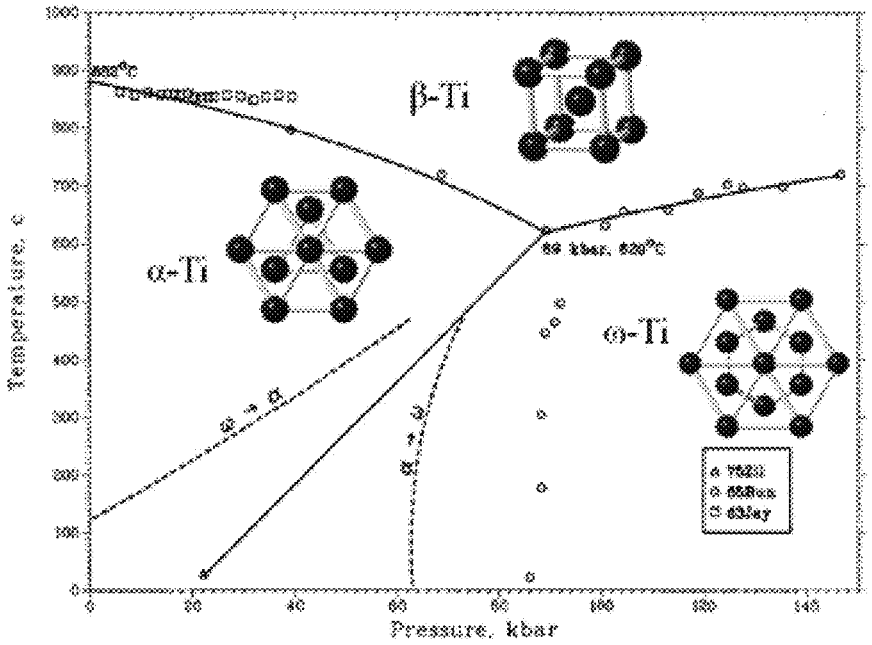
FIG. 2 shows a temperature-pressure phase diagram of pure Ti according to certain embodiments of the present invention.

Pure Ti has three solid phases: α phase of hexagonal close-packed (HCP) structure, β phase of body-centered cubic (BCC) structure, and ω phase of a hexagonal structure. A temperature-pressure phase diagram of pure Ti, as shown in FIG. 2, shows the regions of stability for the three solid phases.

Figure 3:
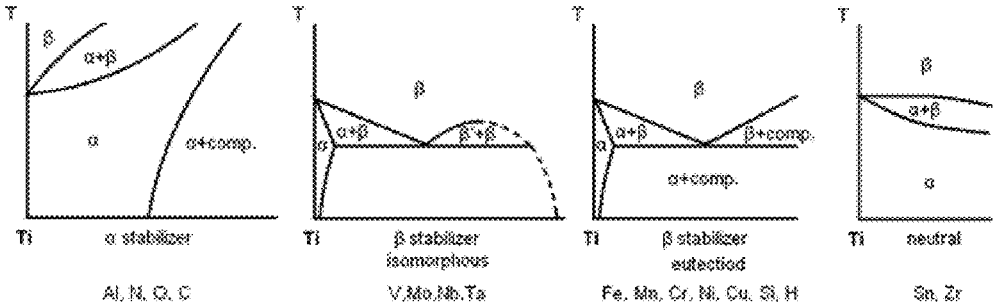
FIG. 3 schematically shows a plurality of Ti—X binary phase diagrams according to certain embodiments of the present invention.

In Ti alloys, equilibrium phases include Ti-rich α and β phases as well as intermetallic compounds. Based on their effects on α/β phase stabilities, alloying elements are categorized as α-stabilizers, β-stabilizers and neutral elements. This can be illustrated by typical Ti—X binary phase diagrams, as shown in FIG. 3. Transformations between these equilibrium phases are usually of the typical nucleation-growth, diffusion-controlled type. For example, Ti-64 and Ti-5111 usually have 10-20% β phase and 80%-90% α phase.

Figure 4:
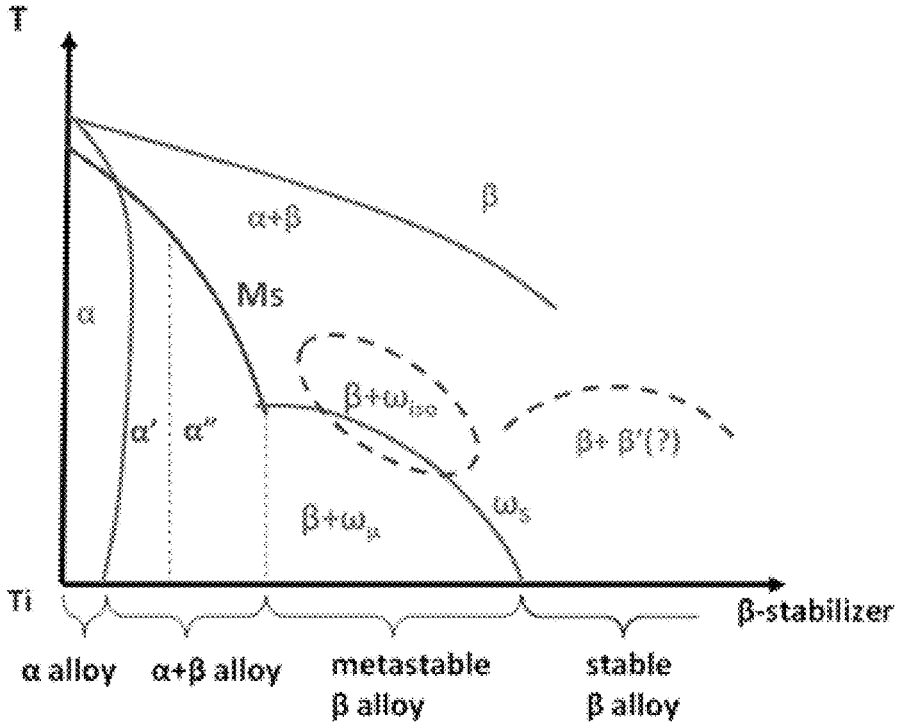
FIG. 4 schematically shows a martensite and ω phase diagram of Ti alloys according to certain embodiments of the present invention.

On quenching a Ti alloy from its β phase region to room temperature, martensitic transformation takes place at the $M_S$ temperature, as shown in FIG. 4. Martensitic transformation is a diffusionless (composition invariant), displacive (lattice distortion dominant), first-order transformation, which is also observed in numerous other systems. On the Ti-rich side, the martensite is HCP, denoted by α'. In many systems, with increasing β stabilizer content, the martensitic structure becomes orthorhombic (α"), or distorted HCP. Given sufficient β-stabilizer contents, β phase can be fully retained after quenching to room temperature. Martensite can also form in some metastable β alloys by mechanical deformation which provides additional mechanical driving force for martensitic transformation. This is the underlying mechanism of TRIP and transformation toughening in Ti alloys, which is modeled quantitatively in certain embodiments of the present invention.

In a metastable β Ti alloy, mechanical deformation can trigger martensitic transformation by stress-assisted nucleation or strain-induced nucleation, which is the underlying mechanism of TRIP effect and transformation toughening.

Figure 5:
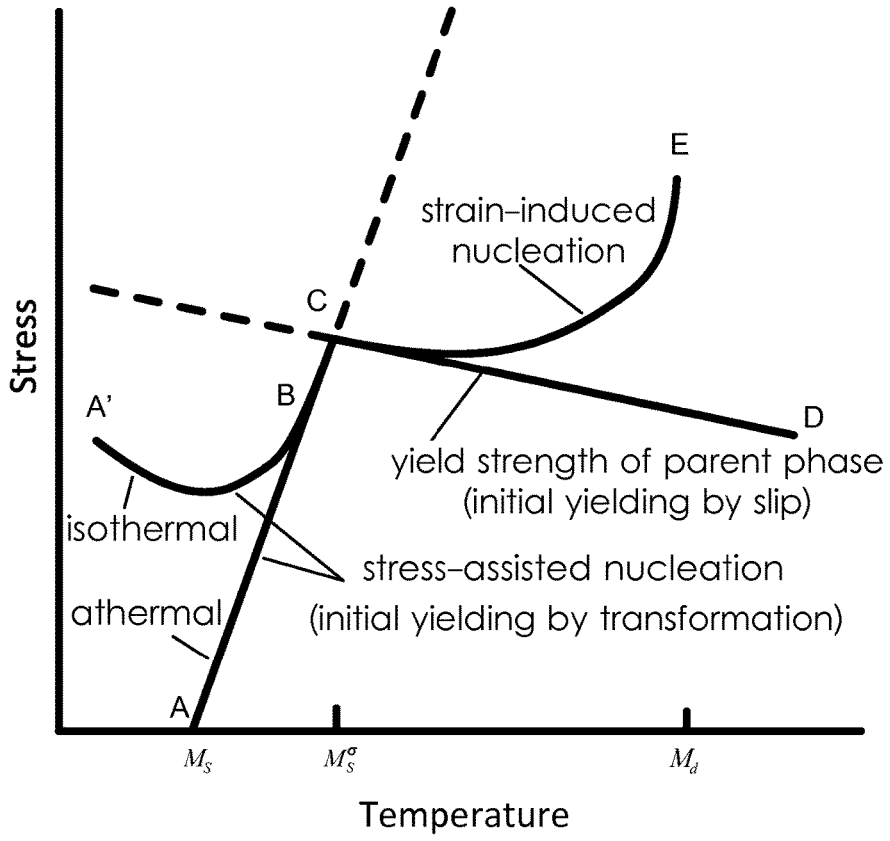
FIG. 5 shows deformation-induced martensitic transformation in a metastable β Ti alloy according to certain embodiments of the present invention.

FIG. 5 shows deformation-induced martensitic transformation in a metastable β Ti alloy according to certain embodiments of the present invention. As shown in FIG. 5, at a temperature closely above $M_S$, martensite can be triggered by applied stress which provides additional mechanical driving force. The transformation stress follows line ABC in FIG. 5. In this case, martensites nucleate on the same sites responsible for the transformation upon cooling, thus named stress-assisted martensite. In the stress-assisted regime, initial yielding is controlled by transformation which occurs at a stress lower than the slip stress of the parent phase. The temperature at which transformation stress equals parent-phase slip stress (at point C as shown in FIG. 5) is defined as $M_S^o$. Above $M_S^o$, slip occurs prior to martensitic transformation, the nucleation sites of which include new potent defects provided by plastic strain, thus the martensite is strain-induced. Near $M_S^o$, both modes of martensite occur. The regime of strain-induced martensite is terminated at $M_d$, the highest temperature at which deformation can induce martensite.

Figure 6:
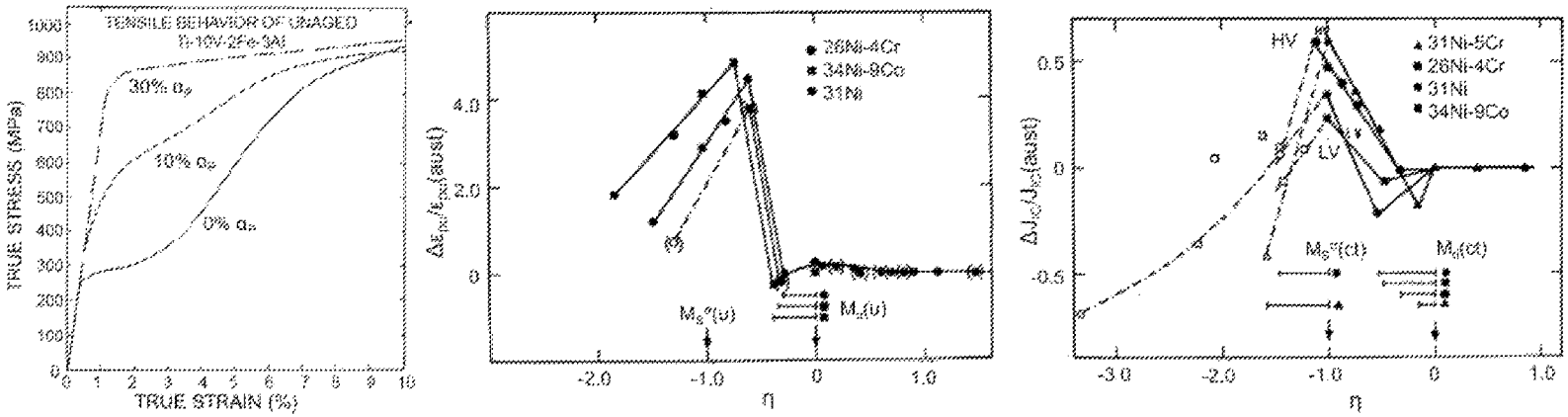
FIG. 6 shows diagrams of the TRIP effect of Ti alloys according to certain embodiments of the present invention, where (a) shows stress-strain curves of a metastable β alloy Ti-1023 with different β phase stabilities, (b) shows relative increment of uniform ductility, and (c) shows fracture toughness in TRIP steels as a function of normalized temperature.

FIG. 6 shows diagrams of the TRIP effect of Ti alloys according to certain embodiments of the present invention, where (a) shows stress-strain curves of a metastable β alloy Ti-1023 with different β phase stabilities, (b) shows relative increment of uniform ductility, and (c) shows fracture toughness in TRIP steels as a function of normalized temperature. As shown in FIG. 6, LV=low volume change and HV=high volume change. As a result of deformation-induced martensite, the tensile stress-strain curve of a TRIP alloy shows an upward curvature and a delayed necking. The TRIP effect can give a four-fold increase of uniform ductility and a 50% increase of $J_{IC}$ fracture toughness in austenitic TRIP steels. The benefits in ductility and fracture toughness depend strongly on the phase stability of the parent phase with respect to martensite. Maximum transformation toughening takes place at $M_S^{\sigma}$(ct), the $M_S^{\sigma}$ temperature at the crack-tip stress state. The volume change from parent phase to martensite (δ) also enhances toughness following a cubic power law. The transformation toughening mechanism by strain-induced martensite involves a direct cross-interaction between transformation and the unit process of ductile fracture (microvoid nucleation, growth and coalescence). Numerical simulations by Socrate show that the transformation greatly delays the onset of shear localization fracture driven by microvoid softening, which is associated with a large toughening effect. For TRIP Ti alloy design, in order to maximize transformation toughening at room temperature, the desired β phase should have an $M_S^{\sigma}$(ct)=25° C. with a large transformation volume change. These are the two primary design objectives in certain embodiments of the present invention.

To meet the performance goals for naval structural applications, the desired materials properties include high strength, fracture toughness, stress-corrosion-cracking (SCC) resistance, weldability, and low cost. In certain embodiments of the present invention, the primary objective is to increase the first two materials properties without compromising the others. In certain embodiments, near-α alloys are focused with compositions and phase fractions similar to Ti-5111 to keep the SCC resistance, weldability and low cost. The primary approach of the present invention is the TRIP effect, for which the $M_S^{\sigma}$(ct) temperature of the β phase should be adjusted to 25° C. and the martensitic dilatation δ as large as possible. After the optimal β phase compositions are determined, the final annealing and cooling process is tailored to meet the microstructure design. It is pivotal to accurately model the thermodynamic stability and martensitic dilatation of β phase, which includes the major part of the present invention.

Figure 7:
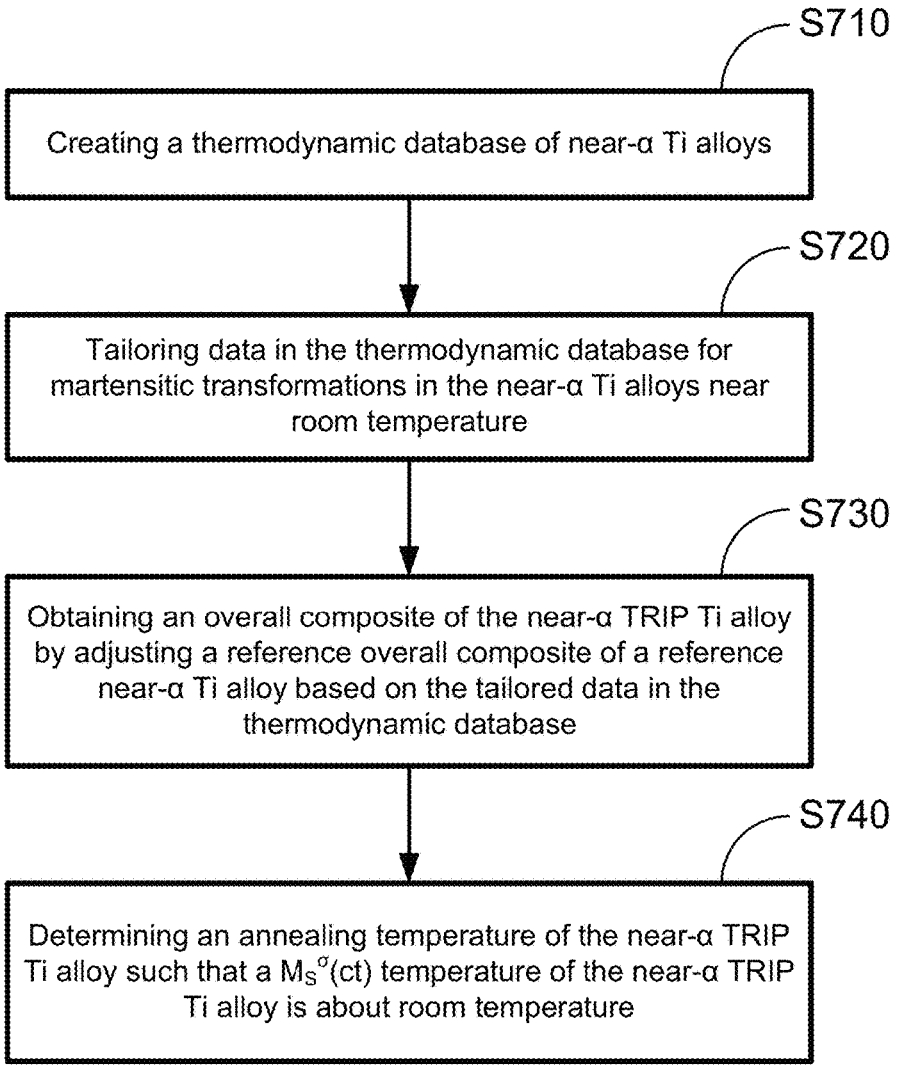
FIG. 7 shows a flowchart of a method of computationally designing a near-α transformation-induced plasticity (TRIP) titanium (Ti) alloy according to certain embodiments of the invention.

One aspect of the present invention relates to a method of computationally designing a near-α transformation-induced plasticity (TRIP) titanium (Ti) alloy. FIG. 7 shows a flowchart of a method of computationally designing a near-α TRIP Ti alloy according to certain embodiments of the invention. As shown in FIG. 7, the method includes: creating a thermodynamic database of near-α Ti alloys (step S110); tailoring data in the thermodynamic database for martensitic transformations in the near-α Ti alloys near room temperature (step S120); and obtaining an overall composite of the near-α TRIP Ti alloy by adjusting a reference overall composite of a reference near-α Ti alloy based on the tailored data in the thermodynamic database (step S130). In certain embodiments, the method further includes: determining an annealing temperature of the near-α TRIP Ti alloy such that a $M_S^{\sigma}$(ct) temperature of the near-α TRIP Ti alloy is about room temperature (step S140), where the $M_S^{\sigma}$(ct) temperature is a $M_S^{\sigma}$ temperature at a crack-tip (CT) stress state, and the $M_S^{\sigma}$ temperature is a temperature at which transformation stress equals parent-phase slip stress.

In a further aspect, a near-α transformation-induced plasticity (TRIP) titanium (Ti) alloy includes Ti-8Al-1V-1Sn-1Zr-0.6Mo-0.9Fe-0.1Si-0.1O by weight percentage, being annealed at an annealing temperature.

In certain embodiments, the annealing temperature is about 865° C.

In certain embodiments, the near-α TRIP Ti alloy has a $M_S^{\sigma}$(ct) temperature of about room temperature, wherein the $M_S^{\sigma}$(ct) temperature is a $M_S^{\sigma}$ temperature at a crack-tip (ct) stress state, and the $M_S^{\sigma}$ temperature is a temperature at which transformation stress equals parent-phase slip stress.

In certain embodiments, the near-α TRIP Ti alloy has a transformation dilatation of about +0.27%, and a β-phase fraction of about 19.5%.

These and other aspects of the present invention are further described below.

IMPLEMENTATIONS AND EXAMPLES OF THE INVENTION

Without intent to limit the scope of the invention, exemplary instruments, apparatus, methods and their related results according to the embodiments of the present invention are given below. Note that titles or subtitles may be used in the examples for convenience of a reader, which in no way should limit the scope of the invention. Moreover, certain theories are proposed and disclosed herein; however, in no way they, whether they are right or wrong, should limit the scope of the invention so long as the invention is practiced according to the invention without regard for any particular theory or scheme of action.

Example One

In certain embodiments, the conventional form used by the CALPHAD community is followed to describe the Gibbs energy of pure solid and solid-solution phases as a function of temperature and chemical compositions. CALPHAD is an acronym for CALculation of PHAse Diagrams, which is an approach of quantitative description of thermodynamic quantities of phases. Among these quantities, Gibbs energy is the most important and fundamental, from which all others can be derived following the principles of thermodynamics. Multi-phase equilibria are determined by minimizing Gibbs energy under certain constraints. Gibbs energy modeling also enables extrapolations to higher-order systems using the parameters of binary and ternary systems. In many cases such extrapolations to quaternary and higher-order systems are sufficiently accurate provided that the basic binary and ternary systems are accurately assessed.

1. Models

The standard equation of molar Gibbs energy of pure elements is $$G_m^0 - H_m^{SER} = a + bT + cT\ln T + \sum_n d_n T^n,$$

where the left hand side is the Gibbs energy relative to a standard element reference (SER) state where $H_m^{SER}$ is the enthalpy of the element in its defined reference state at 298.15K. n is a set of integers, typically 2, 3, and −1, and a, b, c, $d_n$ are coefficients. From this equation, molar enthalpy $H_m$, molar entropy $S_m$ and specific heat $C_P$ can be expressed as:

$$H_m = a - cT - \sum_n n d_n T^{n-1}$$

$$S_m = -b - c - c\ln T - \sum_n (n-1) d_n T^n$$

$$C_P = -c - \sum_n n(n-1) d_n T^{n-1}$$

The Gibbs energy of a random, substitutional solution is expressed by $$G_m = \sum_i x_i G_i^0 + RT\sum_i x_i \ln x_i + G_m^{ex}$$

On the right hand side, the first term is the contribution from pure elements by mechanical mixing, the second term from ideal mixing, and the third term excess Gibbs energy. A general form of multi-component excess Gibbs energy is the Redlich-Kister polynomial with Muggianu extrapolation:

$$G_m^{ex} = \sum_{i<j} x_i x_j \sum_v {}^v L_{ij}(x_i - x_j)^v + \sum_{i<j<k} x_i x_j x_k^0 L_{ijk}$$

In practice it is sufficient to include v up to 2. It is notable that ${}^vL_{ij}$ can be a function of temperature T, often linear, but not necessarily:

$${}^vL_{ij} = A + BT$$

In most cases, the ternary interaction parameter $L_{ijk}$, if needed, is a constant (zeroth-order). There is little need of interaction parameters of fourth order or higher: Accurate binary and ternary interaction parameters are sufficient to accurately describe higher-order systems by proper extrapolation.

From the principles of chemical thermodynamics, the equilibrium state of a multi-component, multi-phase, closed system is determined by minimizing total Gibbs energy under the constraints of mass conservation for each chemical species:

$$\min\left\{\sum_\phi f_\phi G_m^\phi\right\}, \quad \text{with } \sum_\phi f_\phi x_i^\phi = 1 \text{ for all } i$$

where $f_\phi$ denotes molar fraction of phase $\phi$, and $G_m^\phi$ is the molar Gibbs energy of phase $\phi$ as a function of its chemical composition and temperature. The constraints guarantee the conservation of atoms of element i, and the number of constraints is equal to the number of chemical elements in consideration. The minimization is usually executed by computer codes or software, such as the POLY-3 module as part of the Thermo-Calc software.

Thermodynamic optimization, or assessment, refers to the fitting process to obtain optimal parameters in the Gibbs-energy equations that best fit experimental data, including measured phase diagram and thermodynamic quantities. The calculations are usually also carried out by computer software or codes, such as the PARROT module of Thermo-Calc. Opposite to the deductive, deterministic route from Gibbs-energy equations to calculated phase equilibria, thermodynamic optimization is inductive in nature, therefore heavily relies on the quality of the input data, the Gibbs energy model adopted, even the optimizer's personal judgment.

In cases where experimental data are abundant, the uncertainty of thermodynamic optimization mostly comes from the scattering of experimental data of various quality. It is the optimizer's responsibility to judge on the reliability of data obtained by various methods with various materials, which requires rich experiences in both experimental and computational aspects. If available experimental data do not cover the entire region considered in an optimization, one has to extrapolate, using the parameters obtained from charted regions to describe uncharted territories. The extrapolation that cannot be experimentally validated results in two kinds of limitations due to (1) slow kinetics at low temperature and (2) dynamical instabilities of phases.

Because the kinetics towards phase equilibria slows down as temperature decreases, experimental data of phase equilibria at low temperatures are usually few and not very reliable. Optimizers usually exclude those data of phase equilibria measured below a threshold temperature, e.g. 700K, leaving the low-temperature regions described by extrapolated parameters. Although most CALPHAD assessments set 298.15K as the lower limit temperature, their reliability in the vicinity of that temperature is usually not well guaranteed. It will be shown that the existing database Ti-DATA-v3 developed by Thermotech Ltd. (also named TTTI3 by Thermo-Calc AB) is not sufficiently accurate for martensitic transformations at low temperatures. However, martensitic transformations provide an indispensible, yet often overlooked, opportunity to provide data for calibrating low-temperature phase descriptions. Already practiced in ferrous systems (the kMART database), this idea is applied to titanium systems in the present invention.

2. Models First-principles Calculations of Total Energies

Density functional theory (DFT) is a powerful tool for materials scientists to investigate many properties of solids, including phase stabilities, lattice parameters and elastic constants. DFT calculations require only atomic and structural information, without any empirically obtained parameters. With the basic principles discovered in 1960s, first practical computational work done in 1980s, DFT has now become a large family of methods designed for different purposes.

The backbone is the two theorems by Hohenberg and Kohn in 1964, which are (1) the ground state energy from Schroedinger's equation is a unique functional of the electron density, and (2) the electron density that minimizes the energy of the overall functional is the true electron density corresponding to the full solution of Schroedinger's equation. Therefore it becomes a variational problem to solve the ground state energy and electron density distribution. Later Kohn and Sham worked out a single-electron approximation of DFT which can be solved iteratively until reaching self-consistency, without dealing with many-body wavefunctions. The only part that Kohn-Sham equation cannot calculate is the exchange-correlation functional. Common treatments include local-density approximation (LDA) and general-gradient approximation (GGA), each category including many numerical forms.

Pseudopotential is commonly used to replace the true potential in Kohn-Sham equations. Rigid calculations show that outer-shell (valence) electrons are loosely bound, while the inner-shell (core) electrons are quite strongly bound by deep nuclear Coulomb potentials, therefore barely interfere with valence electrons. The wavefunctions of valence electrons are quite smooth, yet those of core electrons change drastically within a localized region near the atomic nuclei. A rigid treatment of core electrons requires considerable mathematical and computational cost with limited benefits. The pseudopotential resolves the difficulty by combining the atomic nucleus with core electrons, leaving a smooth, shallow shielded Coulomb potential inside a cutoff radius $r_c$, outside of which the true potential is preserved. As a result, the pseudoatom has only valence electrons in a slow-varying potential, which yields smooth wavefunctions that require less computational cost.

Virtual crystal approximation (VCA) is a method of generating pseudopotentials for substitutional disordered alloys, by simply mixing elemental pseudopotentials by prescribed chemical composition. As a crude approximation, VCA turns out only suitable for mixing elements chemically very similar.

Besides pseudopotentials described above, another category of approximated potential is muffin-tin (MT) potential, which is spherically symmetric (atom-like) close to atoms and is flat in interstitial regions in a solid. This facilitates the usage of Green's function (GF) to solve Kohn-Sham equations, starting from Korringa-Kohn-Rostoker (KKR) method to a family of improved MT methods, including the exact muffin-tin orbital (EMTO) method used in this embodiment. Compared to the total-Hamiltonian approach, the GF-based methods have significant advantages on dealing with disordered alloys, using coherent potential approximation (CPA) for example. More recently, improvements are made to go beyond the conventional single-site CPA, to a local self-consistent Green's function (LSGF) method, where a local interaction zone (LIZ) is explicitly accounted while its outside is treated with CPA.

In certain embodiments, Quantum Espresso (QE) is used. QE is an open-source DFT package which uses plane waves basis to construct wave functions and solves Kohn-Sham equations for self-consistency. Also used is ultra-soft pseudopotentials (USPP), recently developed by Garrity, Bennett, Rabe and Vanderbilt (GBRV). VCA is implemented as part of the Quantum Espresso package. The cutoff radius of GBRV-USPP of V is adjusted to be compatible for potential mixing with Ti. Calculated bcc-hcp energy difference is converged within 0.5%, which is an accuracy comparable with thermodynamic measurements. The parameters used include a wave-function cutoff energy of 40Ry, electron-density cutoff energy of 480Ry, and Methfessel-Paxton smearing width of 0.005Ry. The k-mesh is 24×24×24 for bcc, 22×22×14 for hcp, and 14×14×19 for omega. Total energy—volume data points are fitted to Murnaghan equation of state to obtain equilibrium lattice parameters and bulk modulus. For hcp and omega structures, the equilibrium c/a ratio is determined by parabolic fitting, which gives the corresponding minimum total energy used for Murnaghan fitting. VCA potentials are generated for Ti—V, Ti—Mo and Ti—Nb systems. Ti—Ta is not mixed because of incompatibility due to the f electrons.

Figure 8:
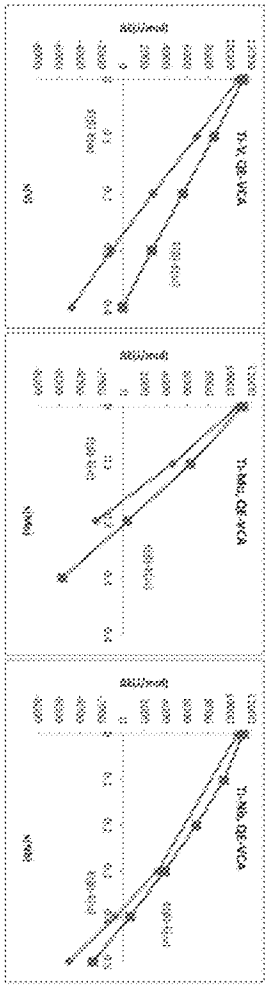
FIG. 8 schematically shows the total energies of Ti—V/Mo/Nb systems by EMTO-LSGF according to certain embodiments of the present invention.
Figure 9:
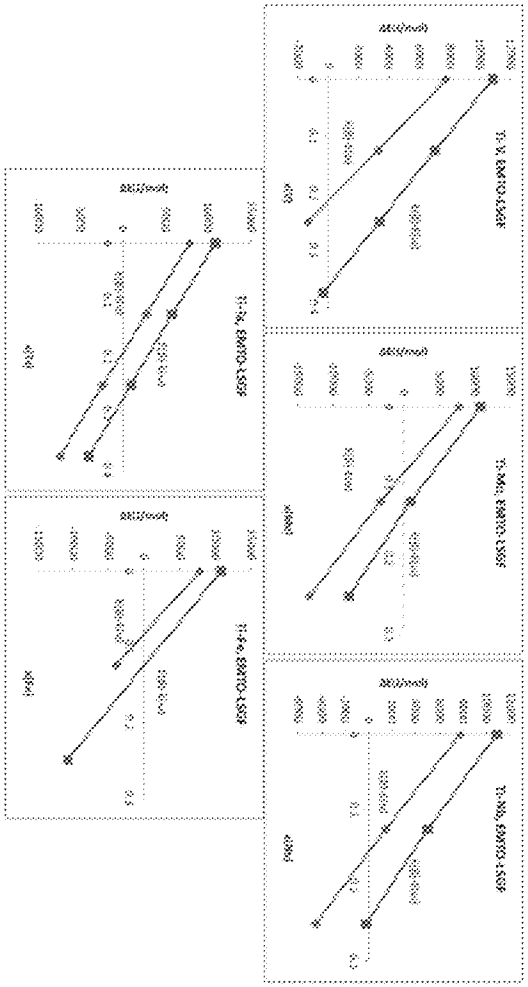
FIG. 9 schematically shows the total energies of Ti—V/Mo/Nb/Ta/Fe by EMTO-LSGF according to certain embodiments of the present invention.
Figure 10:
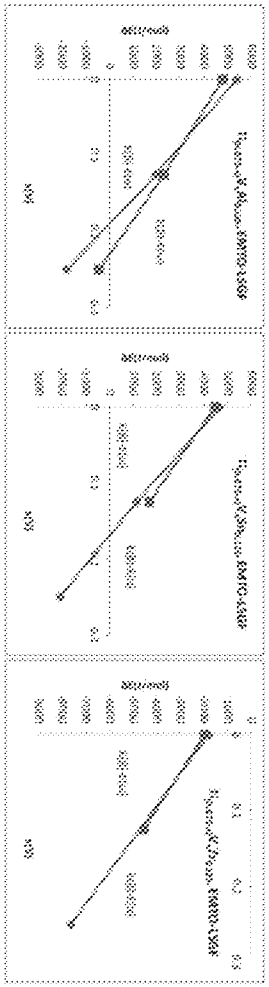
FIG. 10 schematically shows the total energies of Ti—V—Al/Sn/Zr by EMTO-LSGF according to certain embodiments of the present invention.

FIGS. 8-10 schematically show the total enegies of Ti—V/Mo/Nb systems, Ti—V/Mo/Nb/Ta/Fe, and Ti—V—Al/Sn/Zr by EMTO-LSGF according to certain embodiments of the present invention.

For EMTO-LSGF calculations, slope matrices, shape functions, and 4×4×4 supercells of bcc, hcp and omega structures are generated with negligible short-range ordering in the nearest 10 neighboring shells. The chemical compositions of the supercells include $A_7B_1$, $A_6B_2$, $A_5B_3$ for binary alloys and $A_6B_1C_1$, $A_5B_2C_1$ and $A_4B_3C_1$ for ternary. The electrons in the two outmost shells are considered as valence electrons. In LSGF calculations, LIZ size is 3. k-mesh is the same with QE calculations. With these parameters the bcc-hcp energy difference converges to a similar threshold to QE calculations.

TABLE 1

E(omega)-E(bcc) calculated by QE-USPP at 0 K

| Element | E(omega)-E(bcc), J/mol |
|---|---|
| V | 12655 |
| Nb | 19267 |
| Ta | 21835 |
| Mo | 39043 |
| Fe | 27904 |
| Al | 1606 |
| Sn | −74 |

TABLE 2

Calculated equal-Gibbs-energy compositions at 0 K

| | EMTO-LSGF | | QE-USPP-VCA | |
|---|---|---|---|---|
| | $x_0$ (bcc-hcp) | $x_0$ (bcc-omega) | $x_0$ (bcc-hcp) | $x_0$ (bcc-omega) |
| $Ti_{1-x}V_x$ | 0.21 | 0.36 | 0.27 | 0.40 |
| $Ti_{1-x}Mo_x$ | 0.09 | 0.14 | 0.17 | 0.21 |
| $Ti_{1-x}Nb_x$ | 0.16 | 0.25 | 0.38 | 0.42 |
| $Ti_{1-x}Ta_x$ | 0.19 | 0.27 | — | |
| $Ti_{1-x}Fe_x$ | 0.08 | 0.12 | | |
| $Ti_{0.875-x}V_xAl_{0.125}$ | 0.19 | 0.23 | | |
| $Ti_{0.875-x}V_xSn_{0.125}$ | 0.17 | 0.20 | | |
| $Ti_{0.875-x}V_xZr_{0.125}$ | −0.08 | −0.10 | | |

The bcc-hcp and bcc-omega energy differences from QE-USPP-VCA and EMTO-LSGF calculations are presented in FIGS. 8-10. V, Nb, Mo and Ta are all bcc-Ti stabilizing elements, as expected from phase diagrams. A quantity of interest is the equal-energy composition, $x_0$, which can be compared to the extension of equal-Gibbs-energy temperature $T_0$ to 0K by CALPHAD results.

Since first-principles calculations become well received among not only physicists but also materials scientists, phase stabilities of pure elements have been systematically studied. Wang et al. calculated the total energies of bcc, hcp and fcc phases of 78 pure elemental solids using DFT with GGA-PW91 functional and PAW method, and compared with SGTE phase stabilities at 298.15K.

The relationship between FP and SGTE phase stabilities is well described by two linear fittings with small intercepts and very close slopes. Approximately a proportionality holds:

$$\Delta E_{SGTE}=0.357\Delta E_{FP}$$

Pragmatically this relationship can be used to convert between FP and SGTE phase stabilities. In certain embodiments, the omega-bcc phase stabilities are calculated by Quantum Espresso and converted to CALPHAD values using the above equation.

First-principles methods have been very successful in predicting many properties of crystalline solids, and the empirically derived SGTE phase stabilities are able to faithfully reproduce measured thermodynamic properties. Therefore the discrepancy between the phase stabilities from the two categories seemed surprising to materials scientists, but it is now clear that the discrepancy is related to dynamic instabilities of phases. Dynamic instability is represented by the spectrum of lattice vibrations, or equivalently, phonons. A crystal lattice is stable if all phonon modes have positive frequencies. If any of the phonon modes has an imaginary frequency, the lattice vibration of the mode does not restore to equilibrium lattice sites, and the structure collapses. In such cases, even though first-principles calculations can give a "frozen" structure corresponding to an energy minima at 0K, the real structure still collapses due to its imaginary zero-point energy $$\sum_i (1/2)\hbar\omega_i,$$

and the tree energy of this structure has no physical meaning and is ill-defined. The FP values are the energies of frozen structures without zero-point energies, while the SGTE values are usually extrapolated mathematically from high temperatures. Therefore it is not unexpected that FP and SGTE predict different phase stabilities for dynamically unstable structures. For many pure elements, at least one structure of bcc, hcp and fcc is dynamically unstable. The somewhat coincident proportionality may be a result of a systematic approach used to develop the SGTE description.

3. Experimental Measurements of Martensitic Transformation and Reversion Temperatures 3.1 Preparation of Experimental Alloys In this example, pure elements (99.98% Ti, 99.7% V, 99.999% Al, 99.7% Fe, 99.8% Nb) produced by Alfa Aesar were used as raw materials for alloy preparation. Obvious oxide layer were removed by acid pickling in an aqueous solution of 20% $HNO_3$ and 1% HF followed by rinsing before arc melting.

Alloy buttons of 3-5 grams were prepared with Compact Arc Melter MAM-1 manufactured by Edmund Bühler GmbH. Formulated pure element pieces were laid on a water-cooled copper crucible, enclosed in a chamber which was pumped down to a vacuum and refilled with argon gas. An electron arc was then established between a water-cooled tungsten cathode and the copper crucible before moved to a piece of pure zirconium as an oxygen getter. Then the electron arc was moved over onto the pure elements to melt them and to let the liquid cohere into one big drop. After the melting, the electron arc was turned off and the liquid drop solidified quickly before gradually cooling to room temperature. The solidified alloy button was then flipped and re-melted for another 5 times to ensure its chemical homogeneity. The mass change before and after melting was less than 0.005%, therefore the actual composition was taken as the nominal one. The oxygen and nitrogen contents of an arc-melted alloy button were determined by the analytical laboratory of ATI Wah Chang Inc. as 580 wppm O and 53 wppm N, and the same concentrations were assumed in the other buttons prepared following the same procedure.

After arc melting, the buttons were encapsulated in quartz tubes evacuated to a pressure lower than $10^{-4}$ atm. Then the buttons underwent a homogenization/solution treatment at 1073K for 2 hrs, followed by quenching in iced brine with breaking the quartz tubes. Kroll's etchant (3 ml HF and 6 ml $HNO_3$ in 91 ml $H_2O$) was applied by cotton swab to the polished surfaces of the samples to reveal the microstructure. Some buttons were cold rolled for the convenience of machining if they were sufficiently ductile. Small pieces for calorimetry were cut by an abrasive saw, then recrystallized at 1073K for 1 hr and iced-brine quenched. Cylindrical samples for dilatometry were prepared by electrical discharge machining (EDM), with the passivated layer removed by mechanical grinding. Recrystallization treatment was done in a heat cycle in the dilatometer before measurements of martensitic start ($M_S$) and reversion ($A_f$) temperatures.

TABLE 3

Compositions of arc-melted Ti—V—Al—Fe alloys, with 580 wppm O and 53 wppm N.

| Symbol | at % V | at % Al | at % Fe |
|---|---|---|---|
| B01 | 13.38 | 6.95 | 0 |
| B02 | 14.34 | 5.55 | 0 |
| B03 | 10.1 | 5.52 | 0.99 |
| B04 | 7.1 | 7.00 | 2.00 |
| B05 | 3.04 | 6.97 | 3.03 |
| B07 | 11.84 | 8.62 | 0 |
| B08 | 11.75 | 10.24 | 0 |
| B09 | 11.83 | 9.48 | 0 |
| B10 | 10.86 | 10.24 | 0 |
| B11 | 14.84 | 5.32 | 0 |
| B12 | 8.57 | 5.59 | 1.51 |
| B13 | 12.68 | 5.48 | 0.495 |
| B14 | 15.01 | 0.60 | 0 |
| B15 | 15.03 | 2.00 | 0 |
| B16 | 14.99 | 5.01 | 0 |
| B17 | 13.94 | 5.01 | 0 |
| B18 | 13.03 | 5.04 | 0.43 |
| B19 | 8.02 | 5.03 | 1.52 |
| B20 | 12.99 | 5.03 | 0 |
| B21 | 14.02 | 5.53 | 0 |
| B22 | 13.49 | 5.55 | 0 |
| B23 | 14.47 | 5.52 | 0 |
| B24 | 13.03 | 7.03 | 0 |
| B25 | 12.00 | 5.50 | 0.50 |
| B26 | 9.07 | 6.98 | 1.03 |
| B27 | 12.00 | 3.03 | 0 |
| B28 | 11.97 | 5.53 | 0 |
| B29 | 12.01 | 7.11 | 0 |
| B30 | 13.50 | 3.03 | 0 |
| B31 | 13.51 | 6.99 | 0 |

3.2 Differential Scanning Calorimetry (DSC)

Differential scanning calorimetry (DSC) measures the heat flow associated with a change of temperature following a prescribed profile. Compared to drop calorimetry which only gives the difference between two states, DSC allows a continuous scanning of temperature with instantaneous (differential) heat flow recorded. The temperature profile is set up by the user, allowing heating and cooling at a prescribed rate, as well as holding at a constant temperature. There is a sample spot and a reference spot on a platform that supplies heat/cold, where both the sample and reference are kept at the same, prescribed temperature. Sensors under the sample and reference give signals that are converted to heat flow, which is read and displayed real-time. DSC can be used to measure transformation temperature, enthalpy change, specific heat and so forth, provided necessary calibrations of temperature and heat flow.

In certain embodiments, Mettler Toledo DSC822e, which could heat up to 550° C. and cool down to −65° C., is used. Each sample was sealed in an aluminum crucible with a punctured lid, and was put on the sample spot by a robot. An identical but empty aluminum crucible was on the reference spot. The sample size must be smaller than the aluminum crucible (5 mm diameter), and should have a broad flat bottom to ensure good thermal conductivity. In this embodiment, the samples were about 1 mm thick. A sample too thick will result in a temperature gradient in the thickness direction, while a sample too thin gives weak heat flow due to its small mass, thus a large heating/cooling rate is preferred. Nitrogen gas flow was used as protective atmosphere.

TABLE 4

| $A_f$ temperature measured by DSC | |
|---|---|
| Sample | $A_f$/° C. |
| B01 | 307 |
| B02 | 275 |
| B07 | 371* |
| B08 | 327* |
| B09 | 348* |
| B11 | 282 |
| B13 | 231 |

Figure 11:
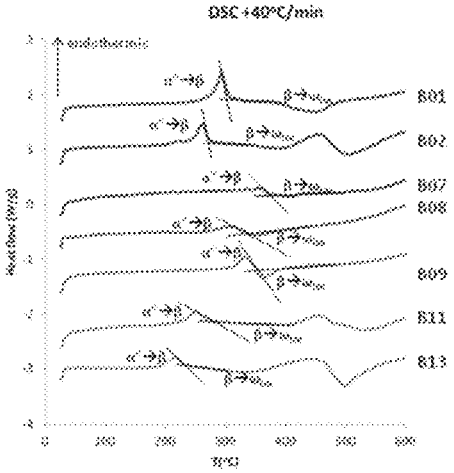
FIG. 11 schematically shows heat flow curves of some martensitic Ti—V—Al—Fe alloys with construction lines for $A_f$ according to certain embodiments of the present invention.

FIG. 11 schematically shows heat flow curves of some martensitic Ti—V—Al—Fe alloys with construction lines for $A_f$ according to certain embodiments of the present invention. Water quenching gives an almost fully martensitic microstructure in all the alloys listed in FIG. 11. Starting from a martensitic microstructure, heating in DSC gives rise to an endothermic peak associated with martensitic reversion. However, during cooling from a temperature just above $A_f$ in DSC, only B01 showed an exothermic peak associated with martensitic formation ($M_S$=161° C.) but not in all other samples. Similar phenomena were also discovered in Ti—Nb based alloys, where the exothermic peak of martensite formation could hardly be observed on cooling from a temperature just above $A_f$.

Thermal cycles of Ti-22 at % Nb showed that martensite formation and reversion processes attenuated with increasing number of cycles. Starting from a martensitic microstructure at room temperature, the first heating above $A_f$ gives an endothermic α"→β peak as expected, but the first cooling to room temperature gives a very small β→α" exothermic peak on a very curved background. In the repeated cycles, an α"→β endothermic peak shows up again, which is smaller than the one in the first heating due to partial transformation in the first cooling. After the second heating, no peaks associated with martensitic formation or reversion are distinguishable. For Ti-23 at % Nb, only an α"→β endothermic peak appears during the first heating. However, heat flow peaks of both martensitic reversion and formation are clearly visible during a heating/cooling cycle of Ti-24 at % Nb.

The attenuating behavior of martensitic formation and reversion over heat cycles observed in Ti—V—Al—Fe and Ti—Nb alloys is a result of continuous, irreversible growth of isothermal ω particles at temperatures above $A_f$, which reduce β→α" driving force and create obstacles against martensitic interfacial motion. In DSC it is difficult to bypass isothermal ω, because that heating above $A_f$ is needed to provide a heat-flow baseline. Based on the observation of martensite from water quench, a rapid cooling from solutionizing temperature is critical to bypass isothermal ω and to get martensite. Therefore, dilatometry is used to measure $M_S$ because it offers a faster cooling than DSC.

3.3 Dilatometry

Dilatometry measures the length change of a sample undergoing a heating/cooling process. Because martensitic transformation is usually associated with a volume expansion, dilatometry is able to capture the temperatures of martensitic formation and reversion.

In certain embodiments, an MMC dilatometer is used with induction heating, gas quenching in a vacuum environment. The samples were machined ϕ2×10.0 (mm) cylinders, thinner than a conventional ϕ3×10.0 (mm) for the purpose of faster cooling. Thermocouple wires were spark welded on the sample surface near its axial center. The sample was horizontally clamped with a small force between two quartz platens, surrounded by induction heating coils and enclosed in a chamber.

Figure 12:
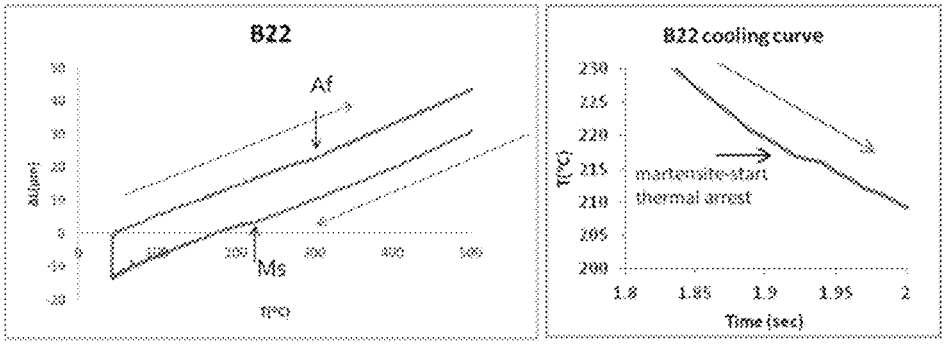
FIG. 12 shows dilatometric curves according to certain embodiments of the present invention, where: (a) shows change of length-temperature; (b) shows cooling curve with a thermal arrest.

FIG. 12 shows dilatometric curves according to certain embodiments of the present invention, where: (a) shows change of length-temperature; (b) shows cooling curve with a thermal arrest. The compositions of the buttons prepared for dilatometric experiments were designed so that their $A_f$ temperatures were about 300° C. This guaranteed a martensitic microstructure at room temperature after quenching. On the diagrams of length change (Δl) vs. temperature (T), an increment of Δl at about 150° C. on quenching signifies martensite formation, while a decrement of Δl of a similar magnitude at about 300° C. signifies martensite reversion. Although dilatometry does not record heat flow, the martensite formation/reversion is also evident from a temperature-time (T-t) curve from the thermocouple attached to the sample. On cooling to $M_S$ temperature, the latent heat of β→α" retards local cooling, leaving a plateau on the T-t curve before martensite stops to form which also signifies $M_S$. This mechanism is essentially the same with differential thermal analysis (DTA). The $M_S$ values obtained by Δl-T and T-t curves are consistent with each other. It is noted that the Δl-T curves are highly reproducible over repeated solutionizing-quench thermal cycles, without attenuating with increasing number of heat cycles, which verifies the argument that isothermal ω above $A_f$ inhibits martensite formation in DSC runs. It should be pointed out that there is an uncertainty of about 20° C. with the measured $M_S$ and $A_f$.

TABLE 5

| $M_S$ and $A_f$ measured by dilatometry | | |
|---|---|---|
| Sample | $M_S$/° C. | $A_f$/° C. |
| B21 | 190 | 260 |
| B22 | 220 | 300 |
| B23 | 150 | 240 |
| B24 | 220 | 295 |
| B25 | 180 | 285 |
| B26 | 210 | 350 |

4. Optimization Process 4.1 Pure Elements

The molar Gibbs energy at low temperatures is:

$$G_m^0 - H_m^{SER} = E_0 + \frac{3}{2}RT_E + 3RT\ln(1 - e^{-T_E/T}) - \frac{a_L}{2}T^2 - \frac{b_L}{20}T^5 - \frac{c_L}{6}T^3$$

where $E_0$, $T_E$ (Einstein temperature), $a_L$, $b_L$, and $c_L$ are variables to be determined. This form comes from the Einstein model for specific heat with additional terms which accounts for electronic specific heat, anharmonic lattice vibrations and smooth connection to SGTE curves:

$$C_P = 3R\frac{e^{T_E/T}}{(e^{T_E/T} - 1)^2}\left(\frac{T_E}{T}\right)^2 + a_L T + b_L T^4 + c_L T^2$$

$T_E$=0.77$T_D$ where $T_D$ is the Debye temperature determined by specific heat or elastic constants (to be exact, (−3) moment of phonon spectrum). The other four variables in Equation 2.9 are determined by the continuity of the $0^{th}$, $1^{st}$, $2^{nd}$ and $3^{rd}$ derivatives of G with respect to T at the limit temperature $T_{lim}$ (100K for Sn and 298.15K for all other elements considered). This guarantees a connection smooth up to $dC_P/dT$, and is totally deterministic. The analytical solution of $E_0$, $a_L$, $b_L$ and $c_L$ is cumbersome therefore omitted in the text.

In the SGTE dataset, Zr is the only element whose omega phase is assessed. To build a database with omega phase in Ti alloys, omega descriptions must be added to Ti and other elements. Results related to omega Ti is summarized as following:

(a) P-T phase diagram (as shown in FIG. 2). BCC-omega transus and HCP-omega transus at 1 atm can be obtained by extrapolating corresponding phase boundaries.

(b) Rapid quenching of pure Ti by Mirzayev et al., where bcc-omega transus is determined as 450±15° C. at cooling rates higher than $8\times10^4$K/sec.

(c) DFT calculations by Mei et al. of 0K total energies and Gibbs free energy using quasi-harmonic approximation (QHA) and Debye model. Hcp and omega Ti are dynamically stable phases, allowing QHA calculations by phonon spectra. Debye model is used for bcc Ti due to its dynamical instability at 0K, and its Gibbs free energy is lowered by 8 kJ/mol to match the experimental data of enthalpy at high temperatures. Their work gives calculated free energy differences of bcc-omega and hcp-omega at temperature. A similar work is by Hu et al. where free energy differences are not explicitly presented, but the calculated P-T phase diagram agrees with the experimental one better than Mei et al.

For bcc-omega transus, 723K is directly taken from Mirzayev et al., because that the extrapolation (a) to 1 atm may have a larger uncertainty, and that DFT calculations (c) may be less reliable at high temperatures especially when using Debye model for bcc phase. For hcp-omega transus, it is preferred to use DFT calculations (c) than the P-T extrapolation (a), because both hcp and omega phases are dynamically stable, for which QHA below 300K is usually quite reliable. On the contrary, because of the large pressure hysteresis, a direct extrapolation of hcp-omega boundary on the P-T diagram (a) is less precise. In summary, $T_0$(bcc-omega)=723K and $T_0$(hcp-omega)=186K are taken. In addition, E(omega)-E(hcp)=−203 J/mol is also taken from Mei et al.

From the dP/dT slope of hcp-omega boundary, it is also possible to get $S_m$(omega)-$S_m$(hcp) at 186K from Clausius-Clapeyron relationship (Δ means from hcp to omega in this section):

$$\frac{\Delta S_m}{\Delta V_m} = \frac{dP}{dT}\Big|_{\Delta G_m=0}$$

The slope dP/dT=0.01316 GPa/K from FIG. 2 is taken, and $\Delta V_m$=−0.24 Å$^3$/atom=$-1.445\times10^{-7}$ m$^3$/mol from calculations in Hu et al. As a result, $\Delta S_m$=−1.902 J/mol/K.

The Cp(T) data of omega-Zr help determine a suitable functional form of $G_m$(omega)-$G_m$(hcp) in the case of Zr, but such data are not available for omega-Ti. The Cp(T) curves of omega-Zr and hcp-Zr are well separated at about 300K, yet those of Ti calculated in Mei et al. are suspiciously close, which is therefore not used.

At this point 4 data points (constraints) are obtained. On the modeling aspect, the above equation is used to describe omega-Ti for T<$T_{lim}$=298.15(K), which adds 5 free parameters. The continuity conditions at $T_{lim}$ add 4 constraints. Therefore an equation for $G_m$(omega-Ti) with 3 free parameters can have all parameters properly determined:

$$G_m^{\omega}-G_m^{\alpha}=k_0+k_1T+k_{-1}/T(T\geq298.15)$$

Hereby all free parameters and constraints may be summarized:

$$G_m^{\omega}=\begin{cases} E_0+\frac{3}{2}RT_E+3RT\ln(1-e^{-T_E/T})- & 0\leq T<298.15 \\ \quad \frac{a_L}{2}T^2-\frac{b_L}{20}T^5-\frac{c_L}{6}T^3, & \\ \quad G_m^{\alpha}+k_0+k_1T+k_{-1}/T, & T\geq298.15 \end{cases}$$

Free parameters: $E_0$, $T_E$, $a_L$, $b_L$, $c_L$, $k_0$, $k_1$, $k_{-1}$ (total: 8).

Constraints: (total: 8)

$$\begin{cases} (G_m^{\omega}-G_m^{\beta})|_{T=723}=0 \\ (G_m^{\omega}-G_m^{\alpha})|_{T=186}=0 \\ \frac{d(G_m^{\omega}-G_m^{\alpha})}{dT}|_{T=186}=-(S_m^{\omega}-S_m^{\alpha})|_{T=186}=1.902 \\ (G_m^{\omega}-G_m^{\alpha})|_{T=0}=-203 \\ (G_m^{\omega}-G_m^{\alpha})|_{T=298.15}\ \text{continuous} \\ \frac{d(G_m^{\omega}-G_m^{\alpha})}{dT}|_{T=298.15}\ \text{continuous} \\ \frac{d^2(G_m^{\omega}-G_m^{\alpha})}{dT^2}|_{T=298.15}\ \text{continuous} \\ \frac{d^3(G_m^{\omega}-G_m^{\alpha})}{dT^3}|_{T=298.15}\ \text{continuous} \end{cases}$$

This nonlinear and cumbersome set of equations is put in MatLab to solve. The results are:

$$\begin{cases} E_0=-7925.6 \\ T_E=232.05 \\ a_L=-1.2066\times10^{-2} \\ b_L=1.4651\times10^{-9} \\ c_L=-9.4686\times10^{-5} \\ k_0=-1401.9 \\ k_1=4.4391 \\ k_{-1}=1.1019\times10^{5} \end{cases}$$

Figure 13:
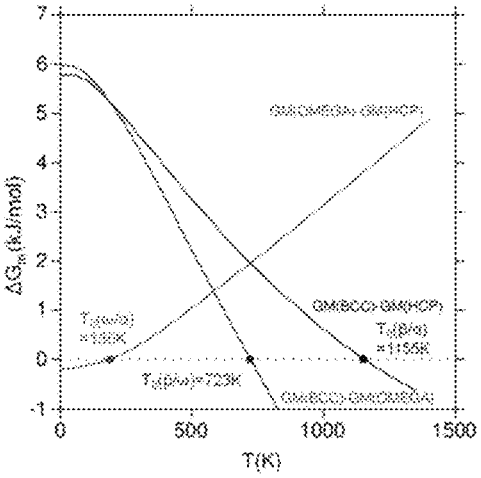
FIG. 13 shows Gibbs energy differences of pure Ti according to certain embodiments of the present invention.

The final form of $G_m^{\omega}-G_m^{\alpha}$ and $G_m^{\beta}-G_m^{\omega}$ are plotted in FIG. 13, together with $G_m^{\beta}-G_m^{\alpha}$ from SGTE database.

E(omega)-E(bcc) at 0K is obtained by Quantum Espresso and USPP in Table 1, and a factor of 0.357 is needed for CALPHAD according to the above equation. Al and Zr are left unmodified because of their small E(omega)-E(bcc) values. For V+8965 J/mol is taken for $G_m$(omega)-$G_m$(bcc) as a better value. For other elements, the factor 0.357 is multiplied to E(omega)-E(bcc) from QE.

TABLE 6

| Gm(omega)-Gm(bcc) for CALPHAD database | |
|---|---|
| Element | $G_m$(omega)-$G_m$(bcc), J/mol |
| V | 8965 |
| Nb | 6878 |
| Ta | 7795 |
| Mo | 13938 |
| Fe | 9962 |
| Al | 1606 |
| Sn | −74 |

It is assumed a constant $G_m$(omega)-$G_m$(bcc) independent of temperature, like in the case of SGTE database for many unstable phases.

4.2 Binary Systems

The formation temperature of athermal ω phase has been measured by electrical resistivity, TEM dark-field (DF) image or selected-area diffraction (SAD) patterns, and thermal analysis during quenching. It is also correlated with an increase of elastic moduli and a transition of bcc deformation mode from slip to twinning. For resistivity measurements and TEM observations, the temperature hysteresis of the formation/reversion of athermal ω phase are usually very small except for the alloys with large oxygen content. Based on these observations, it is believed that (1) the formation of athermal ω particles is a gradual process, from ω-like embryos around point defects to nano-particles visible in TEM images, with an continuously increasing radius as temperature is lowered, and that (2) the growth/shrinkage of athermal ω particles is a result of a balance between chemical driving force and stored elastic energy due to β/ω lattice misfit. Therefore, $T_0$(bcc-omega) should be the "ω-start" temperature ($\omega_S$) with negligible elastic energy and should be consistent with the results of bulk ω phase. Based on these points and compiled data, the $\omega_S$ temperature measured by electrical resistivity as $T_0$(bcc-omega) is taken, because it connects the $T_0$(bcc-omega) of pure Ti and first-principles calculations (if accurate) smoothly. It turns out that electrical resistivity is a technique not too sensitive to detect ω-like embryos around point defects nor too retarded to respond only to nano-particles with considerable elastic strain energy.

For most of the systems the inventors started from COST507B, a light-metal database by the European Cooperation in the field of Scientific and Technical research (COST) published in 1998. Following the guidelines listed above, the updated versions of hcp and omega phases have been complied and named TiGen for "Titanium Genome".

Figure 14:
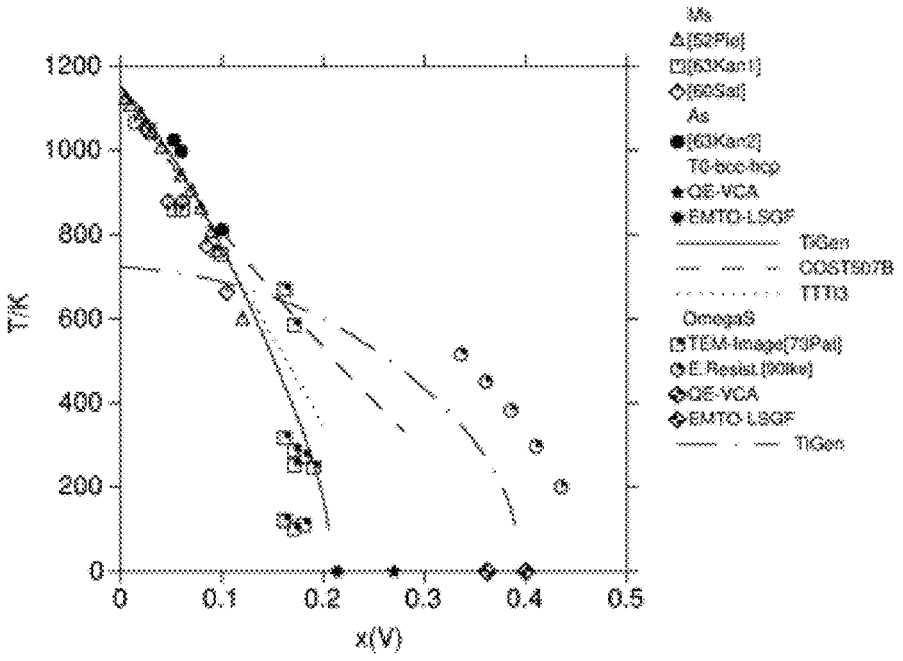
FIG. 14 shows a Ti—V system according to certain embodiments of the present invention.

FIG. 14 shows a Ti—V system according to certain embodiments of the present invention. As shown in FIG. 14, TiGen captures the downward curvature of experimental $M_S$ and $A_S$ data and systematically avoids $M_S$>$T_0$(bcc-hcp), while the $T_0$(bcc-hcp) curves from COST507B and TTTI3 (Ti-DATA-v3) have less curvature and intersect with experimental $M_S$. The extension to 0K agrees reasonably well with DFT results. Because of the close chemical natures of Ti and V, both QE-VCA and EMTO-LSGF work well for this system.

For bcc-omega transformation, the $\omega_S$ data of Ti—V alloys from electrical resistivity connect smoothly with the $\omega_S$ of pure Ti and the $x_0$ calculated by QE and EMTO-LSGF. In contrast, the $\omega_S$ measured by TEM decreases abruptly, extending to an $x_0$(bcc-omega) much lower than DFT predictions, therefore not used as $T_0$(bcc-omega). The measurements are based on the visibility of TEM-SAD spots of ω phases and that of ω particles in dark-field images, where the particles are of nanometer sizes. $T_0$(bcc-omega) also intersects with experimental $M_S$ because of their competitiveness. Despite some experimental uncertainties, the thermodynamics of martensitic and athermal ω phases are well represented by TiGen.

Figure 15:
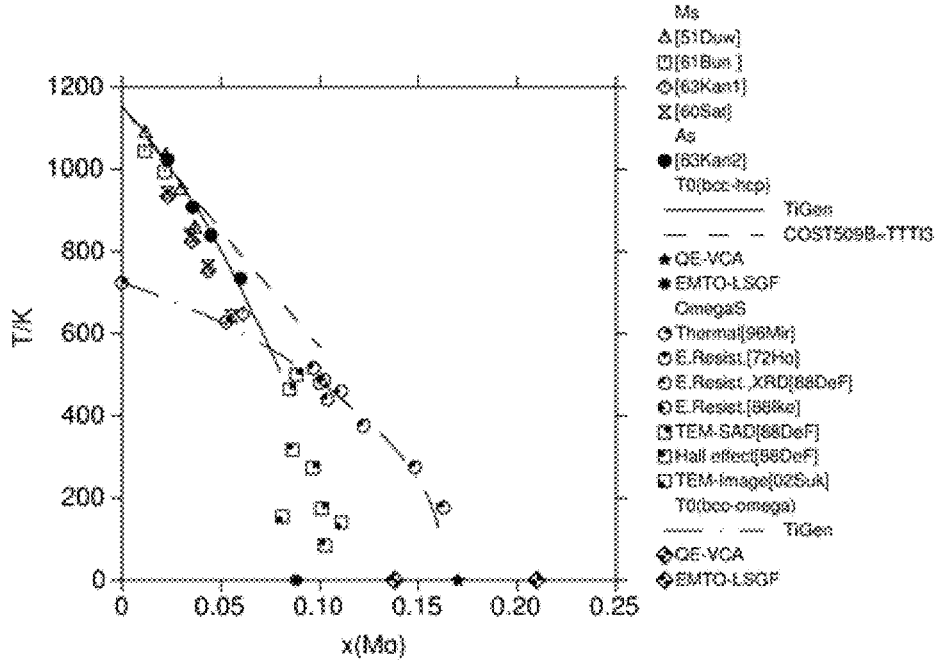
FIG. 15 shows a Ti—Mo system according to certain embodiments of the present invention.

FIG. 15 shows a Ti—Mo system according to certain embodiments of the present invention. A significant improvement of $T_0$(bcc-hcp) over COST507B and TTTI3 is done with the notion of experimental $A_S$. In Ti—Mo, the $\omega_S$ data by thermal arrest and by electrical resistivity are consistent with each other, distinct from those by TEM-SAD and/or imaging and Hall effect. The termination of $M_S$ by $\omega_S$ is precisely represented. DFT results are not considered in optimization.

Figure 16:
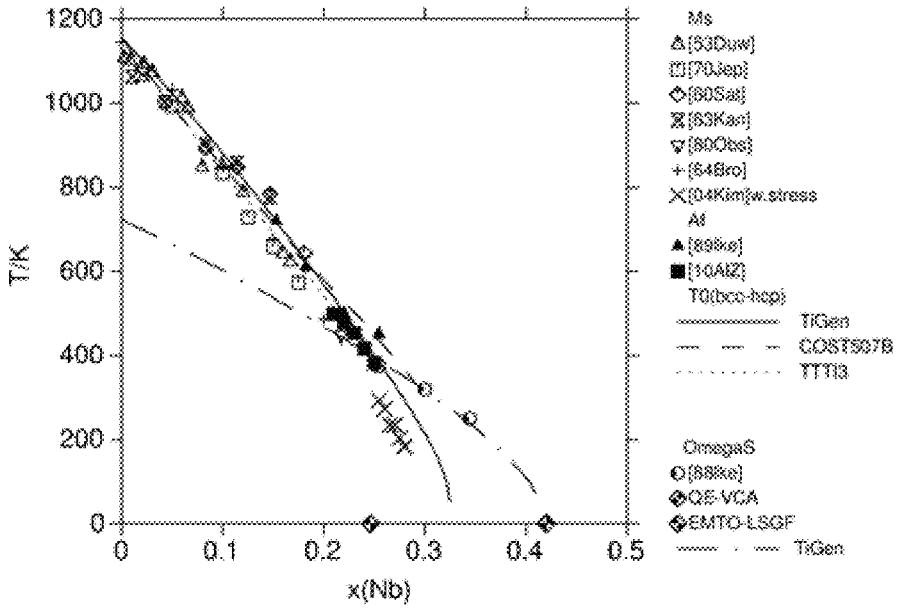
FIG. 16 shows a Ti—Nb system according to certain embodiments of the present invention.

FIG. 16 shows a Ti—Nb system according to certain embodiments of the present invention. Ti—Nb has the most abundant data on martensitic formation and reversion among all Ti binary systems. In this case the $A_f$-$M_S$ gap is as small as 40K (close to the experimental uncertainty of $A_f$ or $M_S$), implying thermoelasticity of the martensite in this system. Therefore $T_0$(bcc-hcp)=$A_f$ is taken. The TiGen description of $T_0$(bcc-hcp) passes the measured $A_f$ data at low temperatures, but still lower than some $M_S$ data at high temperatures due to experimental scattering. $\omega_S$ is available from electrical resistivity method, which connects smoothly with pure Ti. The termination of $M_S$ at its intersection with $\omega_S$ is also well represented. The "$M_S$" is taken as the temperature where the lowest tensile stress (about 50 MPa) is needed to trigger martensite. No martensite is obtained by quenching alone. It is worth noting that the intersection of $M_S$ and $\omega_S$ of Ti—Nb system is much lower than those of Ti—V and Ti—Mo systems, which allows studies of mechanically induced martensite at room temperature where athermal ω is not too dominant.

Figure 17:
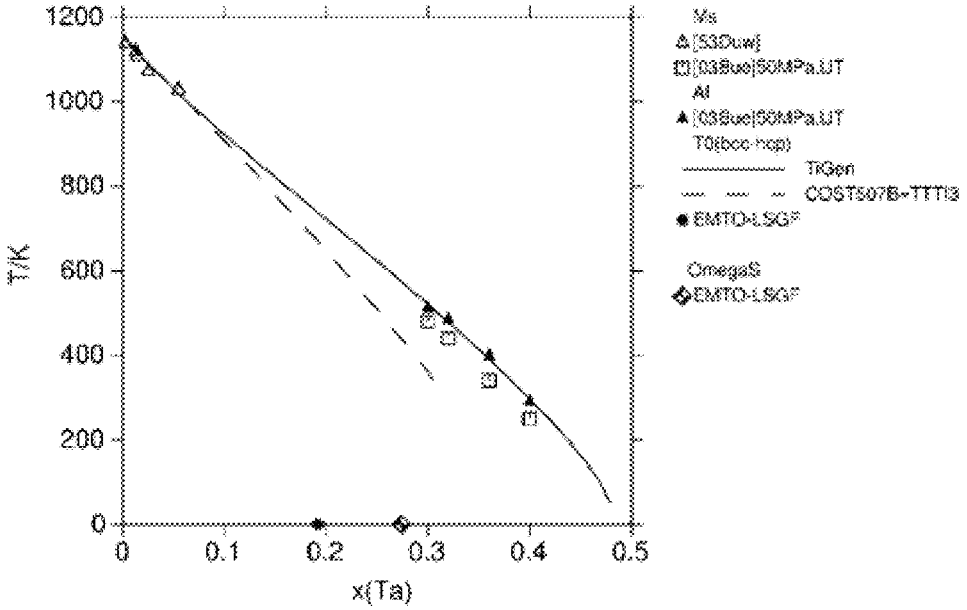
FIG. 17 shows a Ti—Ta system according to certain embodiments of the present invention.

FIG. 17 shows a Ti—Ta system according to certain embodiments of the present invention. At the time when COST507B and TTTI3 are completed, only $M_S$ data were available at high temperatures. More recently, Buenconsejo et al. reported $M_S$ and $A_f$ at low temperature regions, which is used to modify $T_0$(bcc-hcp) in spite that their values are obtained under 50 MPa tensile stress. Similar to the Ti—Nb alloys studied, the Ti—Ta alloys may have athermal ω particles in bcc phase. No experimental $\omega_S$ data are available for Ti—Ta system. The $x_0$(bcc-omega) by EMTO-LSGF is probably too low.

Figure 18:
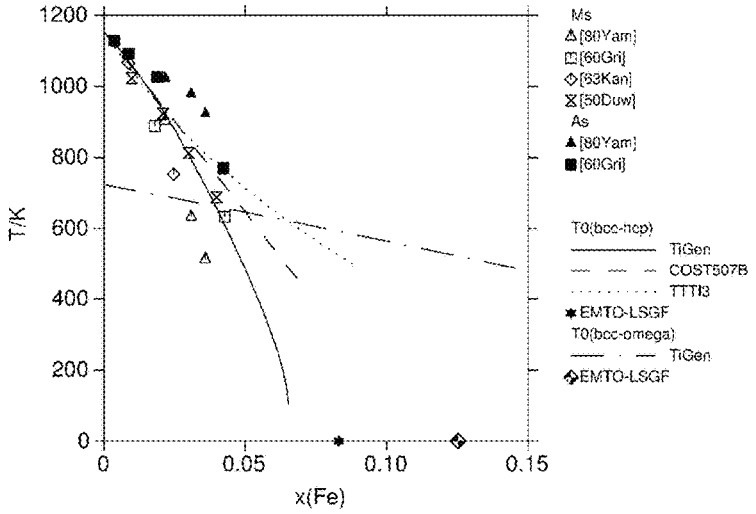
FIG. 18 shows a Ti—Fe system according to certain embodiments of the present invention.

FIG. 18 shows a Ti—Fe system according to certain embodiments of the present invention. For Ti—Fe, the bcc description by Dumitrescu et al. is taken instead of COST507B. $T_0$(bcc-hcp) for Ti—Fe is significantly modified according to 0.5($M_S$+$A_S$) data, obtained by thermal arrests during rapid cooling (speed >20000° C./s) and heating (>500° C./s). Other $M_S$ and $A_S$ data, though scattered, also show a downward curvature which COST507B and TTTI3 fail to reproduce. $M_S$ is higher and close to the calculated $T_0$(bcc-hcp). As of $T_0$(bcc-omega), there exist electrical resistivity measurements of a series of Ti—Fe alloys, but the published results only covers a limited composition-temperature region, therefore not allowing an accurate determination of $\omega_S$. TEM observations of as-quenched Ti-22 at % Fe show sharp ω diffraction spots and ω particles in DF images. Accordingly, the estimated $T_0$(bcc-omega) from TiGen has a weak dependence on Fe composition, starkly different from $T_0$(bcc-hcp). There are two $M_S$ data points below $T_0$(bcc-omega), which requires further investigation.

Figure 19:
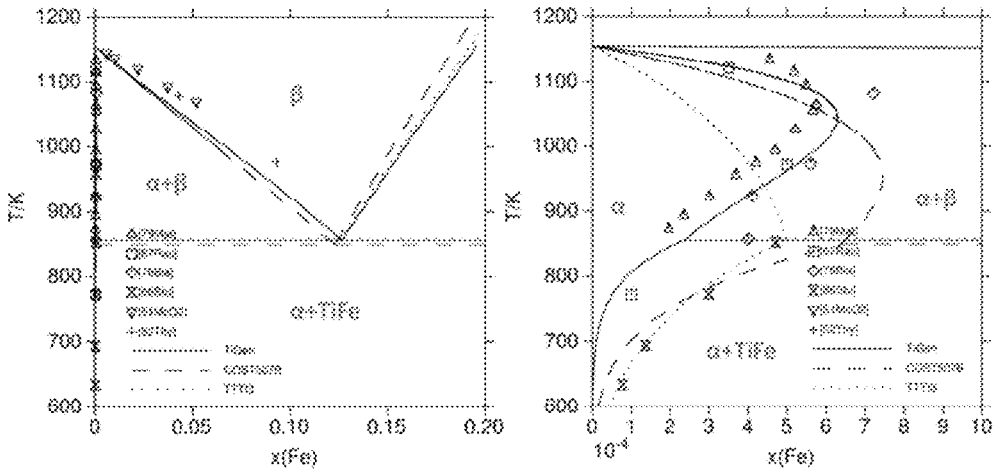
FIG. 19 shows a Ti—Fe phase boundaries according to certain embodiments of the present invention.

FIG. 19 shows a Ti—Fe phase boundaries according to certain embodiments of the present invention. The modification to Ti—Fe is the most significant one among all the binary systems, yet calculated phase boundaries still agree with experimental and other assessments reasonably well.

Figure 20:
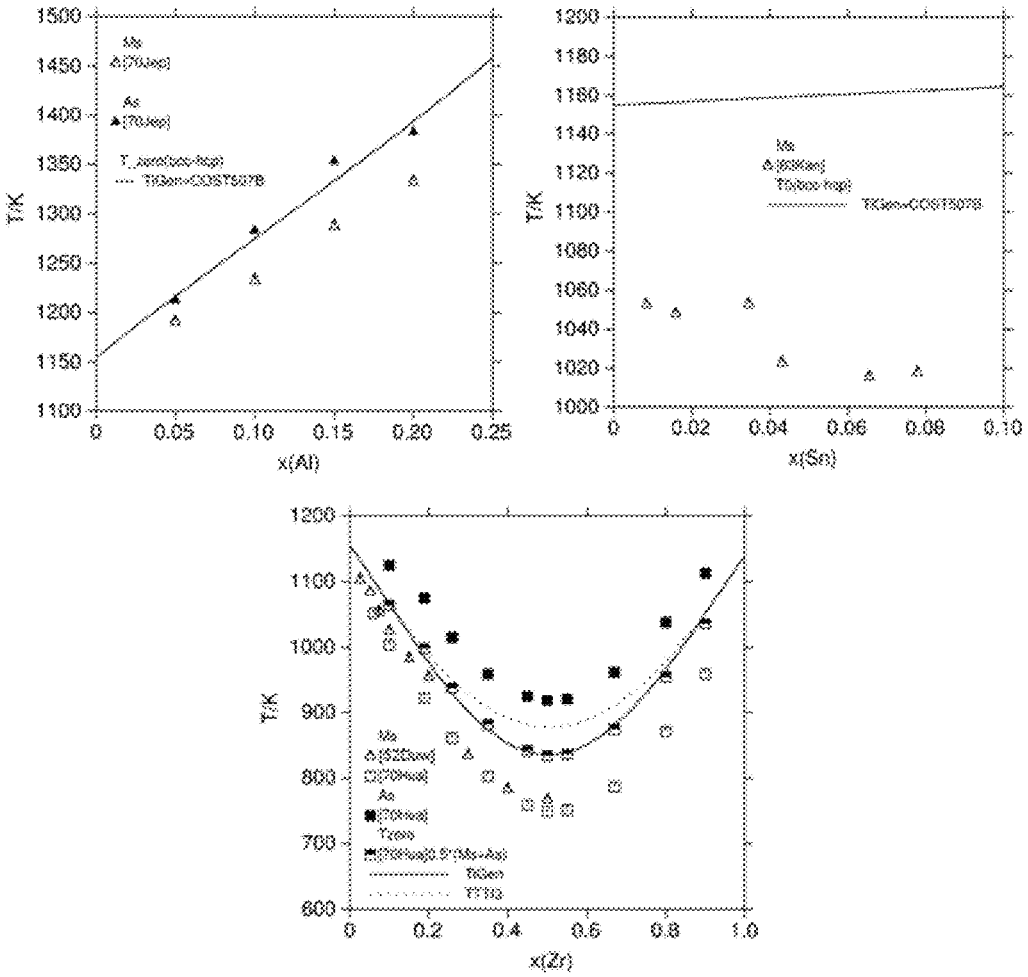
FIG. 20 shows Ti—Al, Ti—Sn and Ti—Zr systems according to certain embodiments of the present invention.

FIG. 20 shows Ti—Al, Ti—Sn and Ti—Zr systems according to certain embodiments of the present invention. Binary phase diagrams show that Al, Sn and Zr are α-stabilizer, neutral element, and weak β stabilizer, respectively. The COST507B description of Ti—Al and Ti—Sn is kept. For Ti—Zr system, the parameters of bcc are used, and hcp Ti—Zr description are modified to fit $T_0$(bcc-hcp) to 0.5 ($M_S$+$A_S$). However, the inventors are more interested in their behaviors in ternary alloys where the main alloying element is a β stabilizer (V, Mo, Nb, Ta, Fe), in which case Al, Sn and Zr exhibit much stronger β stabilizing effects.

4.3 Ternary Systems and Performance Evaluation

Among all the ternary systems, only Ti—Nb—X has sufficient available quantitative information related to martensitic transformations near room temperature, for interests primarily on shape memory effect. For other systems, including the focus Ti—V—X, only qualitative information is available from literature. As discussed above, DSC and dilatometry were used to obtain $M_S$ and $A_f$ data for Ti—V—Al—Fe alloys. For Ti—V—Sn system DFT data is used for estimates.

Figure 21:
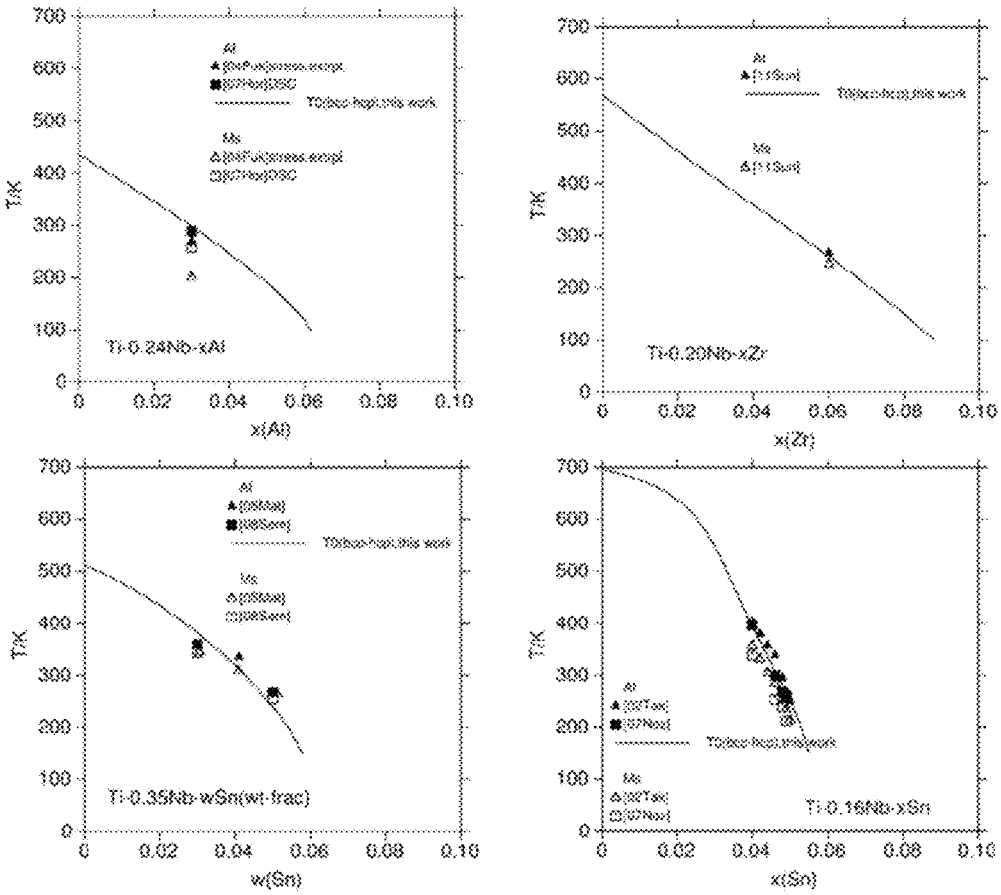
FIG. 21 shows Ti—Nb—Al/Sn/Zr systems according to certain embodiments of the present invention.

FIG. 21 shows Ti—Nb—Al/Sn/Zr systems according to certain embodiments of the present invention. From binary systems the inventors have assessed (Nb,Ti) and (Al/Sn/Zr, Ti) interaction terms. For ternary systems (Al/Sn/Zr, Nb) and (Al/Sn/Zr, Nb,Ti) terms of hcp phase are added to fit to low-temperature $A_f$ data. For Ti—Nb—Sn/Zr systems, a huge unphysical miscibility gap of bcc occurs at high temperature, making $T_0$(bcc-hcp) calculations difficult. Therefore large negative (Al/Sn/Zr, Nb) and (Al/Sn/Zr, Nb,Ti) terms of bcc phase are added to eliminate the miscibility gap merely based on estimation, before assessing the same interaction terms of hcp phase. It is the difference between the same kind of interaction terms for bcc and hcp that determines the $T_0$ temperature. Therefore, if a future assessment of bcc Ti—Nb—Sn/Zr systems gives more realistic (Al/Sn/Zr, Nb) and (Al/Sn/Zr, Nb,Ti) terms, hcp should be adjusted so that the bcc-hcp difference is kept the same.

Figure 22:
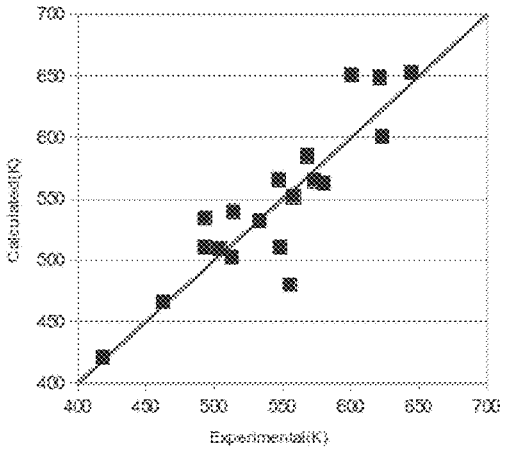
FIG. 22 shows $A_f$ temperatures of Ti—V—Al—Fe alloys according to certain embodiments of the present invention.

FIG. 22 shows $A_f$ temperatures of Ti—V—Al—Fe alloys according to certain embodiments of the present invention. By adding optimized G(hcp,Al,V;0) and G(hcp,Al,Fe;0) it is possible to reproduce the experimental $A_f$ data within reasonable uncertainties.

The $x_0$ results obtained by EMTO-LSGF method (Table 22) is used to estimate the effect of Sn on $T_0$(bcc-hcp) and $T_0$(bcc-omega). It is proved in FIG. 19 that in Ti—V system EMTO-LSGF gives $x_0$ consistent with experimental data. For Ti—V—Sn, after making a small offset for consistency with Ti—V description of TiGen, the results were used to find G(hcp,Sn,Ti,V) and G(omega,Sn,Ti,V).

Example Two

Martensite in Ti alloys has a crystal structure of either hcp (α') or orthorhombic (α"). The change of crystal structure of martensitic transformation is described by an invariant-plane strain (IPS), which is composed of a shear in the invariant plane and a dilatation normal to it. The IPS shear and dilatation are inputs to mechanical driving force, which will be hereinafter calculated. The martensitic dilatation is also an important enhancer of the transformation toughening effect. In this example, a room-temperature molar volume database of bcc (β), hcp (α or α') and orthorhombic (α") phases is created using the same data structure of CALPHAD, which allows the calculations of martensitic dilatation and mechanical driving force.

The orthorhombic distortion from α' to α" phase in Ti alloys is very similar to the tetragonal distortion from body-centered cubic to body-centered tetragonal (bcc-bct) in ferrous martensite. Cahn and Rosenberg pointed out that the physical origin of such distortions is due to an anisotropy in atomic pair correlation caused by short-range ordering, which is inherited from the parent phase. In this example, a computational approach is used to determine the equilibrium short-range ordering parameters of bcc phase at temperature in order to explain the orthorhombicity of α" phase.

1. Lattice Parameters of Martensites: The α'/α" Transition

Figure 23:
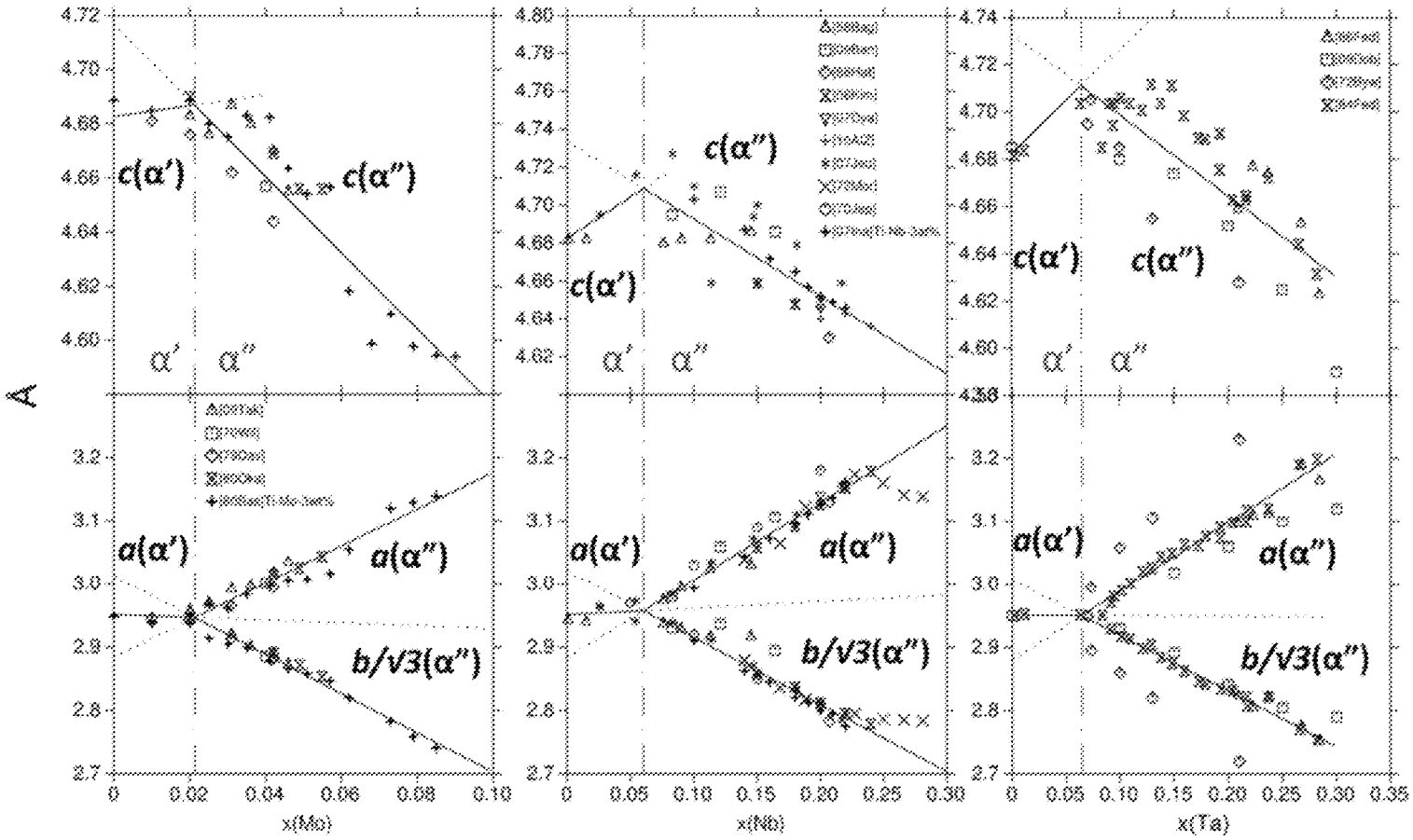
FIG. 23 shows lattice parameters of α' and α" martensites in Ti—Mo/Nb/Ta systems according to certain embodiments of the present invention.

FIG. 23 shows the martensitic lattice parameters of Ti—Mo/Nb/Ta binary systems. An α'/α" transition occurs at a critical composition, featured by a split of $a_{hcp}$ to $a_{orth}$ and $(b/\sqrt{3})_{orth}$. There is no obvious discontinuity in lattice parameters at the α'/α" transition composition within experimental scatter. $M_S$ data as presented above also shows a smooth connection at the α'/α" transition compositions. These facts support the argument that α" is not a discernible new phase but rather a distorted variant of the α' phase.

Figure 30:
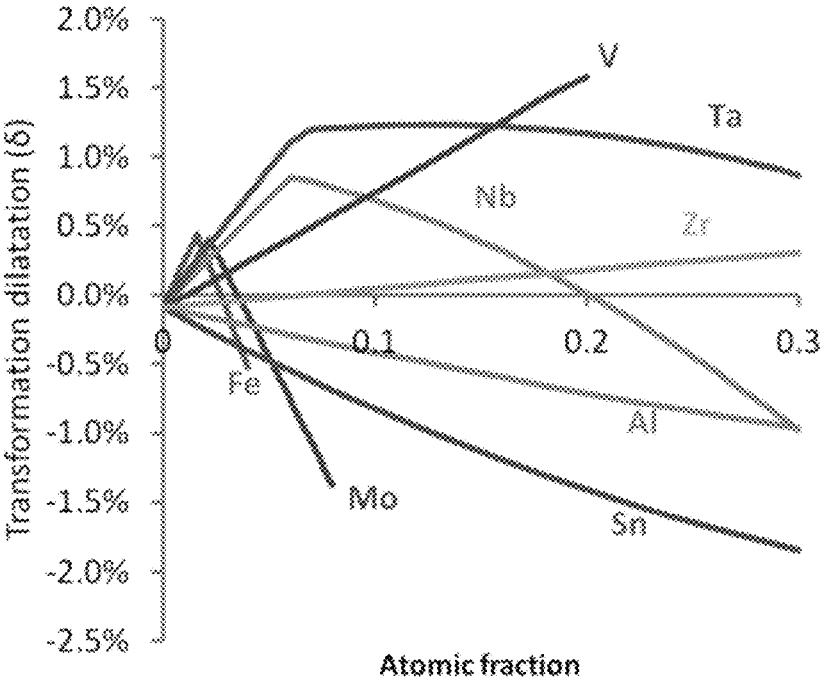
FIG. 30 shows Martensitic dilatation of binary Ti alloys according to certain embodiments of the present invention.

Martensitic lattice parameters of Ti—Mo/Nb—Al ternary alloys are also reported. It is seen that an addition up to 3 wt % (5.5 at %) Al does not change the lattice parameters of Ti—Mo/Nb martensites, as shown in FIG. 30. However, adding similar amount of Al to Ti—V causes an orthorhombic distortion of α' martensite. In certain embodiments, the lattice parameters of α" martensite in Ti—V—Al and Ti—V—Al—Fe systems are measured in an attempt to model the orthorhombicity of Ti—V-based martensite caused by Al.

Some of the alloys listed in Table 3 are used for X-ray diffraction (XRD) experiments. Samples were cold rolled and ground to flat pieces and recrystallized before quenching into ice water. Because the quality of XRD patterns of Ti alloys is susceptible to surface deformation, the samples are either electropolished after mechanical grinding, or prepolished before solutionizing and quenching. Step θ-2θ scans were conducted on a Scintag XDS2000 diffractometer, with 2θ step size <0.1° and 4 sec dwelling time at each step. Diffraction peaks were fitted using pseudo-Voigt functions to find 2θ positions. The peaks of 2θ<70° were adopted in a least-squared fitting using Cohen's method for orthorhombic crystal structure and diffractometer setup, which gave the values of a, b and c parameters of α" phases and their standard deviations.

TABLE 7

Lattice parameters of Ti—V—Al—Fe α" martensite measured by XRD

| Data source | a/Å | b/Å | c/Å | Δa/Å | Δb/Å | Δc/Å |
|---|---|---|---|---|---|---|
| B30 | 3.009 | 4.932 | 4.629 | 0.003 | 0.005 | 0.008 |
| B27 | 2.985 | 4.969 | 4.636 | 0.004 | 0.008 | 0.010 |
| B23 | 3.004 | 4.896 | 4.604 | 0.007 | 0.009 | 0.016 |
| B28 | 2.989 | 4.918 | 4.622 | 0.005 | 0.008 | 0.012 |
| B21 | 3.000 | 4.918 | 4.622 | 0.004 | 0.007 | 0.010 |
| B02 | 2.995 | 4.921 | 4.628 | 0.002 | 0.003 | 0.004 |
| B22 | 2.988 | 4.914 | 4.621 | 0.004 | 0.007 | 0.010 |
| Ref. [114] | 2.990 | 4.900 | 4.570 | 0.010 | 0.020 | 0.020 |
| B01 | 2.979 | 4.922 | 4.638 | 0.002 | 0.004 | 0.006 |
| B31 | 2.972 | 4.963 | 4.637 | 0.003 | 0.005 | 0.006 |
| B24 | 2.982 | 4.924 | 4.625 | 0.003 | 0.004 | 0.006 |
| B08 | 2.972 | 4.930 | 4.632 | 0.002 | 0.004 | 0.005 |
| B03 | 2.977 | 4.955 | 4.639 | 0.003 | 0.005 | 0.008 |
| B04 | 2.984 | 4.929 | 4.632 | 0.003 | 0.005 | 0.006 |

TABLE 7-continued

| Lattice parameters of Ti—V—Al—Fe α" martensite measured by XRD | | | | | | |
|---|---|---|---|---|---|---|
| Data source | a/Å | b/Å | c/Å | Δa/Å | Δb/Å | Δc/Å |
| B25 | 2.987 | 4.928 | 4.626 | 0.003 | 0.004 | 0.007 |
| Ref.[115] | 3.01 | 4.91 | 4.63 | | | |

Figure 24:
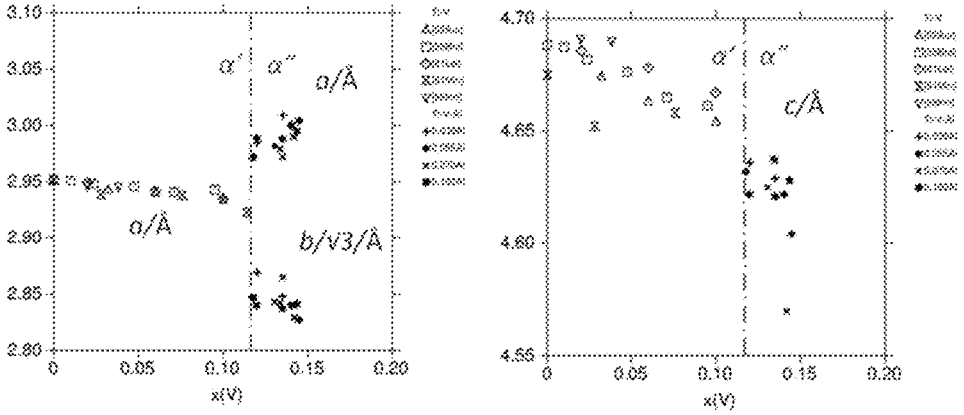
FIG. 24 shows lattice parameters of Ti—V—Al alloys in comparison to Ti—V alloys according to certain embodiments of the present invention.

FIG. 24 shows lattice parameters of Ti—V—Al alloys in comparison to Ti—V alloys according to certain embodiments of the present invention. Unfortunately the lattice parameters of Ti—V—Al—Fe martensites are too scattered to allow modeling the orthorhombicity as a function of compositions. Since the martensite with x(V)>0.1 cannot form in Ti—V binary alloys due to athermal ω phase, it is unclear if the orthorhombicity of the Ti—V—Al alloys studied comes from binary Ti—V alloy or from the addition of Al.

It has been attempted to find the lattice parameters of the hypothetical α" pure Ti by linear back extrapolating in Ti—Mo/Nb/Ta systems and Ti—V—Al system, but common intercepts could not be found. Therefore it is difficult to describe individual lattice parameters using the CALPHAD approach. A physically significant approach is to model the α'/α" transition composition and the orthorhombic distortion beyond the transition point, but it will be very difficult to model multi-component alloys.

2. Molar Volume Modeling 2.1 BCC Phase

Figure 25:
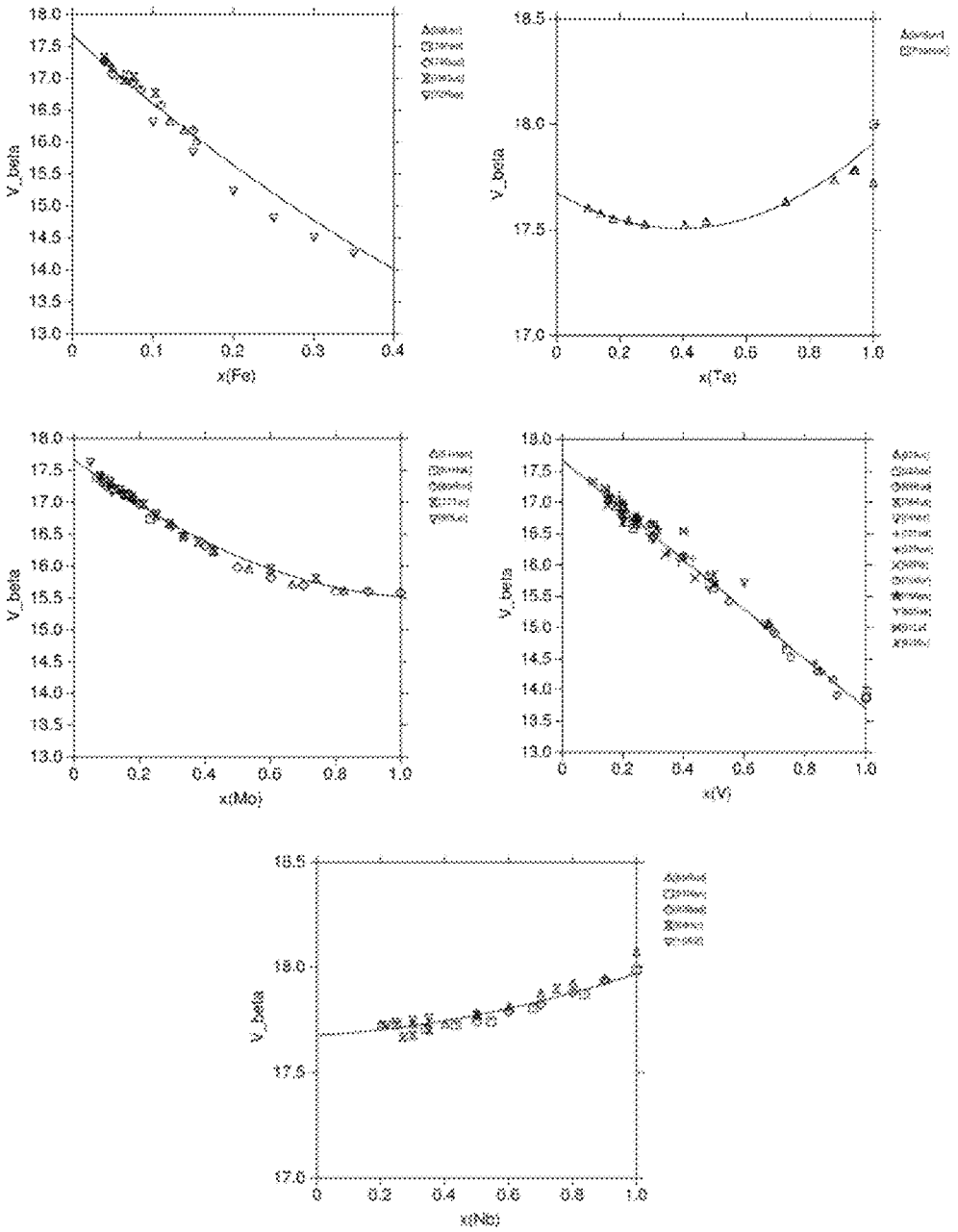
FIG. 25 shows BCC molar volumes in $Å^3$ of Ti—Fe/Mo/Nb/V/Ta systems, experimental data and fitting according to certain embodiments of the present invention.

FIG. 25 shows BCC molar volumes in Å$^3$ of Ti—Fe/Mo/Nb/V/Ta systems, experimental data and fitting according to certain embodiments of the present invention. Lattice parameters of Ti—Fe/Mo/Nb/Ta/V binary systems are available from literature. Because bcc pure Ti is not stable at room temperature, its molar volume is determined by extrapolations as 17.676 Å$^3$/atom ($a_\beta$=3.282 Å). Molar volumes of the other pure elements are taken from the assessment by Lu et al. except for Nb. Using the molar volumes of pure elements, sufficient accuracy is achieved by a single-parameter "regular solution" model for excess molar volume, whose parameter is determined by simple fitting to experimental data.

Figure 26:
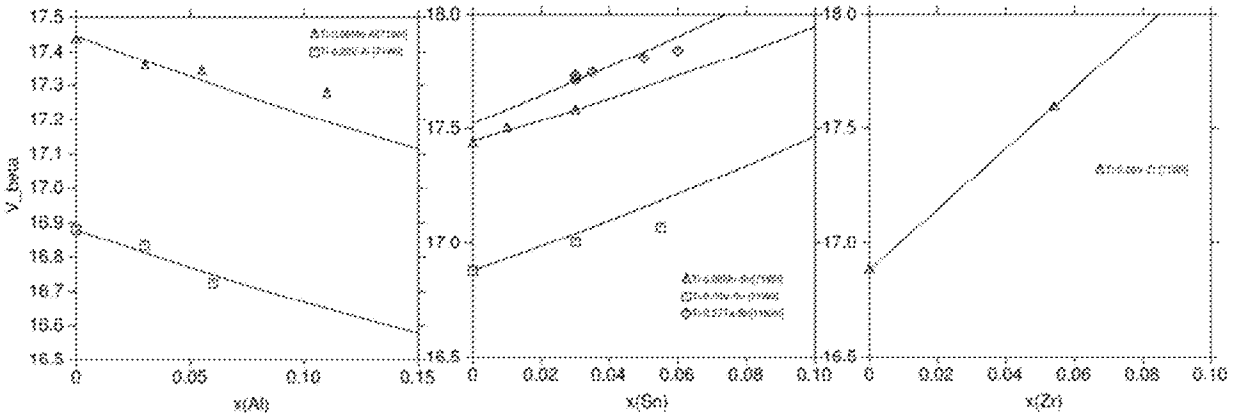
FIG. 26 shows BCC molar volumes in $Å^3$ of Ti—X—Al/Sn/Zr systems, experimental data and fitting according to certain embodiments of the present invention.

FIG. 26 shows BCC molar volumes in Å$^3$ of Ti—X—Al/Sn/Zr systems, experimental data and fitting according to certain embodiments of the present invention. Because the bcc phase is not stable in Ti—Al/Sn/Zr binary systems, the effect of Al, Sn and Zr on bcc molar volumes are taken from ternary alloys Ti—Nb/V—Al/Sn/Zr. The bcc molar volumes of Al and Sn are taken from DFT results by Wang et al., and that of Zr based on an extrapolation of bcc Zr—Nb system. Necessary interaction terms are added to fit to available experimental data.

2.2 HCP Phase

Figure 27:
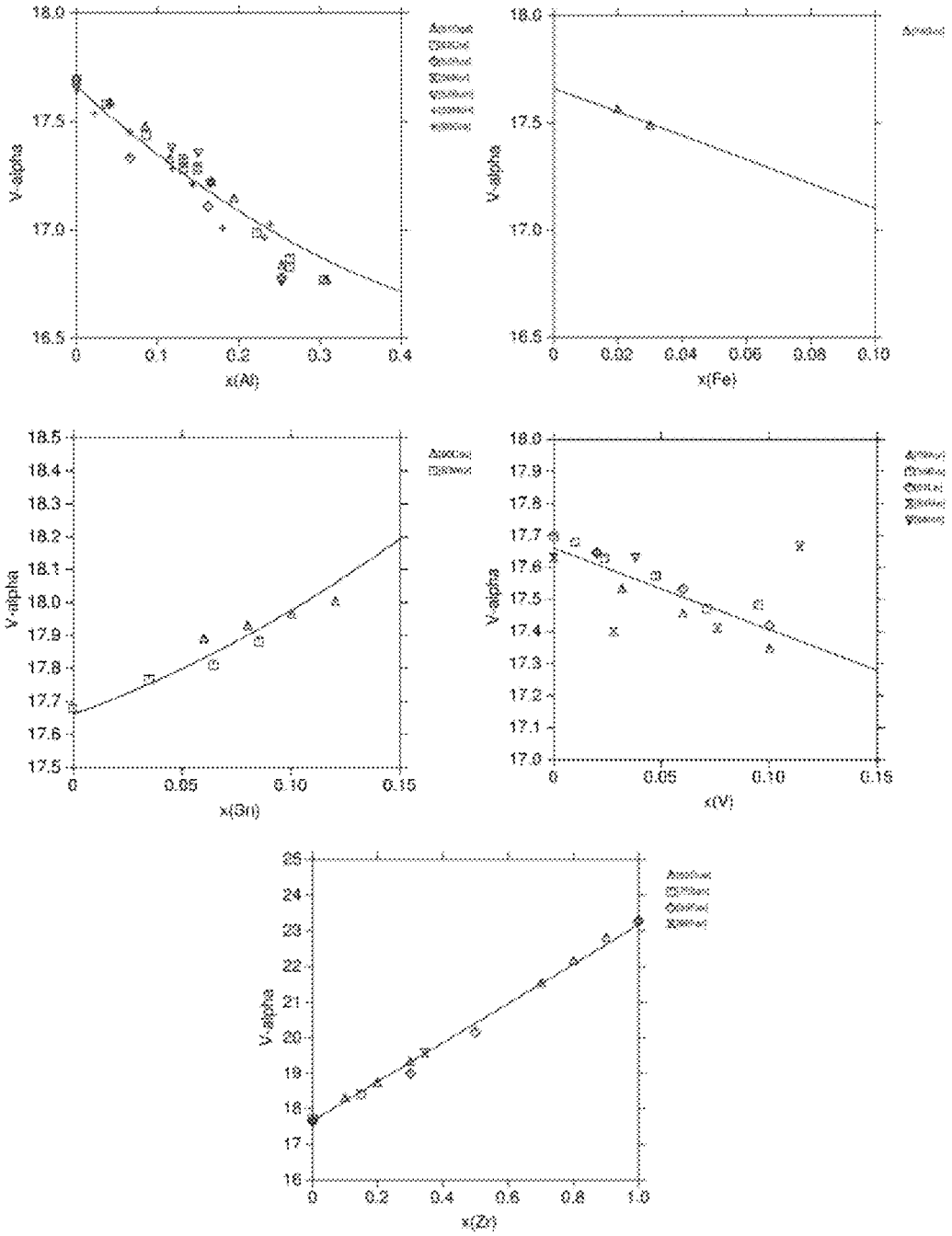
FIG. 27 shows HCP molar volumes in $Å^3$ for Ti—Al/Fe/Sn/V/Zr systems according to certain embodiments of the present invention.

FIG. 27 shows HCP molar volumes in Å$^3$ for Ti—Al/Fe/Sn/V/Zr systems according to certain embodiments of the present invention. Lattice parameters of pure hcp Ti at room temperature have been measured by a number of researchers. In certain embodiments, the values ($a_{hcp}^{Ti}$=2.9512 Å, $c_{hcp}^{Ti}$=4.6874 Å, $V_m$=17.660 Å$^3$/atom) are used because a series of Ti with different O content and extrapolated to pure Ti are measured. The hcp molar volumes of other pure elements are taken from experimental assessments by Lu et al., and DFT calculations if no experimental assessment is available. Interaction terms are obtained by fitting to experimental data of equilibrium α phase (Ti—Al/Zr) or metastable α' phase (Ti—Fe/V/Mo/Nb/Ta).

2.3 Orthorhombic α" Phase

Figure 28:
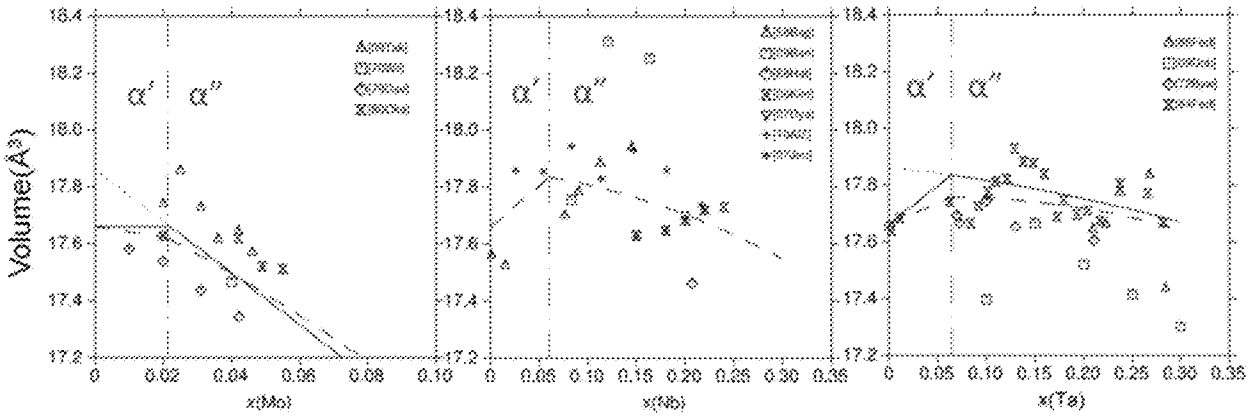
FIG. 28 shows α" molar volume fitting in Ti—Mo/Nb/Ta systems according to certain embodiments of the present invention.

FIG. 28 shows α" molar volume fitting in Ti—Mo/Nb/Ta systems according to certain embodiments of the present invention. As shown in FIG. 28, the dashed curve refers to molar volume calculated by piecewise linear fitting to lattice parameters from FIG. 23, and the solid curve refers to Redlich-Kister polynomial fitting. It should be noted that, for Ti—Nb system the dashed and solid curves overlap. Although not physically meaningful, it is assumed that a molar volume of α" Ti which is the common intercept of all Ti alloy systems. This is done by extrapolating the α" molar volumes from Ti—Mo/Nb/Ta systems. Instead of fitting experimental molar volumes, piecewise linear equations are used to fit the lattice parameters of α'/α" phases first, and then the molar volumes are calculated using the fitted lattice parameters. It is assumed that a common intercept of 17.86 Å$^3$ for α"-Ti to find the molar volumes of α"-Mo/Nb/Ta and binary interaction terms by fitting to the data from fitted lattice parameters.

In these binary systems, the α'/α" transition is determined by an intersection of their molar volumes, and the phase with a smaller molar volume is determined as the martensitic structure. This criterion is not contradictory with the understanding that α" is an intermediate structure between α and β. It is assumed that this is also true for other binary and higher-order systems, which enables a CALPHAD-structured database with the predictability of the real martensitic crystal structure. For each phase the following equation is used to calculate its molar volume:

$$V_m^\phi = \sum_i x_i V_{m,i}^\phi + \sum_{i<j} x_i x_j \Omega_{(i,j)}^\phi$$

where φ stands for β, α' or α" phase, $V_{m,i}^\Phi$ is the molar volume of phase φ of pure element i, $\Omega_{(i,j)}^\Phi$ is the interaction term between different elements i and j.

Figure 29:
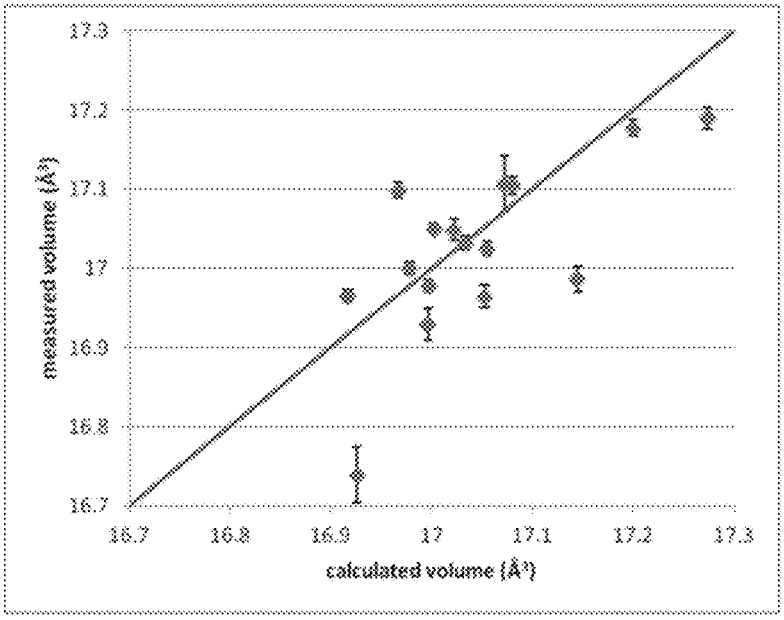
FIG. 29 shows measured versus calculated α" molar volumes of Ti—V—Al—Fe alloys listed in Table 7 according to certain embodiments of the present invention.

The molar volumes of the hypothetical α" phase of other pure elements are determined by linear fitting, assuming zero interaction terms. $V_m^{orth}$(Al) is set equal to $V_m^{orth}$(Ti) based on the notion that 5.5 at % Al does not change the lattice parameters of α" Ti—Mo/Nb as shown in FIG. 23. However, an $\Omega^{orth}_{(Al,V)}$ interaction term is needed if it fit to Ti—V—Al—Fe data from Table 7. The parameters of Sn are determined by α" Ti—Ta—Sn, and those of Zr are estimated based on their values of bcc and hcp phases. FIG. 29 shows measured versus calculated α" molar volumes of Ti—V—Al—Fe alloys listed in Table 7 according to certain embodiments of the present invention. The parameters for molar volume modeling are listed in Table 8.

TABLE 8

| Parameters of molar volumes of β, α' and α" phases | | | | | | |
|---|---|---|---|---|---|---|
| | $V_m^{bcc}$ | $\Omega^{bcc}_{(X,Ti)}$ | $V_m^{hcp}$ | $\Omega^{hcp}_{(X,Ti)}$ | $V_m^{orth}$ | $\Omega^{orth}_{(X,Ti)}$ |
| Ti | 17.676 | N/A | 17.660 | N/A | 17.86 | N/A |
| Fe | 11.637 | −5.20 | 10.155 | +2.14 | 0.0 | 0.0 |
| Mo | 15.520 | −1.78 | 16.218 | +1.46 | 8.78 | 0.0 |
| Nb | 17.969 | −0.20 | 18.836 | +1.81 | 15.00 | +2.6 |
| Ta | 17.912 | −1.10 | 18.759 | +1.72 | 16.53 | +1.0 |
| V | 13.696 | 0.0 | 15.117 | 0.0 | 14.29 | 0.0 |
| Al | 17.069 | −2.16 | 16.788 | −2.49 | 17.86 | 0.0 |
| Sn | 28.312 | −6.82 | 27.809 | −7.76 | 26.51 | 0.0 |
| Zr | 22.936 | 0.0 | 23.168 | 0.0 | 23.3 | 0.0 |
| Cross terms | $\Omega^{bcc}_{(V,Zr)}$ = +40 | | | | $\Omega^{orth}_{(Al,V)}$ = −43.5 | |

3. Martensitic Transformation Dilatation and Shear Magnitude

The transformation dilatation is defined as:

$$\delta = \frac{V_m(\alpha_M) - V_m(\beta)}{V_m(\beta)}$$

The compiled parameters for molar volumes as described above are used to calculate the martensitic dilatation. FIG. 30 shows Martensitic dilatation of binary Ti alloys according to certain embodiments of the present invention. According to the molar volume model, the transformation dilatation reaches its maximum at the α'/α" transition composition. All β stabilizing elements enhance β→α' dilatation, but once α" martensite takes over the dilatation goes down with increasing alloying element.

The method of calculating IPS shear magnitude has been developed by Bowles and MacKenzie, who studied the β→α'/α" case using the general principles established. However, this involves detailed modeling of individual lattice parameters for multi-component alloys. For simplicity, the value of 0.13 is used as a "universal" shear magnitude, which is close to the average of most cases to be considered.

Example Three

The theory of heterogeneous nucleation of martensite has been established by Olson and Cohen. According to this theory, the nucleation of martensite does not require an embryo of the same crystal structure, but rather it requires suitable defects as nucleation sites. Provided sufficient driving force, martensite nucleates without an energy barrier and grows spontaneously. The semi-coherent martensitic interface is composed of coherency dislocations and anti-coherency dislocations, whose motions encounter various kinds of obstacles that exert a frictional work against the martensitic interfacial motion. The critical condition for martensite to nucleate is given by the following equation:

$$\Delta G_{chem}+\Delta G_{mech}=-(W_f+G_0)$$

with the left hand side being the total driving force contributed from chemical thermodynamics ($\Delta G_{chem}$) and applied stress ($\Delta G_{mech}$), and the right hand side being the critical driving force ($\Delta G_{crit}$) which consists of a composition-dependent frictional work term $W_f$ and a nucleation potency term $G_0$.

Quantitative models for martensitic nucleation in ferrous systems have been established. In this embodiment, the thermodynamic database TiGen and the molar volume database are used to evaluate the critical driving forces for Ti alloys.

In the case of martensite formed by quenching, only chemical driving force contributes. For β→α'/α" transformation in Ti alloys, $$\Delta G_{chem}=G_m(\alpha)-G_m(\beta)$$

with fixed composition, which is calculated using Thermo-Calc and TiGen database. By its definition, the critical driving force should equal the chemical driving force at the $M_S$ temperature:

$$\Delta G_{chem}=\Delta G_{crit}(\text{at } T=M_S)$$

For martensite in solid solutions, the frictional work $W_f$ comes solely from solution hardening. It is found that the $\Delta G_{crit}$ of Ti—V/Nb/Mo/Ta/Fe/Al binary systems can be represented by linear equations in the following form:

$$\Delta G_{crit} = -G_0 - \sum_i K_i x_i$$

This is also consistent with the linear solution hardening law observed in Ti alloys. Some Ms data points are not adopted due to possibly inferior quality.

TABLE 10

Parameters of $\Delta G_{crit}$ of Ti alloys (J/mol)

| $G_0$ | K(Fe) | K(Mo) | K(V) | K(Ta) | K(Nb) | K(Al) | K(Sn) | K(Zr) |
|---|---|---|---|---|---|---|---|---|
| 71 | 16714 | 6951 | 2441 | 664 | 533 | 472 | 0 | 0 |

Figure 31:
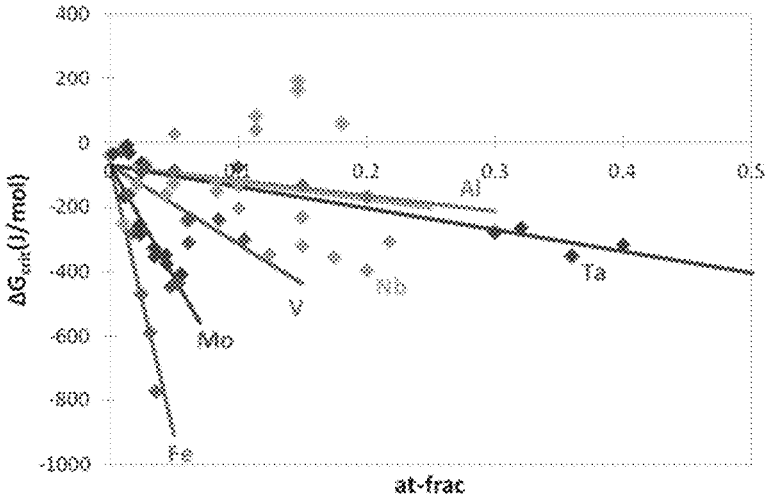
FIG. 31 shows Modeling $\Delta G_{crit}$ of Ti alloys using TiGen and selected $M_S$ points according to certain embodiments of the present invention.
Figure 32:
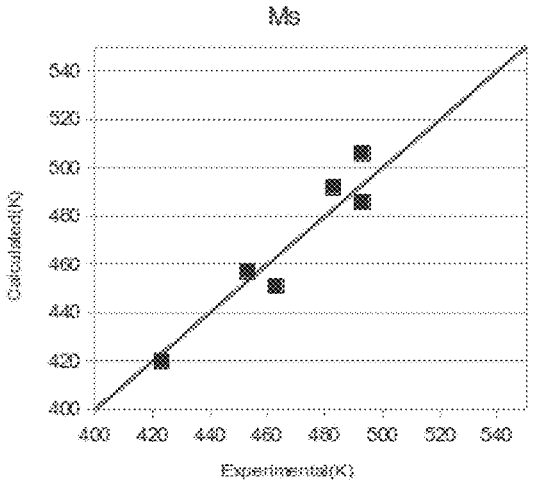
FIG. 32 shows Calculated versus experimental Ms temperatures of Ti—V—Al—Fe alloys according to certain embodiments of the present invention.

FIG. 31 shows Modeling $\Delta G_{crit}$ of Ti alloys using TiGen and selected $M_S$ points according to certain embodiments of the present invention. The contributions to $\Delta G_{crit}$ by Sn and Zr deserve special treatment. In binary systems their parts of $\Delta G_{crit}$ tend to increase in a non-linear way and saturate. The $\Delta G_{crit}$ of Ti—Sn system does not extrapolate to the same intercept at pure Ti as other Ti—X binary systems. However, in ternary systems where Sn and Zr are secondary alloying elements, the critical driving force is negligible. This discrepancy in $\Delta G_{crit}$ may relate to a significant difference of transformation dilatation and shear magnitudes between binary Ti—Sn/Zr and ternary Ti—X—Sn/Zr systems. The focus in this embodiment is not binary Ti—Sn/Zr systems where $M_S$ values are much higher than room temperature, but ternary/higher-order systems where $M_S$ is equal to or below room temperature. Therefore it is assumed that Sn and Zr contribute negligible frictional work, and their K coefficients are taken as zero. FIG. 32 shows Calculated versus experimental Ms temperatures of Ti—V—Al—Fe alloys according to certain embodiments of the present invention. As shown in FIG. 32, the calculated $M_S$ values are consistent with dilatometric measurements:

Because of the shear and dilatational strains associated with martensitic transformation, applied stress can provide mechanical driving force. The method by Patel and Cohen in stress-assisted nucleation region is adopted. For a martensite with an IPS shear strain γ and dilatation δ, the associated mechanical work (negative mechanical driving force) is $$W=\tau\gamma+\sigma_n\delta$$

where τ and $\sigma_n$ are shear and normal stresses resolved on the invariant plane. Assuming a random polycrystalline austenite, the transformation stress is controlled by the most preferential martensite variant, i.e. the variant which requires the minimum applied stress for transformation. From an analysis using Mohr's circle, the mechanical driving force is:

$$\Delta G_\sigma^{UT} = -V_m\bar{\sigma}\left(\frac{\delta + \sqrt{\gamma^2 + \delta^2}}{2}\right)$$

for uniaxial tension and $$\Delta G_\sigma^{CT} = -V_m\bar{\sigma}\left(\frac{5\delta + \sqrt{\gamma^2 + \delta^2}}{2}\right)$$

for crack-tip stress state. Using $\gamma$=0.13 and $\delta$ determined from Example 2, the mechanical driving force can be calculated given the applied stress and stress state.

Example Four

1. Introduction to Ti-1023 Alloy

Ti-1023, namely Ti-10V-2Fe-3Al (wt %), is a commercial metastable $\beta$ Ti alloy developed for aerospace applications. After solutionizing above its $\beta$ transus (about 800° C.) and quenching, $\beta$ phase is almost fully retained, with a small amount of martensite forming preferentially on $\beta$ grain boundaries. TEM dark-field imaging shows athermal $\omega$ phase densely populated in the $\beta$ phase matrix, as shown in FIG. 46. Tensile testing shows the formation of mechanically-induced martensite. This makes the stress-strain curves exhibit an upward curvature, as shown in FIG. 6, which is a signature of TRIP effect. The transformation stress has been determined under the as-quenched condition, showing $M_S^o$(ut)>200° C. To lower $M_S^o$(ut) close to room temperature, Ti-1023 can be annealed in ($\alpha$+$\beta$) region to enrich the $\beta$ phase with more $\beta$-stabilizing elements to make it more stable.

In steel research, models of TRIP and transformation toughening were established based on fully austenitic steels before they were applied to dispersed-austenitic TRIP steels. Analogously, in this embodiment the TRIP and transformation toughening effect are modeled using fully or near-fully $\beta$ Ti-1023 alloy before moving on to an ($\alpha$+$\beta$) TRIP Ti alloy.

2. Calculation Of $\beta$ Phase Stability of Ti-1023 Alloy

The actual composition of the Ti-1023 alloy used in this embodiment is measured by ATI Wah Chang, as listed in Table 11. This is used as input for Thermo-Calc calculations. The TTTI3 (also named Ti-DATA-v3) database is used for high-temperature phase equilibria calculations and the TiGen database with the $\Delta G_{crit}$ model (see Example 3) is used for low-temperature $T_0$(bcc-hcp), $M_S$, and $T_0$(bcc-omega) calculations.

TABLE 11

Chemical composition of the Ti-1023 used (unlisted elements not tested)

| | V | Fe | Al | O | N | Ti |
|---|---|---|---|---|---|---|
| wt % | 9.86 | 1.92 | 3.09 | 0.1110 | 0.0092 | Balance |

The calculated $\beta$ transus is 1092K (819° C.). $T_0$(bcc-hcp), $M_S$, and $T_0$(bcc-omega) are calculated using TiGen, neglecting O and N contents. Although TiGen does not include descriptions of O and N, their contents in $\beta$ phase in an $\alpha$+$\beta$ condition are much lower than the overall contents, because O and N are both strong $\alpha$-stabilizing elements and are enriched in the primary $\alpha$ phase.

Annealing at temperatures below the $\beta$ transus has a significant impact on $\beta$ phase stability, as indicated by the calculated $T_0$(bcc-hcp) and $M_S$. Because the $M_S^o$(ut) of as-solutionized Ti-1023 is higher than 200° C., by lowering the annealing temperature it is very promising to lower $M_S^o$(ut) close to room temperature, making it easy to measure. The increase of $\omega_S$ with lowering annealing temperature is primarily due to a loss of Al.

An observed discrepancy with the model is that the calculated $\omega_S$ of solutionized Ti-1023 is lower than room temperature, which contradicts the experimental observation of the athermal $\omega$ phase present at room temperature. It is probable that the suppressive effect of Al to athermal $\omega$ phase is overestimated by TiGen due to the lack of available data on the $\omega$-start temperature in this system.

3. $M_S^o$(ut) Measurement $M_S^o$(ut) is measured by a series of tensile tests at different temperatures. For steels, the single-specimen technique developed by Bolling and Richman is very efficient in determining $M_S^o$(ut). In their method, one single specimen undergoes a tensile stress at a relatively high temperature to yielding, followed by unloading before building up too much work hardening. The temperature is lowered incrementally, with a loading-unloading cycle completed at each temperature step. At temperatures higher than $M_S^o$(ut), the yield strength increases with decreasing temperature. Once the testing temperature becomes lower than $M_S^o$(ut), martensite forms before austenite starts to yield, resulting an apparent "yielding" behavior. Transformation stress decreases as temperature is lowered. As a result, on a plot of "yield" stress versus temperature, there is a peak at $M_S^o$(ut).

While this method is effective for steels, it turns out not very suitable for Ti-1023. Because of a very smooth yielding behavior, a pre-strain is applied to the Ti-1023 sample before actual testing begins in order to sharpen the yielding plateau. Although only a very small plastic strain is applied in each loading-unloading cycle, a stress-temperature cusp at about 50° C. is visible but very weak. On a closer look, the stress-strain curves on loading/unloading becomes nonlinear for T<$M_S^o$(ut), which is a signature of superelasticity. This implies that stress-assisted martensite forms on loading before reaching the yielding plateau and reverses on unloading. Transformation stresses are estimated due to the smoothness of loading/unloading curves, which roughly intersect with yielding stresses at $M_S^o$(ut).

In certain embodiments, the multiple-specimen method is applied, where each specimen is pulled to fracture at a temperature. This method is more expensive, but the transformation stress can be determined more accurately, and full stress-strain curves also provide more information.

Figure 33:
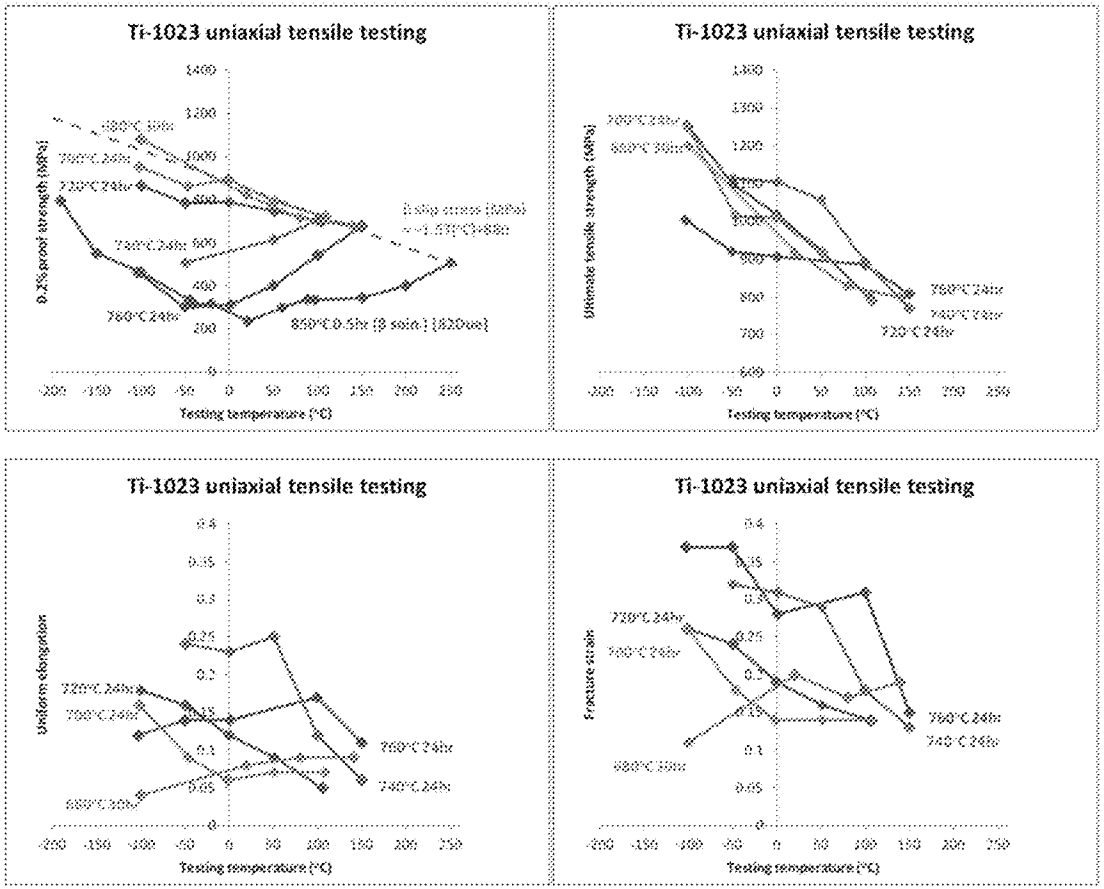
FIG. 33 shows Tensile properties of solutionized and (α+β) annealed Ti-1023 alloys according to certain embodiments of the present invention.

FIG. 33 shows Tensile properties of solutionized and ($\alpha$+$\beta$) annealed Ti-1023 alloys according to certain embodiments of the present invention. The slip stress of $\beta$ phase has a negative temperature dependence caused by reduced dislocation mobilities with decreasing temperature. The as-solutionized Ti-1023 has an $M_S^o$(ut) higher than 250° C. To lower $M_S^o$(ut), the $\beta$ phase needs to be further stabilized by lowering annealing temperature. The Ti-1023 samples annealed at 760° C.-700° C. clearly show a reversed temperature dependence of 0.2% proof stress, which defines their $M_S^o$(ut). Due to the intervals of testing temperatures for each heat treatment condition, the measured $M_S^o$(ut) value may have a ±20° C. uncertainty. The $\beta$ slip stress does not show a significant dependence on heat treatment condition, because the micron-sized primary $\alpha$ particles are too coarse to provide much precipitation strengthening.

TABLE 12

$M_s^o$(ut) temperatures of intercritically annealed Ti-1023

| | Annealing temperature (° C.) | | | |
|---|---|---|---|---|
| | 760 | 740 | 720 | 700 |
| $M_S^o$(ut) (° C.) | 150 | 100 | 20 | 0 |

The uniform ductility $\varepsilon_u$ increases by 100-200% due to mechanically-induced martensite in Ti-1023, exhibiting the TRIP effect. $\varepsilon_u$ also correlates with $M_S^o$(ut). In TRIP steels, $\varepsilon_u$ reaches its maximum at about 30° C. above $M_S^o$(ut).

However, for TRIP Ti-1023, the maximum $\varepsilon_u$ lies below $M_S^o$(ut), probably because martensite in Ti alloys is softer than the β phase, in contrast to the hard martensite in steels.

4. Calculation of $M_S^o$(ut) and $M_S^o$(ct)

Given the thermodynamic and molar volume databases, it is possible to calculate transformation stress using the Patel-Cohen model described above. However, since as-quenched Ti-1023 has athermal ω phase at room temperature which TiGen fails to predict, it is necessary to calibrate the calculations using experimental data to test the predictability of the models.

The IPS shear magnitude γ=0.13 is taken, and calculate the transformation dilatation δ using the models as described above. Using the equilibrium β phase composition predicted by Thermo-Calc using Ti-DATA-v3 database, the dilatation is calculated as a function of annealing temperature. The orthorhombic phase has a smaller molar volume than hcp, and is therefore taken as the stable structure, which is consistent with experimental observation.

The TiGen database as described above is used to calculate $\Delta G_{chem}$, and $\Delta G_{crit}$ is calculated as described above. The required value of $\Delta G_{mech}$ for transformation is equal to $\Delta G_{crit}-\Delta G_{chem}$, from which the transformation stress σ(ut) and σ(ct) can be calculated using Patel-Cohen model.

Figure 34:
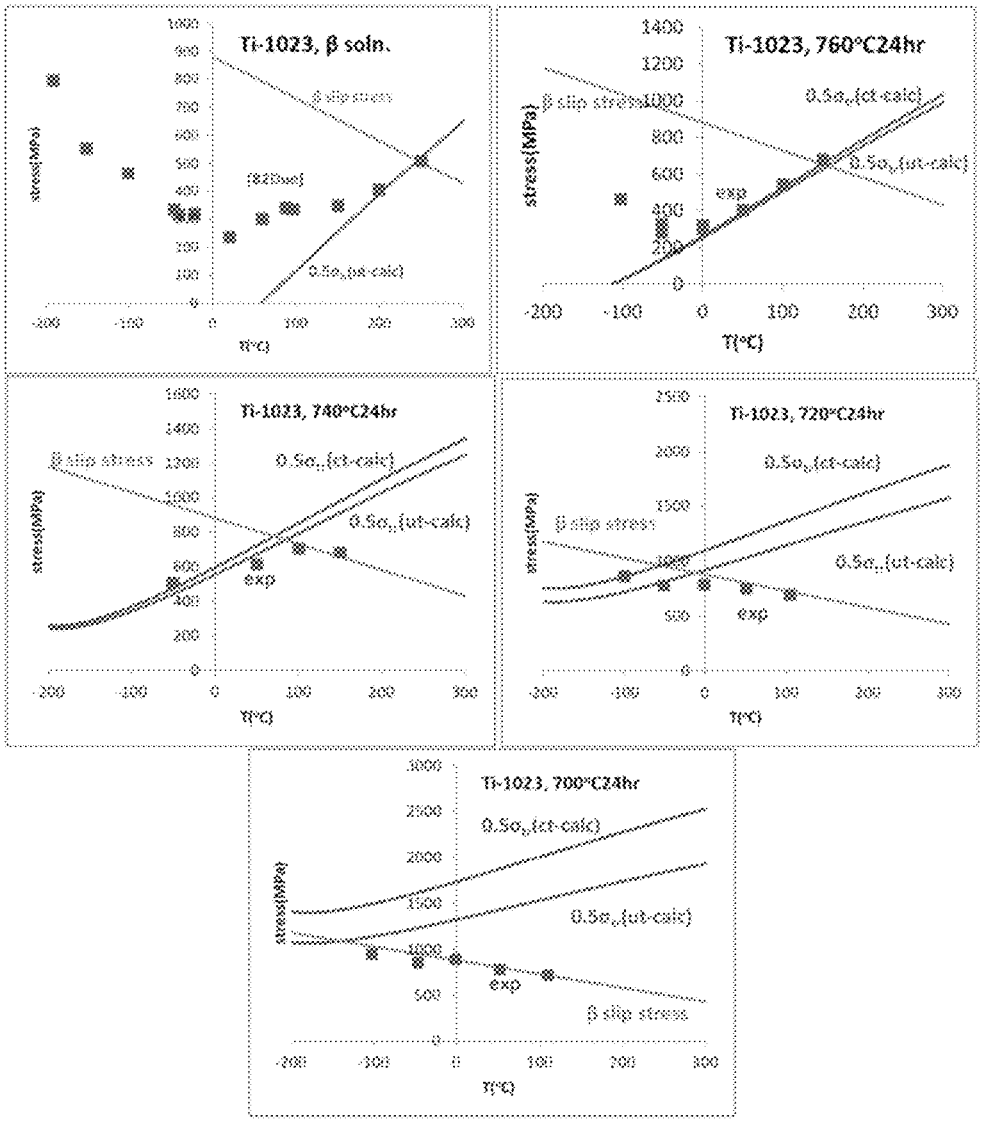
FIG. 34 shows Experimental 0.2% proof strength (red dots), slip stress (green line) and halved Patel-Cohen transformation stresses for uniaxial tension (UT, blue curve) and crack-tip (CT, purple curve) according to certain embodiments of the present invention.

The calculated Patel-Cohen transformation stress is much higher than experimental data. However, after dividing by 2, the transformation stress fits experimental data very well for the samples annealed from 820° C. to 740° C. For the samples annealed at lower temperatures, the halved transformation stress becomes higher than experimental values again. As annealing temperature goes lower, the calculated β phase becomes much more stable than the experimental alloy, probably due to the slow kinetics towards equilibrium. FIG. 34 shows Experimental 0.2% proof strength (red dots), slip stress (green line) and halved Patel-Cohen transformation stresses for uniaxial tension (UT, blue curve) and crack-tip (CT, purple curve) according to certain embodiments of the present invention. Based on the calculations, it is found that annealing at about 730° C. can tune $M_S^o$(ct) to 25° C.

Regarding the factor of 2 on transformation stress, a possible cause is that the entropy change between α" and β phases is smaller than the one between α' and β phases, due to the incompleteness of Bain strain. However, the TiGen database treated the α" phase as a low-temperature extension of the α' phase, without explicit consideration of any structural information. As a result, the calculated $\Delta G_{chem}$ and $\Delta G_{crit}$ for α" martensite can be higher than the real case. The Patel-Cohen $\Delta G_{mech}$ is not over-estimated in the same way as $\Delta G_{chem}$ and $\Delta G_{crit}$, because $\Delta G_{mech}$ does not depend on the thermodynamic database. Therefore, to match the over-estimated $\Delta G_{crit}-\Delta G_{chem}$, the required $\Delta G_{mech}$ may result in a transformation stress twice as large as experimental values. In addition, athermal ω may also reduce the $d(\Delta G_{chem})/dT$ slope and lead to an upward curvature of the stress-temperature curve as described above. It requires more detailed knowledge to separate the effects of martensitic orthorhombicity and athermal ω phase.

5. Fracture Toughness Measurement

To investigate the transformation toughening of Ti-1023, $J_{IC}$ fracture toughness of Ti-1023 under different heat-treatment conditions was measured following ASTM standard E1820. The samples were electrical-discharge machined to single-edge bend geometry with a notch. Each sample had its passivation layer removed before annealing and quench. Because mechanical grinding might trigger martensitic transformation in as-solutionized Ti-1023, samples were pre-polished before heat treatment and the as-tested samples were etched to reveal the microstructure on the surface.

Each heat-treated sample was fatigue pre-cracked to create a fresh crack extending from the machined notch. The sample then underwent a series of three-point bending loading-unloading cycles with the notch-opening displacement recorded by a strain gage. The crack size after each cycle was calculated using the measured elastic compliance.

Figure 35:
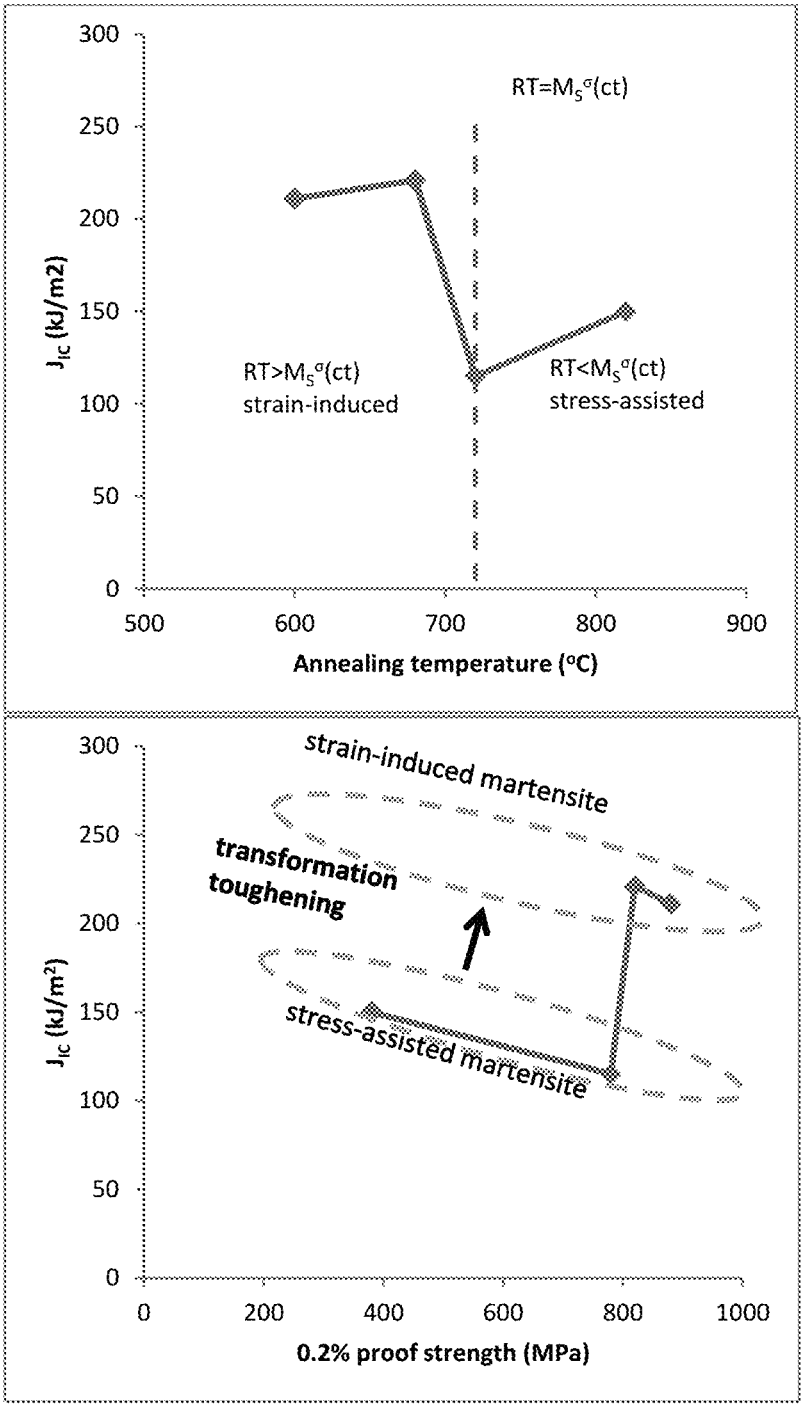
FIG. 35 shows room-temperature $J_{IC}$ fracture toughness of annealed and quenched Ti-1023 according to certain embodiments of the present invention.
Figure 36:
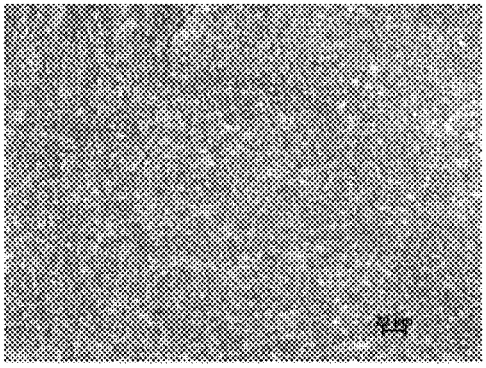
FIG. 36 shows optical micrographs of the $J_{IC}$ samples annealed at 680° C. and 760° C. and tested at 20° C. according to certain embodiments of the present invention.
Figure 36:
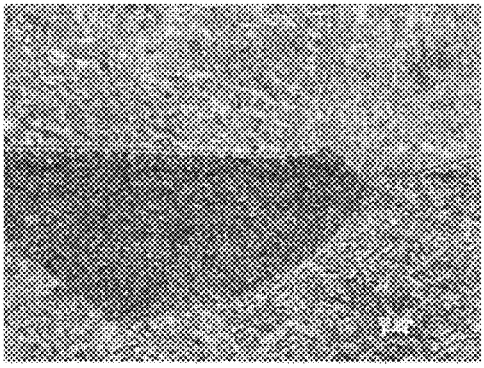
Figure 36:
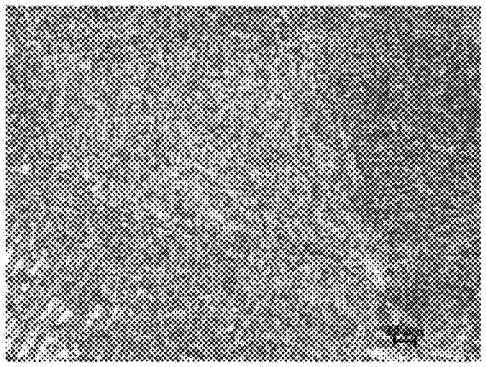
Figure 36:
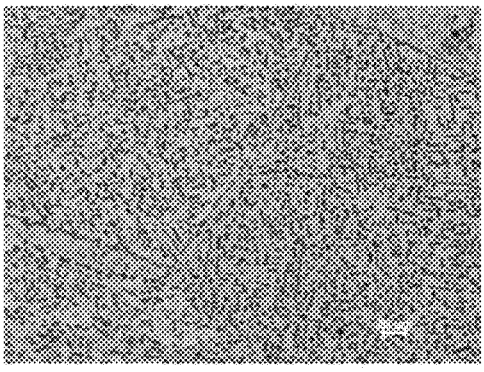

FIG. 35 shows room-temperature $J_{IC}$ fracture toughness of annealed and quenched Ti-1023 according to certain embodiments of the present invention. The room-temperature $J_{IC}$ values of Ti-1023 samples annealed at different temperatures are shown in FIG. 35. FIG. 36 shows optical micrographs of the $J_{IC}$ samples annealed at 680° C. and 760° C. and tested at 20° C. according to certain embodiments of the present invention. The 760° C.-annealed sample exhibited superelasticity, demonstrating a nonlinear loading/unloading behavior which made it impossible to accurately determine the crack extension after each cycle. Therefore, $J_{IC}$ could not be obtained for this sample.

Example Five

1. Ti-5111 Alloy

In the conventional heat treatment of wrought Ti-5111 plates, there are two annealing and cooling steps, which are the key steps to give the final microstructure of Ti-5111. The β annealing allows β-phase recrystallization after hot rolling. The temperature of β annealing is kept within 30-50° C. above β transus to avoid considerable β grain growth. Cooling from β annealing gives a microstructure of colonies of α plates with β phase layers between α plates. A fast cooling results in thinner α plates and smaller colonies. The second annealing is at about 30° C. below β transus, which enriches the α phase with α-stabilizing elements. It also determines the final amount of α phase together with the following cooling step. The cooling rates from both annealing steps are 10-20° C./min. The final amount of β phase is about 15%.

The cooling rate after α+β annealing has a significant effect to the final phase fractions and compositions. A simulation of the β→α diffusional transformation in Ti-5111 using DICTRA software shows that a cooling process of 15° C./min results in a more realistic β phase composition, while equilibrium calculations by Thermo-Calc predicts a smaller amount of β phase with a higher concentration of β-stabilizing elements.

The roles and effects of alloying elements in Ti-5111 are summarized by Tran.

TABLE 13

Ti-5111 alloying elements and effects on properties

| Element | wt % | Effect (S = strength; SCC = stress-corrosion-cracking resistance; W = weldability) |
|---|---|---|
| Al | 5.0 | α stabilizer<br>S: strong substitutional solution hardener in α phase, nucleation and growth of precipitates in matrix, lowers rate of silicide precipitation |

TABLE 13-continued

| Ti-5111 alloying elements and effects on properties | | |
|---|---|---|
| Element | wt % | Effect (S = strength; SCC = stress-corrosion-cracking resistance; W = weldability) |
| | | SCC: >6% forms embrittling $Ti_3Al$ that decreases SCC resistance, want to decrease (Al promotes H solubility in α-Ti and saltwater corrosion) |
| Sn | 1.0 | α stabilizer<br>S: strong substitutional solution hardener in α phase, increases driving force for precipitation of silicides<br>SCC: want to decrease (leads to saltwater corrosion)<br>W: want to decrease (extreme microsegregation) |
| Zr | 1.0 | α and β stabilizer (neutral for phase stabilities)<br>S: strong substitutional solution hardener in α phase, increase ((5:1 ratio with Si) to increase silicide volume fraction), increases silicide solvus temperature, decreases rate of precipitation growth, matrix nucleation on precipitates, promotes uniform silicide distribution, increases driving force for precipitation of silicides<br>SCC: want to decrease (leads to saltwater corrosion)<br>W: increase (reduces the microsegregation of Sn but has high microsegregation itself) |
| V | 1.0 | β stabilizer<br>S: strong substitutional solution hardener in β phase, increase hardness and strength, lowers silicide solvus<br>SCC: increase in combination with Mo (increases resistance to saltwater corrosion but promotes H solubility in α-Ti)<br>W: reduce amount for fusion zone |
| Mo | 0.8 | β stabilizer<br>S: increases hardness and strength, decreases silicide solvus<br>SCC: increase in combination with V (increases resistance to saltwater corrosion but promotes H solubility in α-Ti)<br>W: reduce amount for fusion zone |
| Si | 0.1 | β stabilizer<br>S: increase ((5:1 Zr:Si ratio) to increase silicide volume fraction)<br>W: want to decrease (extreme microsegregation) |
| Fe | 0.1 | Impurity, strong β stabilizer<br>W: want to decrease (extreme microsegregation) |
| O | 0.1 | Impurity α stabilizer, undesirable for SCC resistance |

2. Preventing $Ti_3Al$ and Grain-Boundary α

$Ti_3Al$ is an intermetallic compound of $D0_{19}$ structure (ordered hcp). It is known that too much Al addition to Ti alloys causes $Ti_3Al$ precipitation, which strongly embrittles the alloy. Therefore the final annealing temperature must be higher than $Ti_3Al$ formation temperature, which is calculated by Thermo-Calc with Ti-DATA-v3 database for a given composition.

Figure 37:
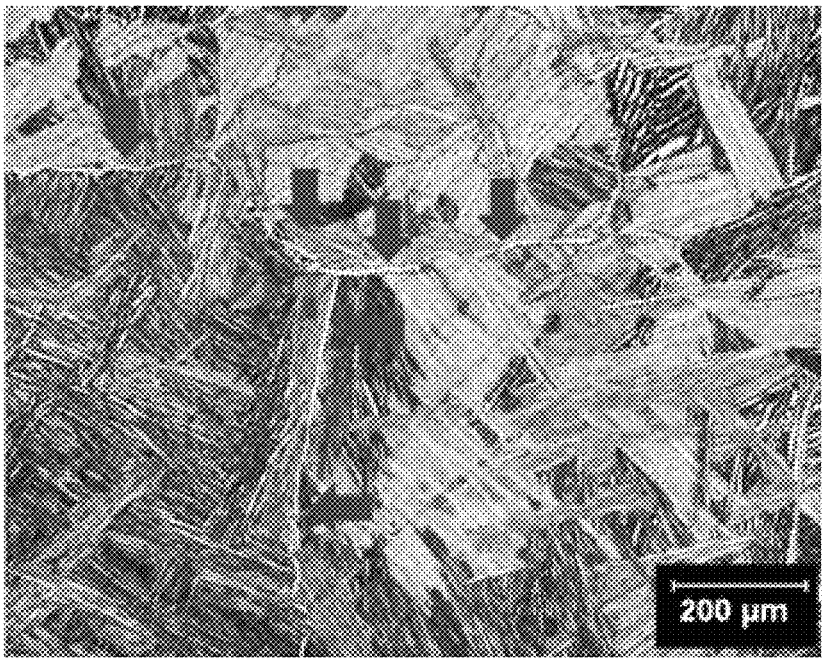
FIG. 37 shows grain-boundary α in Ti-5111 alloy shown by arrows according to certain embodiments of the present invention, where the dilatometric sample is cooled from 950° C. at 15° C./min.
Figure 38:
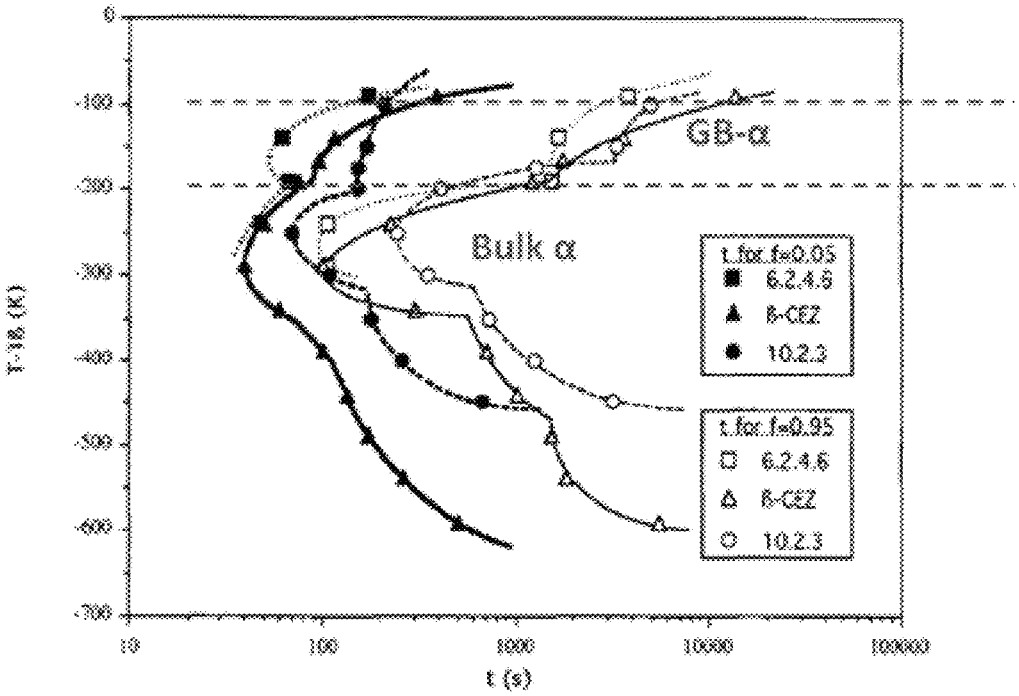
FIG. 38 shows a temperature-time-transformation diagram of three β Ti alloys, relative to their β transus according to certain embodiments of the present invention.

In addition to $Ti_3Al$, grain-boundary α (GB-α) phase is also causes a decrease of fracture toughness. When cooling from β phase region, α phase nucleates preferentially on β grain boundaries. With a small undercooling where the driving force of β→α is small, α phase can grow along β grains and thicken, forming a continuous network of α layer. However, with a large undercooling (and large driving force), α phase grows to the inside of β grains in the form of Widmanstätten plates in colonies. FIG. 37 shows grain-boundary α in Ti-5111 alloy shown by arrows according to certain embodiments of the present invention, where the dilatometric sample is cooled from 950° C. at 15° C./min. FIG. 38 shows a temperature-time-transformation (TTT) diagram of three β Ti alloys, relative to their β transus according to certain embodiments of the present invention. As shown in FIG. 38, the isothermal TTT diagrams of three β Ti alloys have shown that GB-α is most likely to form at 100-200° C. below β transus. In order to inhibit or bypass GB-α formation, the β→α transformation should be slowed before Widmanstätten plates become dominant.

For a multi-component alloy, the normalized rate constant by Morral and Purdy is used as an indicator of transformation kinetics for α precipitates in β matrix of an n-component alloy:

$$\frac{K_{MP}}{\sigma V_m} = \frac{8}{9RT}\left[\left[x_i^\beta - x_i^\alpha\right]^T\left[\frac{\partial^2 G_m^\beta}{\partial x_i \partial x_j}\right]\left[D_{jk}^\beta\right]^{-1}\left[x_k^\beta - x_k^\alpha\right]\right]^{-1}$$

In this equation, σ is the α/β interfacial energy, and $V_m$ is the overall molar volume. $x_i^\beta - x_i^\alpha$ is the difference in composition of element i between the equilibrium α and β phases across a flat interface. $[D]^{-1}$ is the inverse n×n matrix of diffusivities in the matrix β phase. Normalized $K_{MP}$ is calculated at 100° C. lower than β transus by MADE using the Ti-DATA-v3 thermodynamic database and TIMOB12a mobility database (based on TIMOB12 with updated mobilities of Mo, Nb and Ta) in β Ti. The formation ratio of α is assumed as 0.1 to determine $x_i^\beta - x_i^\alpha$.

3. Design Integration

Figure 39:
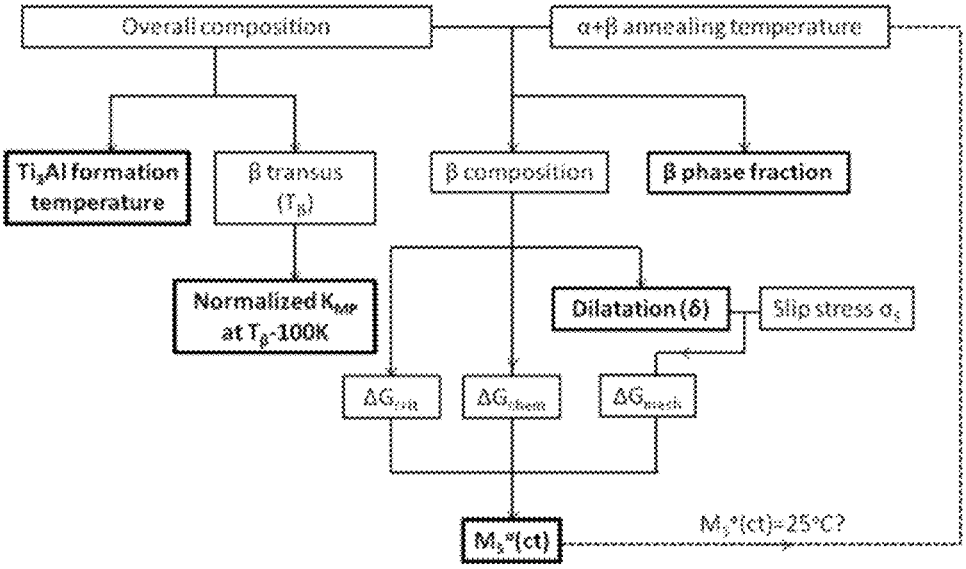
FIG. 39 shows a calculation process for alloy design according to certain embodiments of the present invention.

The objective is to find an optimal overall composition and annealing temperature ($T_{ann}$) to give an $M_S^o$(ct)=25° C. with maximal transformation dilatation, while preventing $Ti_3Al$ and GB-α. The β phase fraction has an upper limit of 20% to maintain the high weldability of near-α Ti alloys. The calculation process is demonstrated by FIG. 39, where key quantities are shown in bold fonts. From the overall composition of a design and a given annealing temperature, $M_S^o$(ct) can be calculated together with other quantities of interest. If $M_S^o$(ct)>25° C., the annealing temperature is lowered to start a new $M_S^o$(ct) calculation. An iterative process can find the required annealing temperature for $M_S^o$(ct)=25° C.

For Ti-5111, equilibrium calculations predict that annealing at 767° C. results in an $M_S^o$(ct) of 25° C. In this condition, the martensite is orthorhombic, with a transformation dilatation of −0.55%. Next, overall composition is adjusted for a larger transformation dilatation. The 1 wt %

Sn and 1 wt % Zr are kept because of their benefits to silicide precipitation for grain refining. 0.1 wt % O and at least 0.1 wt % Fe are also kept because they are common impurities in commercial Ti alloys. After a series of trial calculations, it was found that a good strategy is to increase Fe and Al with decreasing Mo, until the constraint of β phase fraction is reached.

TABLE 14

Alloy design calculations

| # | Overall composition, wt % | | | | | | | | $T_{ann}$(° C.) for $M_s^o$(ct) | δ(%) | f(β) | T($Ti_3Al$)(° C.) | Normalized $K_{MP}$(1E−18) |
|---|---|---|---|---|---|---|---|---|---|---|---|---|---|
| | Al | V | Sn | Zr | Mo | Fe | Si | O | | | | | |
| D00 | 5.0 | 1.0 | 1.0 | 1.0 | 0.8 | 0.1 | 0.1 | 0.1 | 767 | −0.55 | 0.032 | 487 | 7.9 |
| D01 | 5.0 | 2.0 | 1.0 | 1.0 | 0.8 | 0.1 | 0.1 | 0.1 | 747 | −0.66 | | | |
| D02 | 5.0 | 1.0 | 1.0 | 1.0 | 0.4 | 0.1 | 0.1 | 0.1 | 780 | −0.42 | 0.020 | | |
| D03 | 5.0 | 1.0 | 1.0 | 1.0 | 0.0 | 0.1 | 0.1 | 0.1 | 805 | −0.15 | 0.013 | | |
| D04 | 4.0 | 1.0 | 1.0 | 1.0 | 0.8 | 0.1 | 0.1 | 0.1 | 740 | −0.79 | 0.035 | | |
| D05 | 6.0 | 1.0 | 1.0 | 1.0 | 0.4 | 0.1 | 0.1 | 0.1 | 803 | −0.25 | 0.018 | | |
| D06 | 5.0 | 3.0 | 1.0 | 1.0 | 0.0 | 0.1 | 0.1 | 0.1 | 750 | −0.54 | 0.069 | | |
| D07 | 5.0 | 1.0 | 1.0 | 1.0 | 0.0 | 1.0 | 0.1 | 0.1 | 824 | −0.03 | 0.193 | | |
| D08 | 6.0 | 1.0 | 1.0 | 1.0 | 0.0 | 1.0 | 0.1 | 0.1 | 844 | 0.14 | 0.196 | 594 | 179 |
| D09 | 7.0 | 1.0 | 1.0 | 1.0 | 0.0 | 1.0 | 0.1 | 0.1 | 863 | 0.3 | 0.196 | 700 | 215 |
| D10 | 8.0 | 1.0 | 1.0 | 1.0 | 0.0 | 1.0 | 0.1 | 0.1 | 876 | 0.36 | 0.188 | 787 | 258 |
| D11 | 8.0 | 1.0 | 1.0 | 1.0 | 0.0 | 0.5 | 0.1 | 0.1 | 868 | 0.26 | 0.089 | 774 | 330 |
| D12 | 8.0 | 1.0 | 1.0 | 1.0 | 0.0 | 1.5 | 0.1 | 0.1 | 882 | 0.42 | 0.284 | 801 | 200 |
| D13 | 8.0 | 1.0 | 1.0 | 1.0 | 0.8 | 1.0 | 0.1 | 0.1 | 864 | 0.26 | 0.224 | 795 | 7.6 |
| D14 | 8.0 | 1.0 | 1.0 | 1.0 | 0.6 | 0.9 | 0.1 | 0.1 | 865 | 0.27 | 0.195 | 790 | 9.7 |
| | Al | V | Sn | Zr | Nb | Fe | Si | O | | | | | |
| D15 | 8.0 | 1.0 | 1.0 | 1.0 | 1.0 | 0.5 | 0.1 | 0.1 | 858 | 0.02 | 0.096 | 783 | |

Figure 40:
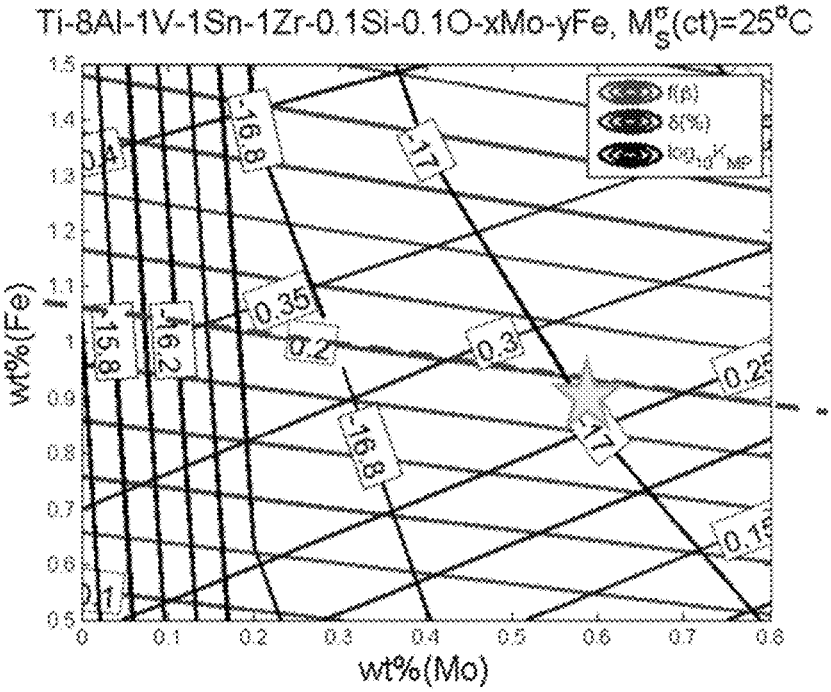
FIG. 40 shows Fe—Mo crossplot for alloy design according to certain embodiments of the present invention.

FIG. 40 shows Fe—Mo crossplot for alloy design according to certain embodiments of the present invention. In certain embodiments, the final design composition is Ti-8Al-1V-1Sn-1Zr-0.6Mo-0.9Fe-0.1Si-0.1O (wt %), annealed at 865° C. Its predicted transformation dilatation is 0.27%, with a β-phase fraction of 19.5%. $Ti_3Al$ forms at 75° C. lower than the annealing temperature. The normalized $K_{MP}$ is slightly larger than that of Ti-5111, due to a reduced amount of the slow diffusing element Mo. An attempt to replace Mo with Nb (D15 compared to D11) decreases transformation dilatation significantly, therefore Mo is kept as the slow diffuser. To compensate the effect of increased rate constant, a cooling rate faster than 20° C./min after β annealing should be used to inhibit the formation of GB-α. Fast cooling after the final (α+β) annealing is also required to keep the microstructure at the annealing temperature.

4. An Estimation of the Yield Strength and Fracture Toughness of the Design

The yield strength of the design alloy can be estimated with reference to Ti-5111. Due to an expected similarity of microstructure, there should not be a significantly difference in Hall-Petch strengthening. The strength difference is primarily due to solution strengthening:

$$YS^{design} = YS^{Ti-5111} + \sum_i P_i\left(X_i^{Design} - X_i^{Ti-5111}\right)$$

where $P_i$ is the solution strengthening coefficient of element i for its overall composition. The strength increment due to the changes of Al, Fe and Mo contents is calculated in Table 15. The yield strength of the design alloy is estimated to be about 890 MPa.

TABLE 15

Yield strength estimation of the design alloy

| | at %, Ti-5111 | at %, Design | Difference | Solution strengthening coefficients (MPa/at %)[171] | Strength contribution (MPa) | Ti-5111 YS (MPa) [2] | Design YS (MPa) |
|---|---|---|---|---|---|---|---|
| Al | 8.66 | 13.56 | +4.9 | 35 | +172 | 690 | 893 |
| Fe | 0.08 | 0.74 | +0.66 | 54 | +36 | | |
| Mo | 0.39 | 0.29 | −0.1 | 54 | −5 | | |

To estimate the toughness increment due to TRIP effect, Ti-1023 was taken as a reference. By comparing the 680° C.-annealed and 720° C.-annealed Ti-1023 samples, an increase of about 120 kJ/$m^2$ may be obtained in $J_{IC}$ toughness by transforming about 70% β phase to strain-induced martensite. Such an increment converts to about 50 MPa·$m^{-1/2}$ for $K_{JIC}$. The design alloy should have about 20% β phase, which contributes at least about 17 MPa·$m^{-1/2}$ to $K_{IC}$ if a proportionality is assumed. In addition, the design alloy should have a larger transformation dilatation, which contributes more fracture toughness. Based on the estimates of solution strengthening and transformation toughening, the design alloy should meet the objectives of strength and toughness as shown in FIG. 1.

In sum, one aspect of the present invention relates to a method of computationally designing a near-α transformation-induced plasticity (TRIP) titanium (Ti) alloy, which includes: creating a thermodynamic database of near-α Ti alloys; tailoring data in the thermodynamic database for martensitic transformations in the near-α Ti alloys near room temperature; and obtaining an overall composite of the near-α TRIP Ti alloy by adjusting a reference overall composite of a reference near-α Ti alloy based on the tailored data in the thermodynamic database. In certain embodiments, a near-α TRIP Ti alloy includes Ti-8Al-1V-1Sn-1Zr-0.6Mo-0.9Fe-0.1Si-0.1O by weight percentage.

In certain embodiments, the near-α TRIP Ti alloy designed by the method may be utilized in various applications, such as building structural components for lightweight watercraft or other suitable occasions.

Aspects of the present invention are further disclosed and described in Appendix A, which is incorporated herein by reference in its entirety as an integral part of the application.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein. Moreover, aspects of the present invention are further disclosed and described in Appendix A, which is incorporated herein by reference in its entirety as an integral part of the application.

Some references, which may include patents, patent applications and various publications, are cited and discussed in the description of this invention in Appendix A. The citation and/or discussion of such references is provided merely to clarify the description of the present invention and is not an admission that any such reference is "prior art" to the invention described herein. All references cited and discussed in the description of this invention in Appendix A, are incorporated herein by reference in its entirety and to the same extent as if each reference was individually incorporated by reference.

What is claimed is:

1. A method of computationally designing a near-α transformation-induced plasticity (TRIP) titanium (Ti) alloy, comprising:

using a thermodynamic database and a mobility database of Ti alloys for α, β, and $Ti_3Al$ phase equilibria and diffusive processes;

based on experimental data, creating a thermodynamic and kinetic database for β-to-α'/α" martensitic transformations in the Ti alloys;

creating a molar volume database for the β-to-α'/α" martensitic transformations in the Ti alloys at room temperature; and obtaining an overall composite of the near-α TRIP Ti alloy by adjusting a reference overall composite of a reference near-α Ti alloy based on the created thermodynamic database, wherein the reference near-α Ti alloy is Ti-5Al-1 Sn-1Zr-1V-0.8Mo-0.1Si-0.1Fe-0.1O by weight percentage (Ti-5111), and wherein the near-α TRIP Ti alloy is Ti-8Al-1V-1Sn-1Zr-0.6Mo-0.9Fe-0.1Si-0.1O by weight percentage.

2. The method of claim 1, wherein a transformation dilatation of the near-α TRIP Ti alloy is greater than that of the reference near-α Ti alloy.

3. The method of claim 1, wherein the near-α TRIP Ti alloy has a β-phase fraction no greater than 20%.

4. The method of claim 1, further comprising:

determining an annealing temperature of the near-α TRIP Ti alloy such that a $M_S^{\circ}$(ct) temperature of the β phase in the near-α TRIP Ti alloy is about room temperature, wherein the $M_S^{\circ}$(ct) temperature is a $M_S^{\circ}$ temperature at a crack-tip (CT) stress state, and the $M_S^{\circ}$ temperature is a temperature at which transformation stress equals parent-phase slip stress.

5. The method of claim 4, wherein the annealing temperature is a temperature higher than a $Ti_3Al$ formation temperature to prevent formation of $Ti_3Al$.

6. The method of claim 4, wherein the annealing temperature is about 865° C.

7. The method of claim 6, wherein the near-α TRIP Ti alloy has a transformation dilatation of about +0.27% and a β-phase fraction of about 19.5%.

8. The method of claim 4, wherein a cooling rate of the near-α TRIP Ti alloy after annealing at the annealing temperature is greater than about 20° C./min to inhibit formation of grain-boundary α (GB-α) phase in the near-α TRIP Ti alloy.

9. The method of claim 4, wherein a normalized rate constant $K_{MP}$ of the near-α TRIP Ti alloy is obtained by:

$$\frac{K_{MP}}{\sigma V_m} = \frac{8}{9RT}\left[\left[x_i^{\beta} - x_i^{\alpha}\right]^T \left[\frac{\partial^2 G_m^{\beta}}{\partial x_i \partial x_j}\right]\left[D_{jk}^{\beta}\right]^{-1}\left[x_k^{\beta} - x_k^{\alpha}\right]\right]^{-1},$$

wherein σ is an α/β interfacial energy, $V_m$ is an overall molar volume, $x_i^{\beta}-x_i^{\alpha}$ is the difference in composition of element i between the equilibrium α and β phases across a flat interface, and $[D]^{-1}$ is an inverse n×n matrix of diffusivities in a matrix β phase.

10. The method of claim 9, wherein the normalized rate constant $K_{MP}$ is calculated at about 100° C. lower than a β transus temperature ($T_{\beta}$).

* * * * *